US012788161B2

(12) United States Patent
Fontecchio et al.

(10) Patent No.: US 12,788,161 B2
(45) Date of Patent: Nov. 10, 2026

(54) FIELD-INSTALLABLE REFRIGERATED CABINET KIT WITH ON-CABINET REFRIGERATION SYSTEM

(71) Applicant: True Manufacturing Co., Inc., O'Fallon, MO (US)

(72) Inventors: Joseph Fontecchio, St. Peters, MO (US); John Friend, Washington, MO (US); Christian Pizzi, St. Peters, MO (US); Daniel Pestka, Wentzville, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 0 days.

(21) Appl. No.: 19/382,789

(22) Filed: Nov. 7, 2025

(65) Prior Publication Data

US 2026/0123772 A1 May 7, 2026

Related U.S. Application Data

(63) Continuation of application No. 18/918,447, filed on Oct. 17, 2024, which is a continuation of application (Continued)

(51) Int. Cl.
*A47F 3/04* (2006.01)
*F25D 19/02* (2006.01)

(Continued)

(52) U.S. Cl.
CPC ..... *A47F 3/0408* (2013.01); *A47F 3/0426* (2013.01); *F25D 19/02* (2013.01);

(Continued)

(58) Field of Classification Search
CPC ..... A47F 3/0408; A47F 3/0426; F25D 19/00; F25D 19/02; F25D 19/04; F25D 21/14;

(Continued)

(56) References Cited

U.S. PATENT DOCUMENTS 3,712,078 A 1/1973 Maynard et al.
4,776,182 A 10/1988 Gidseg (Continued)

FOREIGN PATENT DOCUMENTS

CN 106037353 A 10/2016
DE 102017113873 A1 12/2018

(Continued)

OTHER PUBLICATIONS

KR-20120140001-A Translation (Year: 2012).*

(Continued)

*Primary Examiner* — David J Teitelbaum
(74) *Attorney, Agent, or Firm* — Stinson LLP

(57) ABSTRACT

A field-installable refrigerated merchandiser kit includes a reach-in cabinet having an interior, a top wall above the interior, and one or more cabinet systems integrated into the reach-in cabinet. The kit includes a refrigeration system with, a temperature controller with a user interface, a main electrical distribution assembly including an enclosure and a main power cable terminated by a plug-in connector, and a power distribution cable terminated by a plug-in connector. In kit form, the refrigeration system, main electrical distribution assembly, and temperature controller are detached from the top wall and the refrigeration system is electrically disconnected from the main power cable. The kit is installed as a refrigerated merchandiser via a field installation process involving mounting the components to the top wall and making plug-in connections. When installed, the main electrical distribution assembly distributes power and the temperature controller thermostatically controls the sealed refrigeration circuit and the cabinet systems.

29 Claims, 32 Drawing Sheets

Related U.S. Application Data

No. 17/481,747, filed on Sep. 22, 2021, now Pat. No. 12,150,566.

(60) Provisional application No. 63/082,805, filed on Sep. 24, 2020.

(51) Int. Cl.
*F25D 19/04* (2006.01)
*F25D 21/14* (2006.01)
*F25D 25/02* (2006.01)

(52) U.S. Cl.
CPC ..... *F25D 19/04* (2013.01); *F25D 21/14* (2013.01); *F25D 25/02* (2013.01); *F25D 2700/02* (2013.01); *F25D 2700/12* (2013.01)

(58) Field of Classification Search
CPC ... F25D 25/02; F25D 2700/02; F25D 2700/12
See application file for complete search history.

(56) References Cited

U.S. PATENT DOCUMENTS

| | | | | |
|---|---|---|---|---|
| 4,800,732 | A | 1/1989 | Newton | |
| 5,086,627 | A | 2/1992 | Borgen | |
| 5,284,023 | A | 2/1994 | Silva et al. | |
| 5,580,155 | A | 12/1996 | Hildebrand et al. | |
| 5,809,789 | A | 9/1998 | Baker et al. | |
| 5,824,023 | A | 10/1998 | Anderson | |
| 5,953,929 | A * | 9/1999 | Bauman | F25D 21/14 62/448 |
| 6,128,911 | A | 10/2000 | Mathews et al. | |
| 6,216,479 | B1 | 4/2001 | Elwood | |
| 6,701,739 | B2 | 3/2004 | Morse | |
| 6,948,324 | B2 | 9/2005 | Jin | |
| 8,522,565 | B1 | 9/2013 | Hauck et al. | |
| 11,293,690 | B1 * | 4/2022 | Whitfield | F25D 19/02 |
| 2003/0140639 | A1 | 7/2003 | Gray et al. | |
| 2003/0230104 | A1 | 12/2003 | Morse | |
| 2005/0092012 | A1 * | 5/2005 | Hirano | F25D 29/00 62/298 |
| 2005/0126196 | A1 * | 6/2005 | Grassmuck | A47F 3/0443 62/298 |
| 2005/0172654 | A1 | 8/2005 | Rohrer et al. | |
| 2005/0262863 | A1 | 12/2005 | Iguchi et al. | |
| 2006/0107677 | A1 | 5/2006 | Iguchi et al. | |
| 2006/0201175 | A1 | 9/2006 | Shapiro et al. | |
| 2007/0000273 | A1 * | 1/2007 | Sanders | F25D 21/14 62/285 |
| 2008/0202154 | A1 | 8/2008 | Salt | |
| 2010/0012291 | A1 | 1/2010 | Sporie | |
| 2014/0096545 | A1 * | 4/2014 | Zangari | F25D 19/02 62/248 |
| 2014/0260360 | A1 | 9/2014 | Rasch | |
| 2017/0172317 | A1 * | 6/2017 | Hay | A47F 9/04 |
| 2017/0214277 | A1 | 7/2017 | Jeong et al. | |
| 2018/0120017 | A1 | 5/2018 | Wilson et al. | |
| 2018/0352973 | A1 | 12/2018 | Lauri | |
| 2019/0226749 | A1 | 7/2019 | Lee | |
| 2019/0293322 | A1 | 9/2019 | Ullah | |
| 2020/0300525 | A1 | 9/2020 | Jacobi | |
| 2021/0059433 | A1 | 3/2021 | Lennon | |

FOREIGN PATENT DOCUMENTS

| | | | | |
|---|---|---|---|---|
| DE | 102018108230 | A1 | 10/2019 | |
| JP | S5314455 | A | 2/1978 | |
| JP | H10220948 | A | 8/1998 | |
| JP | 2020085406 | A | 6/2020 | |
| KR | 1020110118196 | A | 10/2011 | |
| KR | 20120140001 | A * | 12/2012 | F25D 17/06 |
| KR | 1020120140001 | A | 12/2012 | |
| RU | 197434 | U1 | 4/2020 | |
| RU | 205617 | U1 | 7/2021 | |
| WO | 2016118820 | A1 | 7/2016 | |
| WO | 2020/014279 | A1 | 1/2020 | |

OTHER PUBLICATIONS

Invitation to Pay Additional Fees, And Where Applicable, Protest Fee, International Application No. PCT/US2021/051785 dated Jan. 26, 2022, 54 pages.
True Manufacturing Company et al. : "Spec Series—STR, STA & STG", Sep. 11, 2020, XP55878254, Retrieved from the Internet: URL: https://www.youtube.com/watch?v=Ogai_fLoDlo.
Zero Zone, "Highlight Merchandiser RHZC30 Hybrid LCCU EPT Specs," dated Jun. 24, 2019, SS-99-B, 2 pages.
Partial Search Report from EP Application No. 24223109.0, dated Mar. 11, 2025, 17 pages.
Freedom Line, Aug. 12, 2020, retrieved from https://web.archive.org/web/20200812232812/https://www.hussmann.com/freedom-line, 7 pages.
Hybrid Display Cases, Nov. 12, 2019, retrieved from https://web.archive.org/web/20191112232638/https://www.zero-zone.com/hybrid-display-cases/, 3 pages.
Hybrid Merchandiser™ Installation Video, YouTube upload date: Jan. 15, 2020, https://www.youtube.com/watch?v=LaFAw6y_FU4, 7 pages.
Hussmann Freedom Line Multi Deck, Installation & Operation Manual P/N 0527427_M Excel Series, Sep. 2018, 110 pages.
Turpin, "Embraco showcased its vision for the future of refrigeration", the ACHR News, Feb. 18, 2019, 7 pages.
Hussmann Freedom Line RFLNS with Innovator Doors Technical Data Sheet P/N 0541253_L, May 2020, 8 pages.
Hussmann Freedom Line RFMNS with Innovator Doors Technical Data Sheet P/N 0541256_M, Apr. 2020, 9 pages.
Hussmann Freedom Line RFL with Innovator Doors or Innovator III Doors Low Temperature Technical Data Sheet P/N 3002316_F, Apr. 2020, 10 pages.
Hussmann Freedom Line RFM with Innovator Doors Medium Temperature Technical Data Sheet P/N 3056469_F, Apr. 2020, 10 pages.
"Hussmann launches complete store, propane micro distributed solution in the United States", from https://www.hussmann.com/news/hussmann-launches-complete-store-propane-micro-distributed-solution-united-states, Oct. 30, 2018, 4 pages.
"Embraco launches innovative solutions for cooling with R-290", https://heatinghelp.com/news-and-media/industry- news/embraco-launches-innovative-solutions-for-cooling-with-r-290/, Jan. 23, 2015, 9 pages.
ZeroZone, Crystal Merchandiser® RVLC30 Hybrid™ Specs, May 29, 2020, 2 pages.
ZeroZone, Crystal Merchandiser® RVMC30 Hybrid™ Specs, Aug. 25, 2020, 2 pages.
ZeroZone, Highlight Merchandiser® RHCC30 Hybrid™ Specs, Aug. 25, 2020, 2 pages.
ZeroZone, Highlight Merchandiser® RHZC30 Hybrid™ Specs, May 29, 2020, 2 pages.
ZeroZone, Highlight Merchandiser® RHCC30T Tall Hybrid™ Specs, Aug. 25, 2020, 2 pages.
ZeroZone, Highlight Merchandiser® RHZC30T Tall Hybrid™ Specs, May 29, 2020, 2 pages.

* cited by examiner

FIELD-INSTALLABLE REFRIGERATED CABINET KIT WITH ON-CABINET REFRIGERATION SYSTEM

CROSS-REFERENCE TO RELATED APPLICATION

This application claims priority to U.S. Provisional Patent Application No. 63/082,805, filed Sep. 24, 2020, which is hereby incorporated by reference in its entirety for all purposes.

FIELD

The present disclosure pertains generally to a refrigerated merchandiser, as well as to a refrigerated cabinet kit comprising one or more field-installable refrigeration system modules configured to be releasably and operably mounted and installed on a cabinet module to form a refrigerated merchandiser.

BACKGROUND

Reach-in refrigerated cabinets have access doors and are used to store and/or display refrigerated goods. One well-known type of refrigerated reach-in cabinet is a display refrigerated merchandiser. Conventionally, there are two types of refrigerated merchandisers: (1) the self-contained type and (2) the remote refrigeration type. The United States Department of Energy's regulations differentiate between self-contained and remote refrigeration systems. For example, energy consumption regulations for self-contained refrigeration systems are based on the measured energy consumption of the machinery, whereas energy consumption regulations for remote refrigeration systems are based on refrigerant mass flow and calculated assumptions of electrical loads.

Self-contained merchandisers are prefabricated assemblies comprising a cabinet with an integrated refrigeration system. In many self-contained merchandisers, the refrigeration systems are hermetically sealed so that there is no loss of refrigerant through access valves or mechanical connections. The refrigeration system in a self-contained merchandiser is precisely engineered for the application and applicable regulations, accounting for the size of the cabinet, the loads, and the temperature requirements. Compliance with these constraints enables self-contained merchandisers to operate very efficiently in comparison with remote refrigeration merchandisers (discussed below). Self-contained merchandisers can employ onboard systems for removing condensate that forms on the refrigeration system without separate drain connections. Air-cooled self-contained merchandisers only require a single cord and plug electrical connection to operate. Water-cooled self-contained merchandisers require only a single cord and plug electrical connection and a water connection for removing heat from the condenser. This makes self-contained merchandisers a preferred option for retailers that lease their buildings or otherwise require the refrigeration cabinet to occasionally be moved from place to place within the building.

Remote refrigeration merchandisers, by contrast, are commonly built into a retail building at the time of deployment. Most typically, a refrigeration system for a plurality of remote merchandiser cabinets is installed on the roof of a building and the merchandiser cabinets are installed as fixtures inside the building such that they are physically separated from the remote refrigeration system components by the building's roof. HVAC contractors must make refrigeration connections between evaporators mounted inside the cabinet and the piping chases that connect the merchandiser to the remote condenser, which is typically located on the building roof. (Not all remote refrigeration systems are on the rooftop. There are mechanical rooms that house these at times.) In addition, to address the condensate that forms on the evaporator during use, a plumber must make a drain connection between a condensate removal line of the cabinet and the building's drain line, which usually runs in a trench under the floor of the cabinet. Occasionally, hoses and pumps can be used to send the condensate to a heated drain pan. Lastly, electrical connections are provided by an electrician as remote refrigeration is a fixed installation. Thus, remote refrigeration merchandisers are most suitable for retailers that own or have very long-term leases on retail buildings due to the trenching in the flooring to run refrigerant lines, drain water, and electrical cables. In addition to the inherent permanence of a remote refrigeration merchandiser, another disadvantage of remote refrigeration systems in relation to self-contained merchandisers is operating efficiency. To ensure that the necessary refrigeration capacity is always available, refrigeration systems mounted on the roof or remote locations of the building are typically oversized in relation to the actual refrigeration requirements of the cabinets deployed inside the building. In other words, remote refrigeration systems lack the application-specific engineering of their self-contained counterparts. This is due to the approach to sizing the refrigeration systems. Remote systems must consider seasonal fluctuations of outdoor temperatures and running multiple different products (freezers, refrigerators, floral, etc.) cabinets off of the same refrigeration system sized for worst case conditions. In this way, each cabinet consumes what it needs from a hypothetical endless cooling source. Furthermore, because the refrigeration, plumbing, and electrical connections must all be made in the field, remote refrigeration merchandisers are never hermetically sealed and are much more prone to water and refrigerant leaks. Refrigerant leaks are extremely detrimental to the environment and generate reoccurring installation costs.

The advantage that remote refrigeration merchandisers have had over self-contained merchandisers is greater "pack out," which refers to the usable available space inside the merchandiser for holding saleable merchandise. A typical self-contained merchandiser in the same footprint will have less pack out as it contains the condenser and compressor portions of the refrigeration circuit.

Because remote refrigeration cabinets are often deployed when the building is being constructed (or remodeled for a particular purpose), the cabinets are often installed into the building by a crane before a roof is put in place. By contrast, self-contained merchandiser cabinets, because of how they are intended to be used, must be able to fit through a doorway of a standard-height man door (e.g., a doorway of no more than eight feet in height e.g., a doorway of no more than seven feet or a doorway having a height of about 82 inches). Furthermore, in a remote refrigeration merchandiser, the space taken up by refrigeration components inside the building is minimal, since many of the major mechanical components of the refrigeration system are located remotely. By contrast, existing self-contained merchandisers must physically contain and support all the refrigeration system components within the envelope of the unit, which again must be able to fit through a standard-height door.

To increase the pack out of merchandisers that are still at least somewhat portable and able to be deployed through a standard-height doorway, a third type of merchandiser has recently become available that combines aspects of self-contained and remote refrigeration merchandisers. This third type of merchandiser does not yet have an industry standard name or definition. But in essence, the type consists of two separate modules that can be assembled together as a kit in the field. The first module is a cabinet module that is sized to fit through a standard-height doorway, and the second module is a refrigeration system module that likewise fits through a standard-height doorway. Further, the refrigeration system module is configured to be installed on the cabinet module after both modules are in the building. Thus, the third type of merchandiser comprises a field-installable refrigeration system that is configured to be supported on a cabinet. Examples of field-installable, self-supporting merchandisers are the hybrid display cases sold by Zero Zone and the Freedom merchandisers sold by Hussmann. In these systems, the cabinet module includes an evaporator unit and the condensing unit is initially provided as a separate module from the cabinet module. A mechanical field-installed refrigeration connection is made by a certified refrigeration technician between the condensing unit and the evaporator in the cabinet module in the field.

SUMMARY

In one aspect, a field-installable refrigerated merchandiser kit comprises a cabinet module having an exterior and an interior and configured to define a free refrigerated space in the interior. A prefabricated refrigeration system module is configured to operatively connect to the cabinet module for cooling the free refrigerated space. The prefabricated refrigeration system module is separate from the cabinet module. The prefabricated refrigeration system module and the cabinet module comprise mutual connection fittings configured to releasably and operatively connect the prefabricated refrigeration system module to the cabinet module for cooling the interior of the cabinet module.

In another aspect, a refrigerated merchandiser comprises a cabinet defining a free refrigerated space and having a front and a width. The cabinet includes a plurality of shelves in the free refrigerated space. The cabinet has a shelf space volume comprised of volume in the free refrigerated space located above the shelves. A prefabricated refrigeration system module is removably connected to the cabinet for cooling the free refrigerated space. The prefabricated refrigeration system module includes a complete refrigeration circuit. The prefabricated refrigeration system module being is configured to disconnect from the refrigerated merchandiser for removal as a unit solely by removing one or more removable fasteners and disconnecting one or more plug-in connectors. The refrigerated merchandiser is configured to be deployed against a backing structure such that the refrigerated merchandiser occupies a footprint equal to the width times a front-to-back-distance from the front of the cabinet to the backing structure. The refrigerated merchandiser has a ratio of the shelf space volume to the foot print greater than 3.25 $ft^3/ft^2$.

In another aspect, a refrigerated merchandiser comprises a reach-in cabinet defining a common refrigerated space and a plurality of refrigeration systems. Each refrigeration system comprises an evaporator, a compressor, a condenser, an expansion valve, and interconnecting tubing. Each refrigeration system is configured to be entirely supported on the reach-in cabinet and configured to be operatively connected to the reach-in cabinet for cooling the common refrigerated space. Each refrigeration system comprises an independent temperature controller.

In another aspect, a refrigerated merchandiser comprises a reach-in cabinet defining a common refrigerated space, a single power input, a plurality of high voltage plug-in connectors operatively connected to the single power input, and a plurality of refrigeration systems configured to be operatively connected to the reach-in cabinet for cooling the common refrigerated space. Each refrigeration system comprises a power cable configured to make a plug-in connection to one of the plug-in connectors whereby the cable operatively connects the refrigeration system to the single power input for drawing power from the single power input for cooling the common refrigerated space.

In another aspect, a refrigerated merchandiser comprises a reach-in cabinet defining a common refrigerated space. A plurality of refrigeration systems are configured to be operatively connected to the reach-in cabinet for cooling the common refrigerated space. Each refrigeration system comprises a defrost heater and an evaporator fan. The refrigerated merchandiser is configured periodically execute a defrost cycle in each refrigeration system in which the temperature controller turns on the defrost heater and turns off the evaporator fan for a period of time, wherein the refrigerated merchandiser is configured to execute the defrost cycles in each refrigeration system at different times.

In another aspect, a refrigerated merchandiser comprises a reach-in cabinet defining a common refrigerated space, a single power input, and a plurality of refrigeration systems configured to be operatively connected to the reach-in cabinet and to the single power input for drawing power from the single power input for cooling the common refrigerated space. Each refrigeration system further comprises a variable speed compressor and an inverter configured to gradually increase compressor speed at startup to moderate inrush of current to the refrigerated merchandiser on startup.

In another aspect. a refrigerated merchandiser comprises a reach-in cabinet separating a common refrigerated space from an unrefrigerated space. A plurality of refrigeration systems are configured to be operatively connected to the reach-in cabinet for cooling the common refrigerated space. Each refrigeration system comprises a heat absorbing heat exchanger configured for thermal communication with the common refrigerated space and a heat rejecting heat exchanger configured to reject heat to the unrefrigerated space. One or more isolators provide thermal isolation of the heat rejecting heat exchangers.

In another aspect, a method of repairing a refrigerated merchandiser comprises removing a defective one of a plurality of refrigeration systems from a reach-in cabinet that defines a common refrigerated space cooled by the plurality of refrigeration systems. While the defective one of the plurality of refrigeration systems is removed, the common refrigerated space is cooled with one or more remaining ones of the plurality of refrigeration systems. An operating refrigeration system is subsequently installed on the reach-in cabinet for cooling the common refrigerated space with said one or more remaining ones of the refrigeration systems.

In another aspect, a refrigerated merchandiser comprises a cabinet defining a free refrigerated space. A refrigeration system is connected to the cabinet for cooling the free refrigerated space. The cabinet has a kick plate or a door defining a front plane of the cabinet. The refrigerated merchandiser is configured to be deployed against a backing structure such that the front plane is spaced apart from the backing structure by a front-to-back distance of less than or equal to 40 inches. The refrigerated merchandiser further comprises a plurality of shelves having a front-to-back shelf depth of greater than 24 inches.

In another aspect, a cabinet for a refrigerated merchandiser comprises walls defining an interior that includes a free refrigerated space. The walls include a top wall, a bottom wall, and a back wall. The top wall defines a cold air inlet through which cold air is passable into the free refrigerated space. The top wall defines a return air outlet through which return air is passable out of the free refrigerated space. The cold air inlet is spaced apart from the return air outlet. The top wall comprises an attachment fixture for releasably and operably attaching a refrigeration system to the cabinet module such that: (i) the refrigeration system is supported on top of the cabinet module; (ii) the refrigeration system is configured to direct cold air from an evaporator into the free refrigerated space through the cold air inlet; and (iii) the refrigeration system is configured to direct return air from the free refrigerated space through the return air outlet.

In another aspect, a prefabricated field-installable refrigeration system module comprises a base having an evaporator portion and a condenser portion. A refrigeration circuit is supported on the base. The refrigeration circuit comprises an evaporator above the evaporator portion and a condenser above the condenser portion. An insulated wall is connected to the base between the evaporator portion and the condenser portion. The insulated wall provides thermal separation of the evaporator and the condenser. The evaporator portion of the base defines a cold air outlet and a return air inlet. The base is configured to couple to a top wall of a merchandiser cabinet such that the refrigeration system is configured to direct cold air from the evaporator into a free refrigerated space of the cabinet through the cold air outlet and is configured to draw return air from the interior of the cabinet across the evaporator through the return air inlet.

In another aspect, a prefabricated field-installable refrigeration system module comprises a base. A refrigeration circuit is supported on the base. The base is configured to couple to a top wall of a merchandiser cabinet such that the entire prefabricated field-installable refrigeration system is above the top wall and the refrigeration system is configured to direct cold air from the evaporator into a free refrigerated space of the cabinet and is configured to draw return air from the interior of the cabinet across the evaporator. The prefabricated field-installable refrigeration system module is configured to be lifted by the base as a unit onto the top wall of the cabinet.

In another aspect, a prefabricated field-installable refrigeration system module comprises a base defining a cold air outlet and a return air inlet and having a bottom. A refrigeration circuit is supported on the base. The refrigeration circuit comprises an evaporator and a condenser. A cold air gasket on the bottom of the base extends 360° about the cold air outlet. A return air gasket on the bottom of the base extending 360° about the return air inlet. The base is configured to couple to a top wall of a merchandiser cabinet such that the each of the cold air gasket and the return air gasket is compressed between the base and the top wall to form respective fluid seals about the cold air outlet and the return air inlet for directing cold air from the evaporator into a free refrigerated space of the cabinet through the cold air outlet and drawing return air from the interior of the cabinet across the evaporator through the return air inlet.

In another aspect, a refrigerated merchandiser comprises a cabinet having a free refrigerated space cross-sectional area in a front-to-back plane perpendicular to a width of the cabinet. The free refrigerated space cross-sectional area is at least about 1350 square inches. A refrigeration system is mounted on the cabinet. The refrigeration system comprises one or more hermetically sealed refrigeration circuits comprising r290 refrigerant.

In another aspect, a method of deploying a refrigerated merchandiser in the field comprises lifting a prefabricated refrigeration system module onto a top wall of a cabinet module when a rail of the prefabricated refrigeration system module is in a lowered position to define a bottom of the prefabricated refrigeration system module. The prefabricated refrigeration system module is slid on the rail along the top wall of the cabinet module. The rail is raised to compress a gasket of the prefabricated refrigeration system module onto the top wall of the cabinet module.

In another aspect, a refrigerated merchandiser comprises a cabinet having a unit volume and a free refrigerated space volume that is at least 60% of the unit volume.

In another aspect, a refrigerated merchandiser comprises a cabinet having a unit cross-sectional area and a free refrigerated space cross-sectional area that is at least 65% of the unit cross-sectional area.

In another aspect, a refrigerated merchandiser comprises a cabinet having an occupied volume and a free refrigerated space volume that is at least 60% of the occupied volume.

In another aspect, a refrigerated merchandiser comprises a cabinet having an occupied cross-sectional area and a free refrigerated space cross-sectional area that is at least 60% of the occupied cross-sectional area.

In another aspect, a field-installable refrigerated merchandiser kit comprises a cabinet module having an interior configured to define a free refrigerated space. The cabinet module comprises a top wall defining an upper end of the interior. A prefabricated refrigeration system module is configured to operatively connect to the top wall of the cabinet module to cool the free refrigerated space. The prefabricated refrigeration system module is separate from the cabinet module. The prefabricated refrigeration system module and the cabinet module comprise mutual connection fittings configured to releasably and operatively connect the prefabricated refrigeration system module to the cabinet module. The cabinet module has a unit cross-sectional area and a free refrigerated space cross-sectional area. The free refrigerated space cross-sectional area is at least 65% of the unit cross-sectional area.

In another aspect, a field-installable refrigerated merchandiser kit comprises a cabinet module having an interior configured to define a free refrigerated space. The cabinet module comprises a top wall defining an upper end of the interior. A prefabricated refrigeration system module is configured to operatively connect to the top wall of the cabinet module to cool the free refrigerated space. The prefabricated refrigeration system module is separate from the cabinet module. The prefabricated refrigeration system module and the cabinet module comprise mutual connection fittings configured to releasably and operatively connect the prefabricated refrigeration system module to the cabinet module. When the prefabricated refrigeration system module is operatively connected to the top wall of the cabinet module, the refrigerated merchandiser is configured to have an occupied cross-sectional area and a free refrigerated space cross-sectional area. The free refrigerated space cross-sectional area is at least 60% of the occupied cross-sectional area.

Other aspects and features will be apparent hereinafter.

BRIEF DESCRIPTION OF THE DRAWINGS

Corresponding reference characters indicate corresponding parts throughout the drawings.

DETAILED DESCRIPTION

The inventors have recognized several drawbacks to existing refrigerated merchandisers with field-installable, on-cabinet refrigeration systems. In particular, every existing product of this type requires a portion of the refrigeration system to be received into the interior of the cabinet. This reduces pack-out volume and also creates challenges with servicing and repairing the refrigeration system. In particular, a service technician often must access at least portions of the refrigeration system from inside the refrigerated interior to complete a repair. This requires the retailer to unpack the merchandiser before servicing, which creates a substantial disruption in retail operations. In addition, all existing field-installable, on-cabinet merchandisers require plumbing connections to be made in the field to address the condensate byproduct of refrigeration. Most typically, a technician must install a water pump and piping along the back of the cabinet for pumping condensate from a condensate pan located under the cabinet to an evaporation tray on top of the cabinet. The field-installed plumbing provides an opportunity for leaks and also requires the cabinet to be mounted away from the wall to leave space for piping and plumbing. Usable height is also reduced by the condensate pan and pump which conventionally reside below the cabinet.

Figure 1:
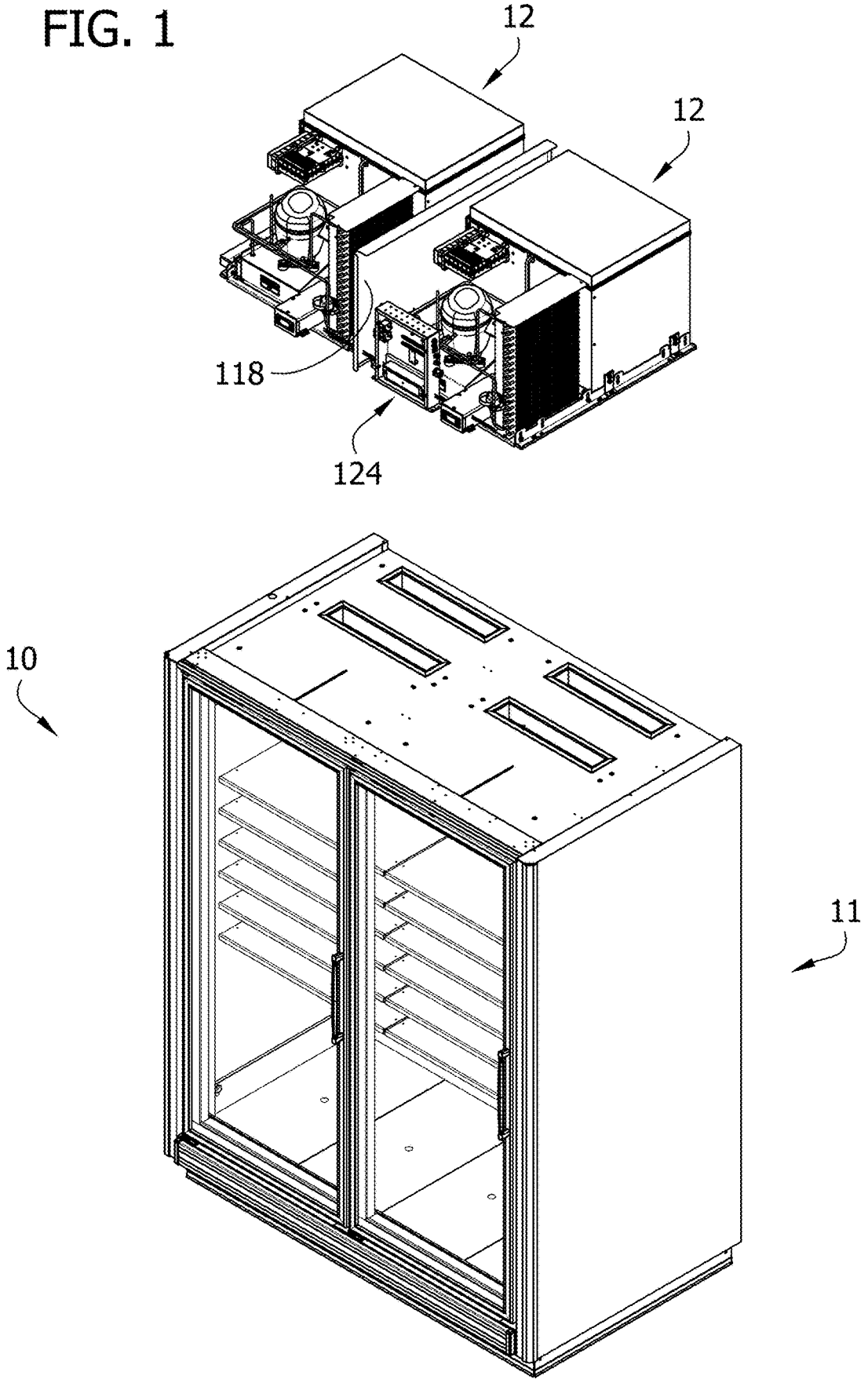
FIG. 1 is a perspective of a field-installable refrigerated merchandiser kit including a cabinet module and a separate refrigeration system module.
Figure 1A:
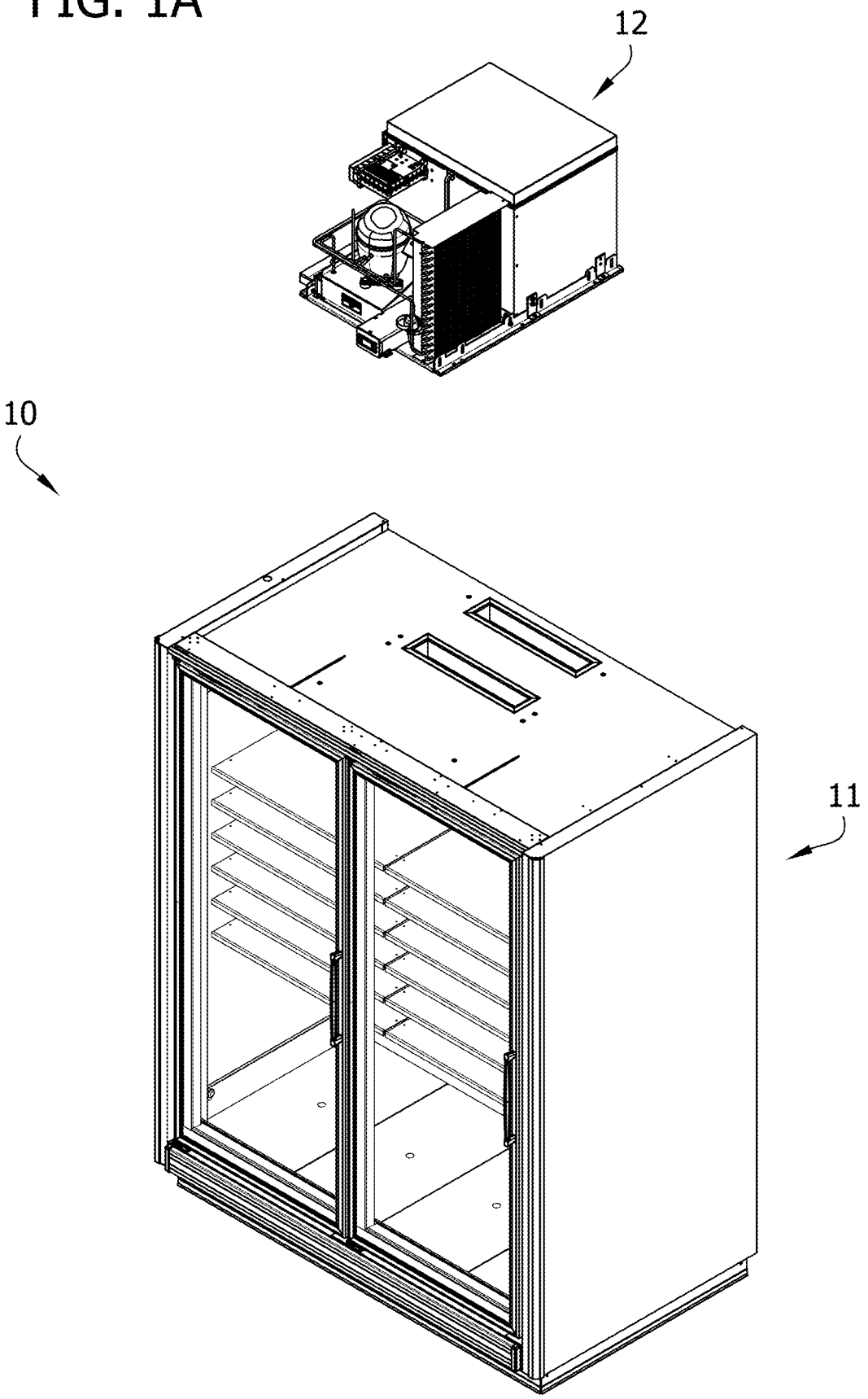
FIG. 1A is a perspective similar to FIG. 1 of another modular configuration of a field-installable refrigerated merchandiser kit.
Figure 1B:
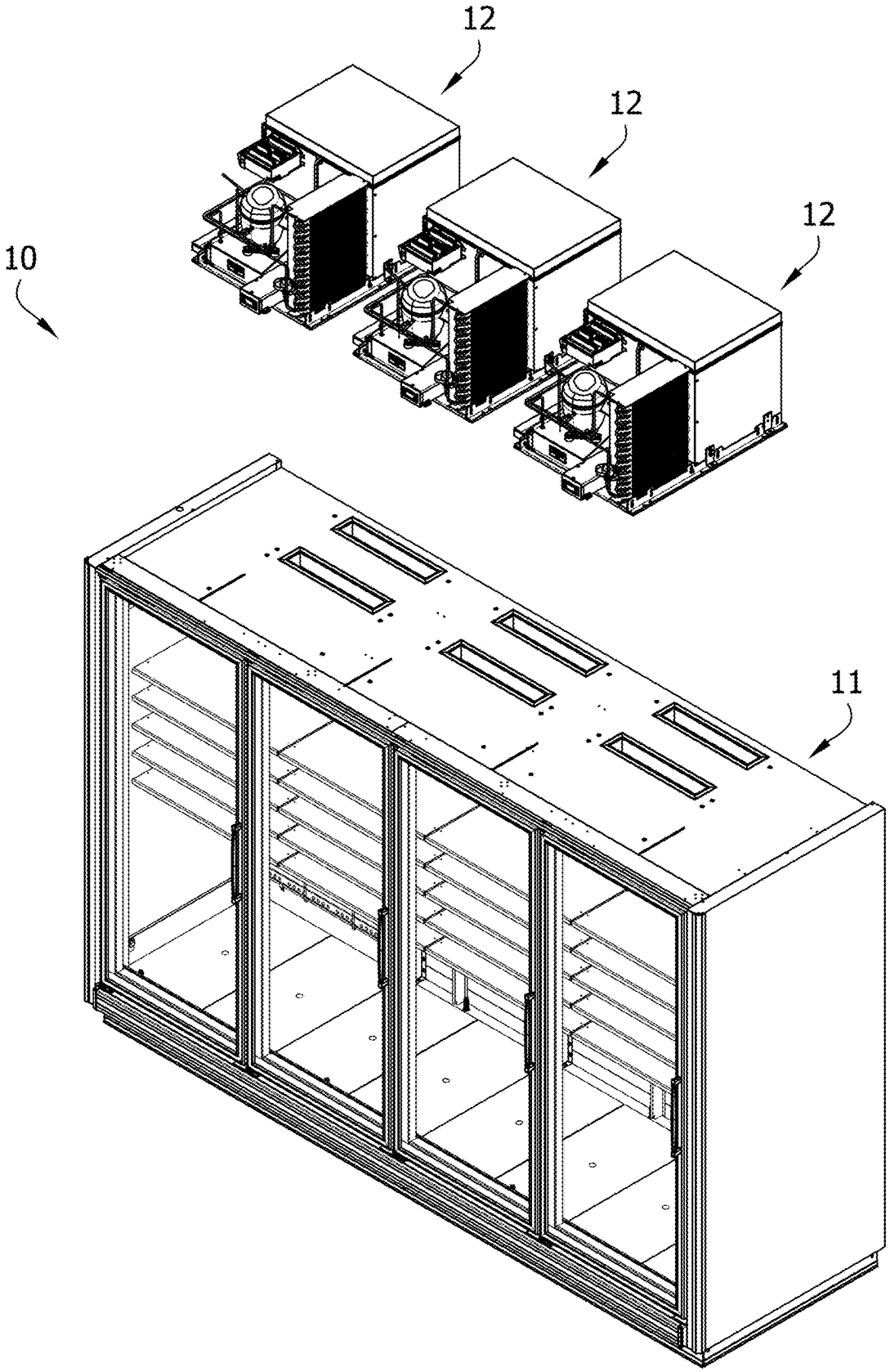
FIG. 1B is a perspective similar to FIG. 1 of still another modular configuration of a field-installable refrigerated merchandiser kit.

Referring to FIGS. 1-1B, in one aspect, the present disclosure relates to a field-installable refrigerated cabinet "kit," generally indicated at reference number 10. The illustrated merchandiser kit 10 comprises a cabinet module 11 and one or more separate refrigeration system modules 12 configured to be installed on the cabinet module in the field (that is, at the site of end use, not at a separate factory or fabrication site). The term "kit" is used in this disclosure to refer to a set of separate parts purpose-built for being assembled together into a larger whole. For example, the cabinet module 11 and each refrigeration system module 12 are separate parts of a kit 10 that can be assembled together to form the refrigerated merchandiser 10' shown in FIG. 2. In certain embodiments, the kit may include instructions for assembling the separate parts of the kit together to form a refrigerated cabinet.

Providing the refrigerated merchandiser as a field-installable kit instead of as a prefabricated, all-in-one, self-contained refrigeration cabinet allows for a larger cabinet and greater pack-out volume than traditional self-contained merchandisers but still allows the merchandiser to be delivered through a standard-height man door. Thus, in one or more embodiments, each cabinet module 11 and each prefabricated refrigeration system module 12 is configured to fit upright through a doorway of a standard-height man door having a height of less than or equal to eight feet (e.g., a doorway of no more than seven feet or a height of about 82 inches). To maximize pack-out depth, it may be desirable in certain circumstances to design the cabinet module 11 so that it is too large to fit through a single-door doorway of 36 inches or less. In other words, a double-door man doorway may be required to deliver certain embodiments of the cabinet module 11 into a building. However, it is expressly contemplated that cabinet modules in the scope of this disclosure may be constructed and arranged to fit through a single-door man doorway having a height of less than or equal to seven feet and a width of less than or equal to 36 inches.

Figure 2:
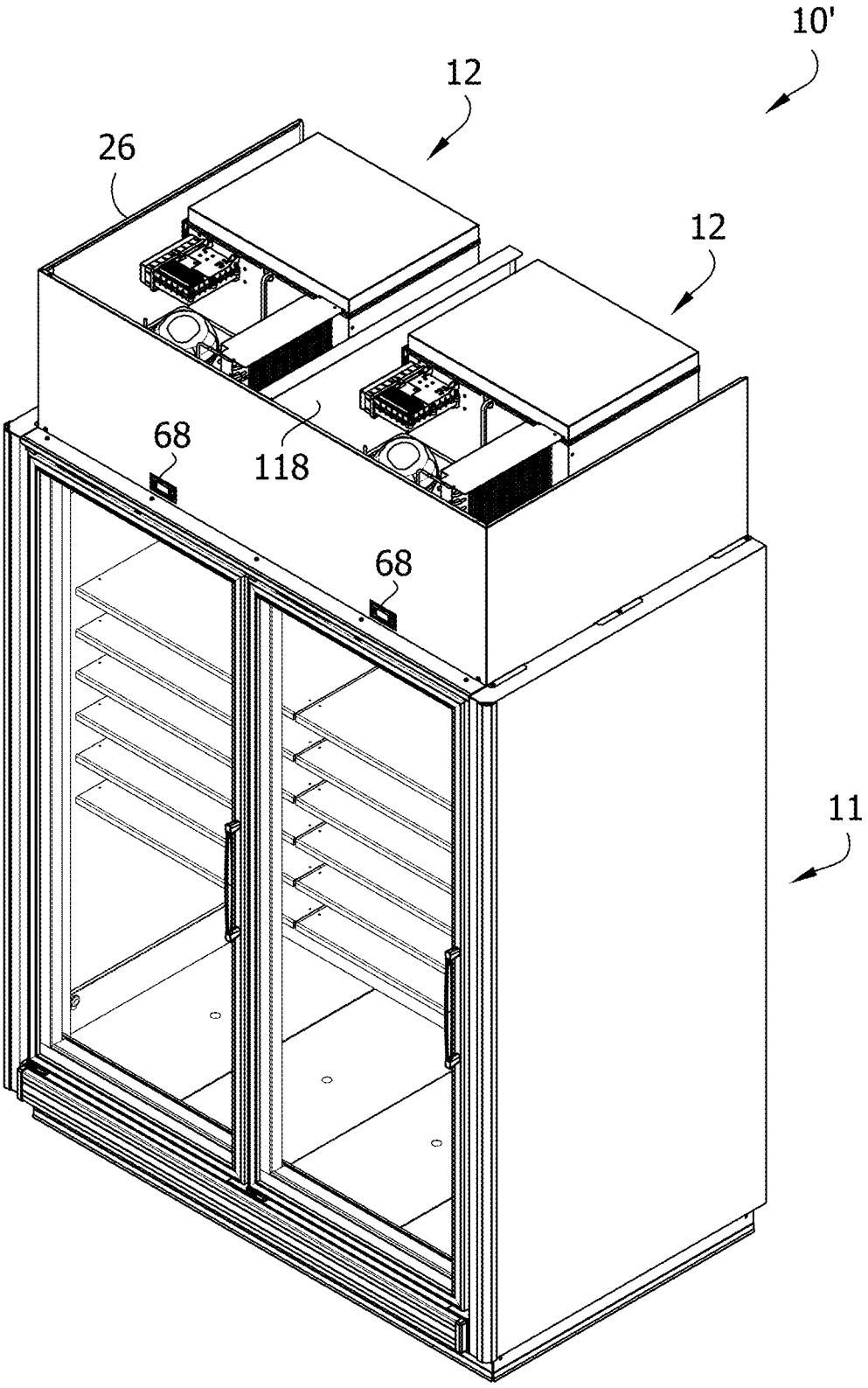
FIG. 2 is a perspective of a refrigerated merchandiser assembled from the kit of FIG. 1.
Figure 2A:
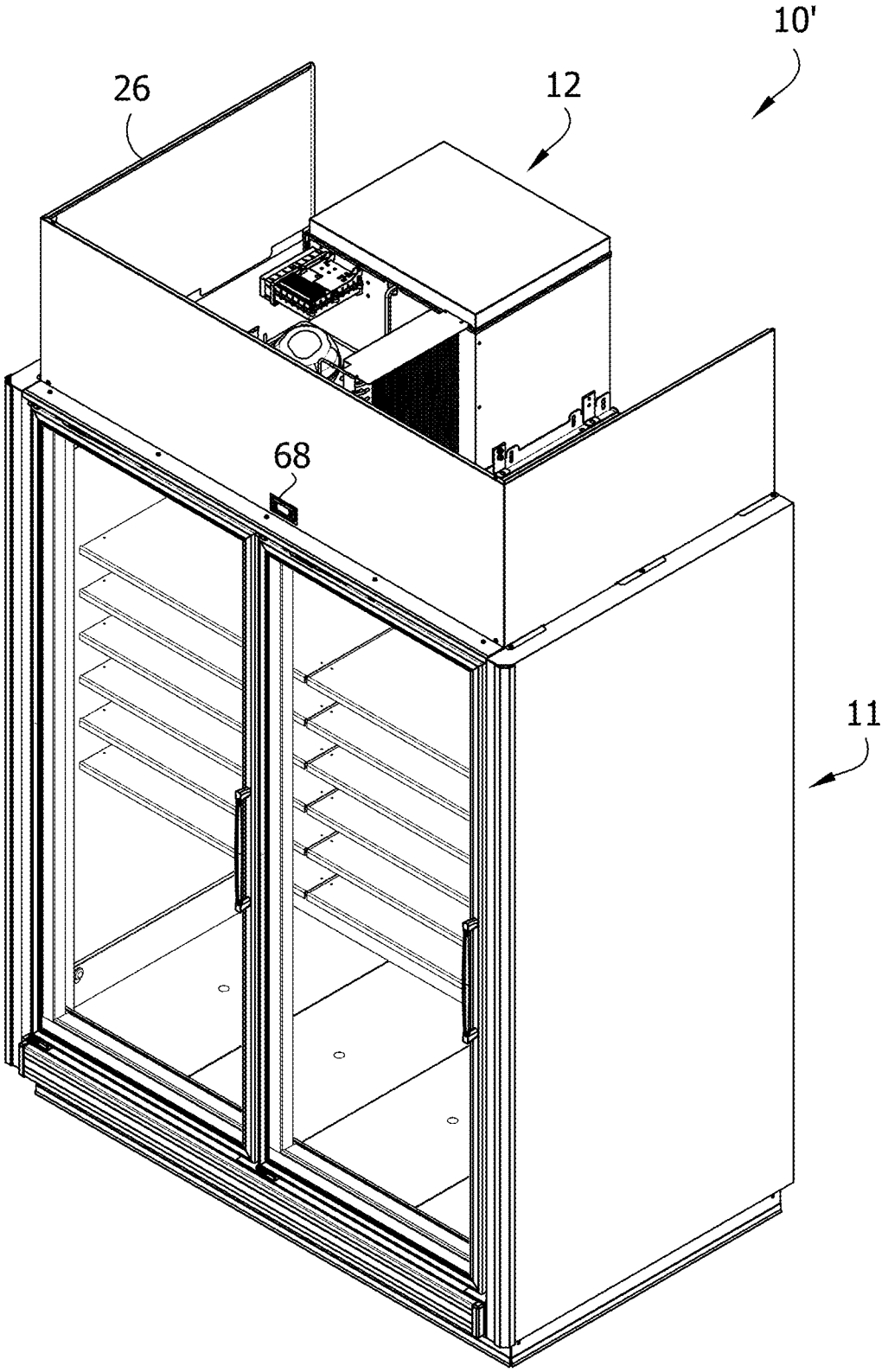
FIG. 2A is a perspective of a refrigerated merchandiser assembled from the kit of FIG. 1A.
Figure 2B:
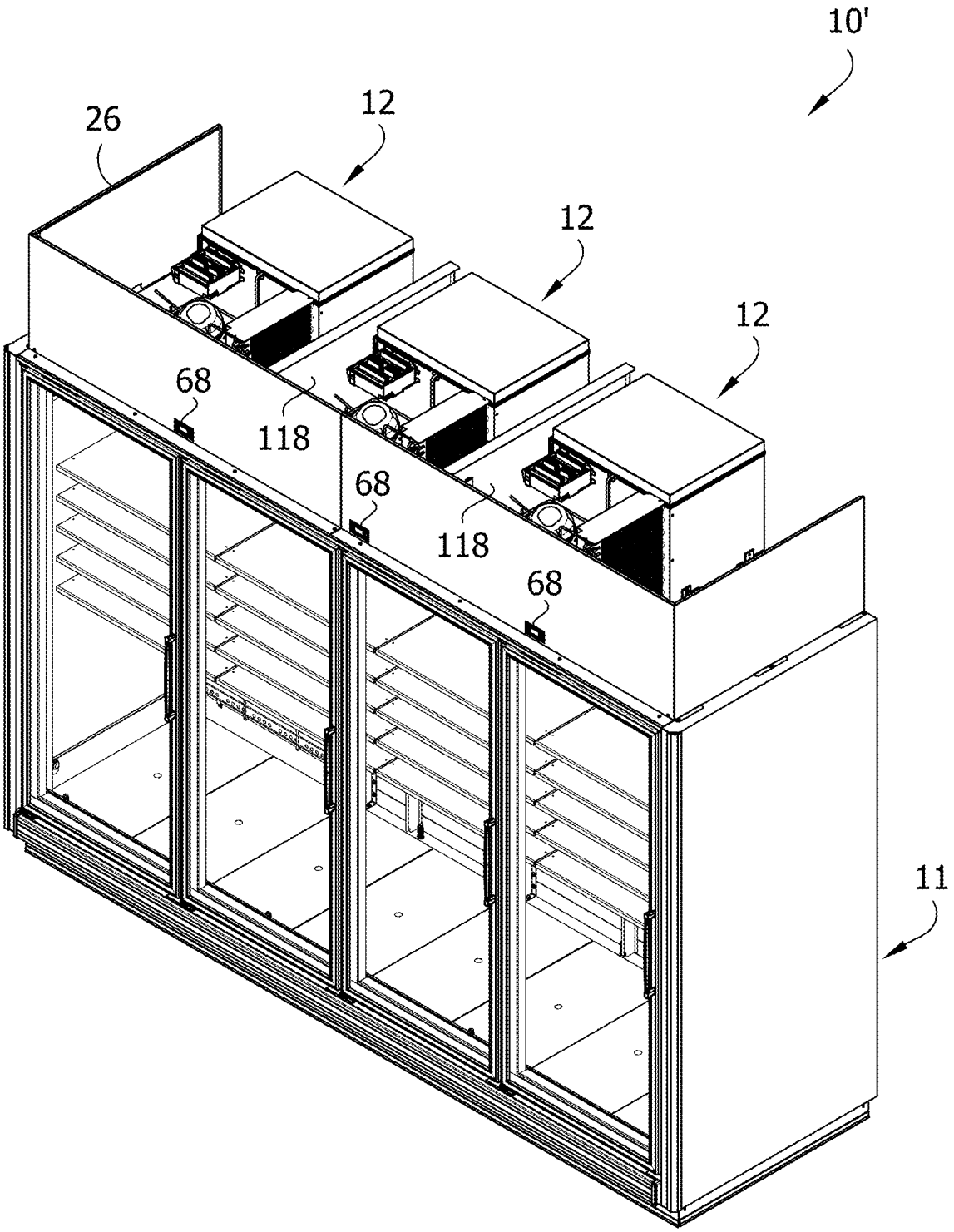
FIG. 2B is a perspective of a refrigerated merchandiser assembled from the kit of FIG. 1B.
Figure 3:
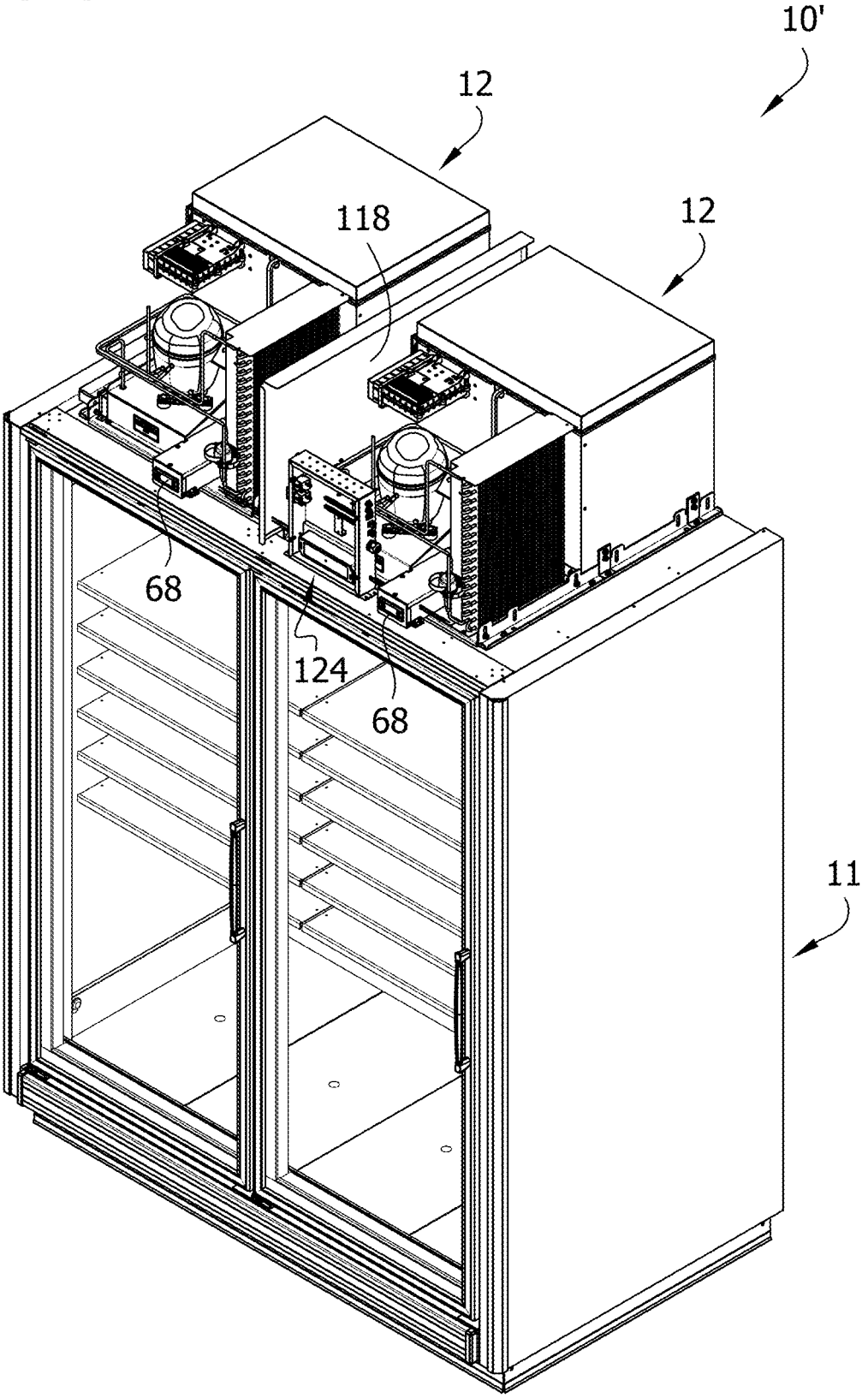
FIG. 3 is a perspective of the refrigerated merchandiser with a shroud removed.

Referring to FIGS. 2-2B, the present disclosure pertains to a refrigerated merchandiser 10' (broadly, a refrigerated reach-in cabinet) comprising one or more field-installable, on-cabinet refrigeration system modules 12. As will be explained in further detail below, the illustrated merchandiser 10'addresses certain drawbacks of existing merchandisers with field-installable, on-cabinet refrigeration systems. For example, in one or more embodiments, the illustrated merchandiser 10' is configured so that each refrigeration system module 12 can be installed without any part of the refrigeration system protruding into the interior of the cabinet. Moreover, each refrigeration system module 12 provides a completely hermetically sealed refrigeration system (more broadly, a refrigeration circuit that is complete as prefabricated) which can be installed without making any refrigeration connections in the field. Further, in certain embodiments, each illustrated removable refrigeration system module 12 comprises an integrated condensate removal system so that no additional piping or plumbing connections need to be made. Rather, the merchandiser can be deployed through a standard-height man door without the involvement of any skilled tradesmen such as plumbers, HVAC technicians or electricians. Moreover, since the merchandiser 10' can be deployed with no piping along the back of the cabinet, the merchandiser can be deployed closer to the back wall (broadly, backing structure) (e.g., at zero offset) so that a larger percentage of the footprint of the merchandiser provides usable merchandising space. Further, there is no refrigeration system protrusion into the interior of the cabinet when installed, so after deployment, the merchandiser 10' can be serviced or repaired without intrusion into the refrigerated space.

In the illustrated embodiment, the kit 10 is configured to provide a refrigerated merchandiser 10'. However, it is also contemplated that kits for forming other types of refrigerated cabinets may be used without departing from the scope of the disclosure. For example, aspects of the present disclosure are particularly well-suited to any refrigerated cabinets of the upright, refrigerated type, including merchandisers with either doors or air curtains and merchandisers employing either air-cooled or water-cooled refrigeration systems.

Referring to FIGS. 3-6, the illustrated cabinet module 11 generally comprises a set of insulated walls that separate an interior and an exterior of the cabinet. When each refrigeration system module 12 is deployed on the cabinet module 11, a portion of the interior of the cabinet forms free refrigerated space. FIG. 12A depicts one cross-section of the free refrigerated space FRS in the illustrated cabinet module 11. Throughout this disclosure "free refrigerated space" defines the chilled area in which refrigerated goods may be held and through which a user of the merchandiser 10 can reach into the interior of the cabinet module 11. In this disclosure, "free refrigerated space" excludes any region occupied by air ducts and refrigeration system equipment, even though such areas may be cooled by the refrigeration system. In this way, the term "free refrigerated space" defines the usable space within the unit. In one common case that is shown in the drawings, the free refrigerated space includes all shelf space (a cross section of shelf space SS is shown in FIG. 12B by way of comparison) and additional space including free (refrigerated) space between the front edges of the shelves and the cabinet doors 22. Any support articles, such as shelving 24, used for supporting refrigerated goods is part of the free refrigerated space and should not be subtracted from it, in contrast with how ducting and refrigeration system components are treated in this disclosure. It can be seen that any portion of the interior of the cabinet module 11 that is occupied by refrigeration system components or ducting is not packable or useful for storing or displaying merchandise, whereas the remaining shelf space and free refrigerated space is packable and useful for merchandising and thus forms the usable free refrigerated space of the merchandiser.

Figure 4:
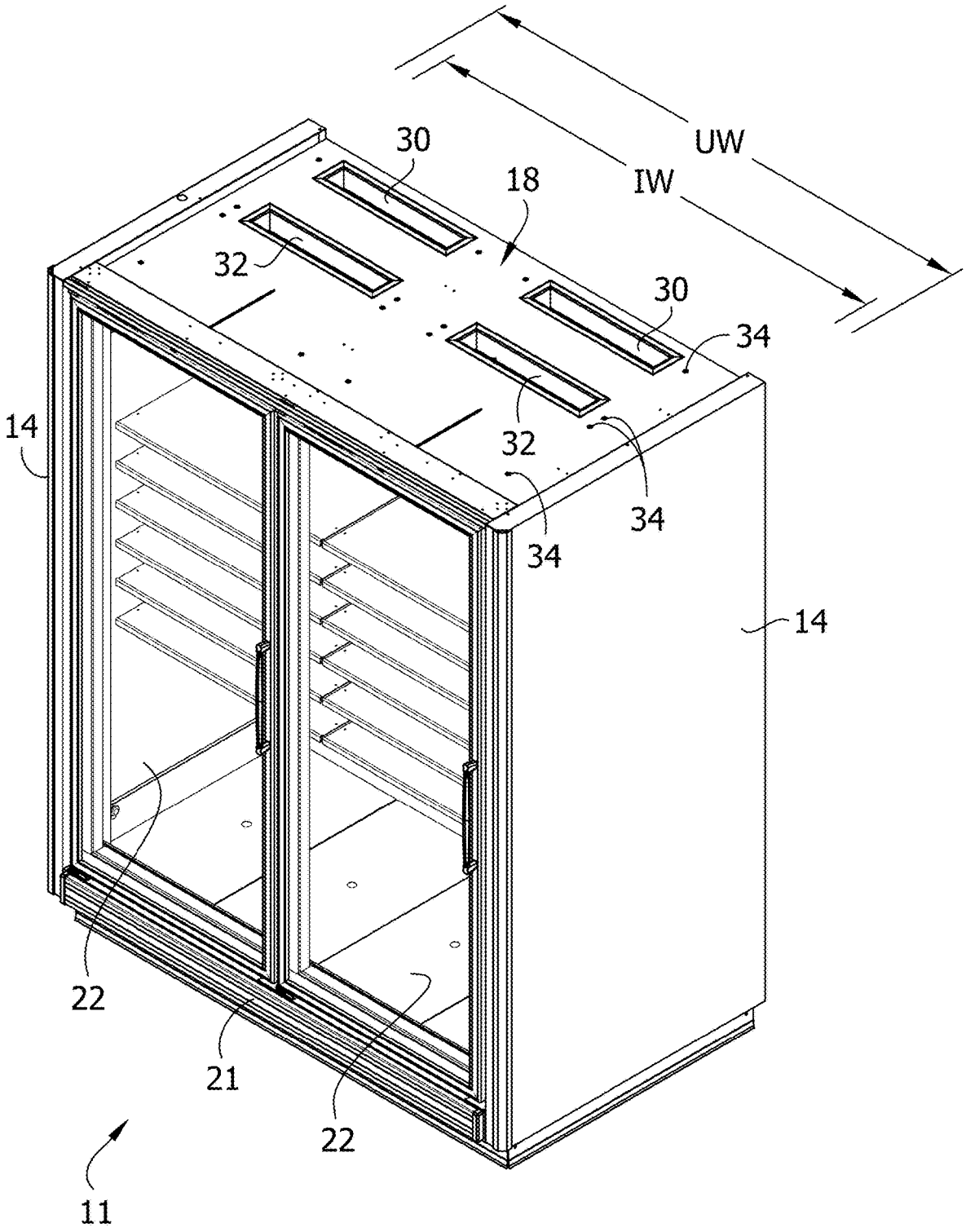
FIG. 4 is a perspective of the cabinet module.
Figure 5:
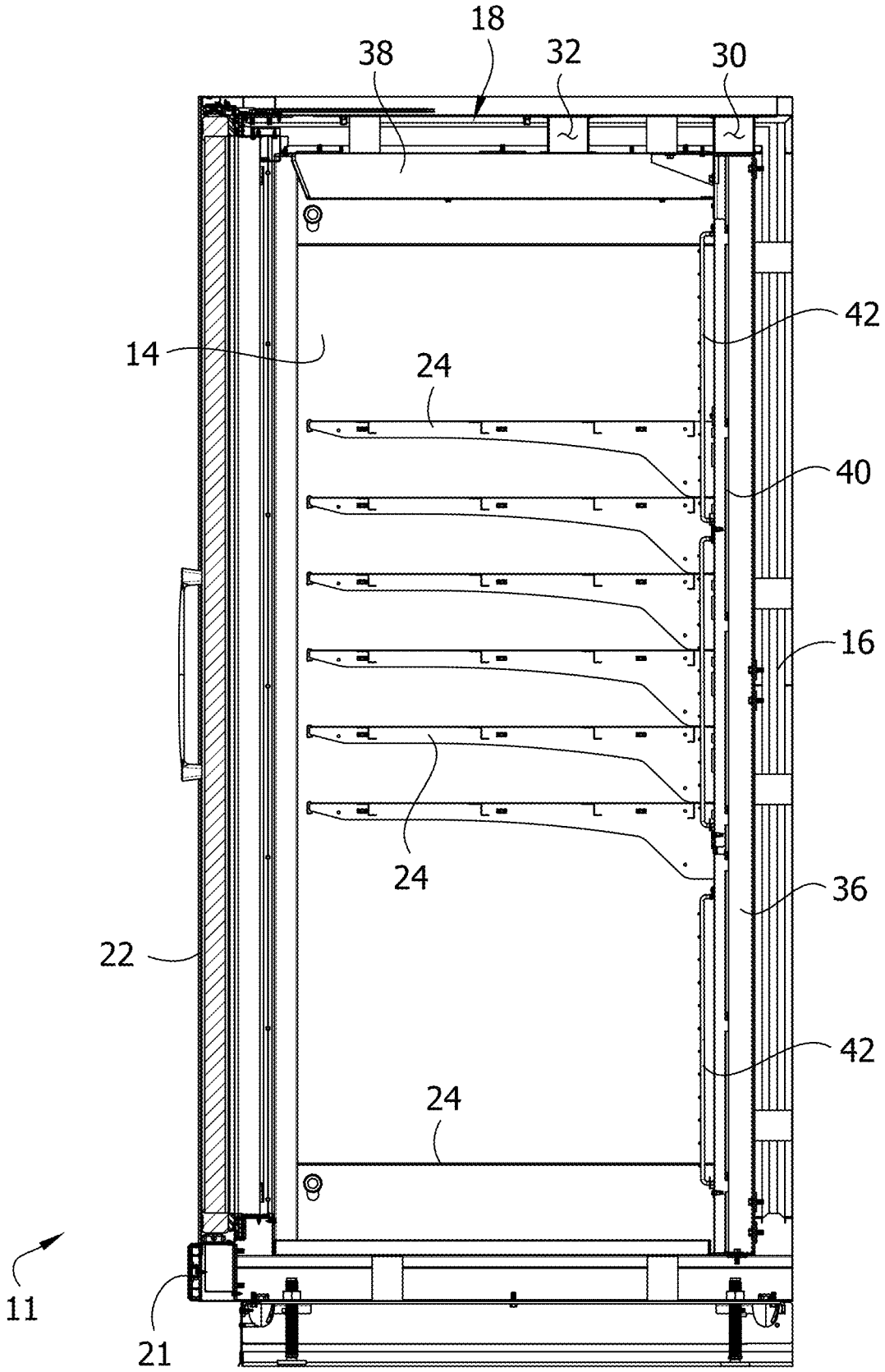
FIG. 5 is a cross section of the cabinet module taken in a front-to-back plane.
Figure 6:
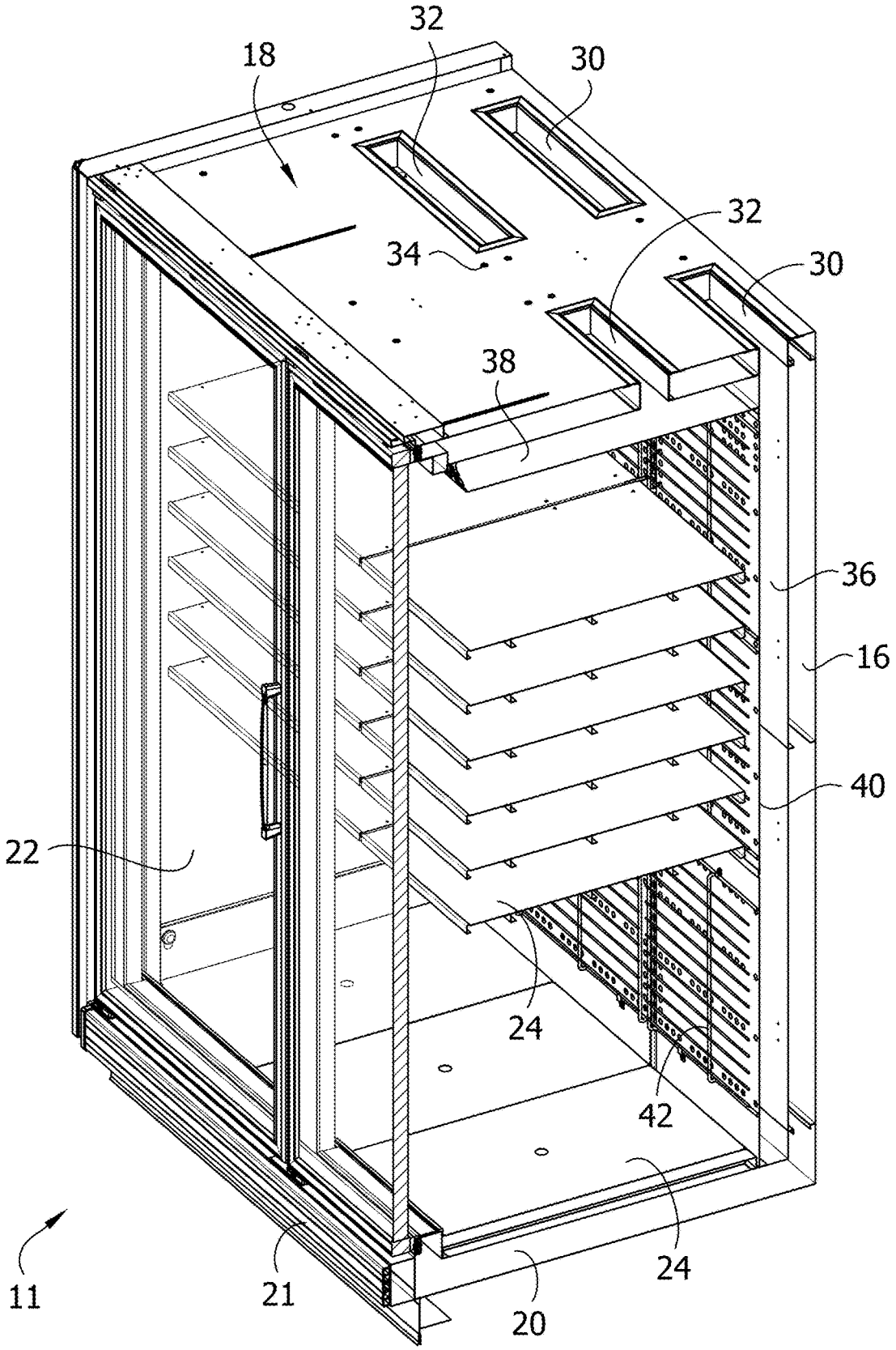
FIG. 6 is a cross-sectional perspective of the cabinet module.

Referring to FIGS. 4-6, the cabinet module 11 comprises a pair of side walls 14, a back wall 16, a top wall 18, a bottom wall 20, and a kick plate 21. The side walls 14 define the lateral sides of the interior (spaced apart along the cabinet's width), the top wall 18 defines an upper end of the interior, the bottom wall 20 defines a lower end of the interior, and the back wall 16 defines the rear of the interior. In the illustrated embodiment, the front of the interior of the cabinet is defined by a pair of French doors 22. Suitably, each door 22 may have a width of about 24 inches or about 30 inches, though other door widths are also possible. It will be appreciated that cabinet modules with other numbers of doors (e.g., one or more doors) and configurations of doors (e.g., sliding doors, doors with same-side hinges) may be used without departing from the scope of the disclosure. Further, it is contemplated that one or more embodiments in the scope of the present disclosure may be implemented on an air curtain-type merchandiser comprising an open front and no doors. In embodiments with a plurality of doors 22 as shown, each the cabinet module 11 suitably comprises a door sensor circuit 140 (shown schematically in FIG. 24) including a door sensor for each door configured to output a signal indicating when the respective door is open.

The illustrated cabinet module 11 is configured to form a reach-in cabinet. Those skilled in the art will recognize that reach-in cabinets hold goods inside so that a user can access all of the goods from a station in front of the cabinet. In the typical reach-in cabinet, a normal-sized, able-bodied user can reach goods stored even at the back end of the free refrigerated space.

It can be seen in FIGS. 1-1B and FIGS. 2-2B that individual refrigerated merchandiser kits 10 in the scope of this disclosure can be modular such that different configurations of cabinet modules 11 and prefabricated refrigeration system modules 12 may be selected to suit particular applications. As shown in FIG. 1A, some field-installable refrigerated merchandiser kits 10 may use only a single prefabricated refrigeration system module 12 (see also FIG. 2A), while other modular configurations of the field-installable refrigerated merchandiser kits of the present disclosure may utilize a plurality of refrigeration system modules (see FIGS. 1 and 2 and FIGS. 1B and 2B). Thus, any given kit 10 may be but one modular kit option from among a plurality of selectable modular kit options employing interchangeable cabinet modules 11 and refrigeration system modules 12 to suit particular applications. In one aspect, therefore, the present disclosure contemplates a system of selectable modular refrigerated cabinet kits that includes a plurality of selectable cabinet modules 11 of different widths, door configurations, and side wall configurations (e.g., side wall configurations that enable a contiguous lineup of refrigerated merchandisers, etc.), and a plurality of refrigeration system modules 12 with different refrigeration characteristics, that can be combined in different ways to meet the requirements of various applications.

What follows is a description of one particular embodiment of a field-installable refrigerated merchandiser kit 10 and corresponding merchandiser 10' depicted in FIGS. 1, 2, and 3-24. The particular modular configuration chosen for purposes of illustration only includes a two-door cabinet module 11 and two prefabricated refrigeration system modules 12. But to emphasize, this particular modular configuration is chosen only for purposes of illustration. A wide range of other modular configurations of a field-installable refrigerated merchandiser kit and merchandiser are contemplated to be in the scope of the present disclosure.

The cabinet module 11 may comprise various internal product supports without departing from the scope of the disclosure. In the illustrated embodiment, vertically spaced shelves 24 are supported on the cabinet module 11 for holding merchandise for sale. However, other product support/display configurations are also possible. For example, in certain embodiments, merchandise for sale or other refrigerated goods may be supported in the free refrigerated space on a roll-in cart (not shown). As will be explained more fully below, this is possible because the illustrated cabinet module 11 is configured to support the entire refrigeration system on the top wall 18 of the cabinet. No portion of the refrigeration system is located at the lower end of the free refrigerated space. Thus, in one or more embodiments, the bottom walls 20 of the cabinet module is removed or lowered to be nearly flush with the ground so that the free refrigerated space can extend downward substantially to ground level. This allows merchandise carts to roll into the free refrigerated space at ground level.

In the illustrated embodiment, the cabinet module 11 includes a plurality of adjustable support assemblies on the bottom wall 20 for adjusting the cabinet to be level. These support assemblies are described more fully in U.S. patent application Ser. No. 17/031,129, filed Sep. 24, 2020, and U.S. patent application Ser. No. 17/480,827, filed Sep. 21, 2021, each of which is hereby incorporated by reference in its entirety. Cabinet modules can be supported in other ways without departing from the scope of this disclosure.

In an exemplary embodiment, the cabinet module 11 is equipped with one or more integrated cabinet systems suitable for particular merchandiser application requirements. For example, such cabinet systems may include one or more lighting systems 142 (shown schematically in FIG. 24) or one or more cabinet heating systems 144 (shown schematically in FIG. 24). Those skilled in the art will appreciate that heaters are selectively employed in refrigerated cabinets in certain commercial refrigeration applications, including door mullion heaters, door glass heaters, cabinet frame heaters, etc. Any such heaters may be used in a heating system 144 in accordance with the present disclosure. In an exemplary embodiment, the cabinet module 11 is further equipped with a heated pressure relief valve 145 (shown schematically in FIG. 24) that is configured to open in response to a differential pressure between the interior and exterior of the cabinet and thereby automatically equalize the pressure between the interior and exterior of the cabinet. Those skilled in the art will recognize that the heated pressure relief valve 145 addresses situations where cooling reduces the pressure inside the cabinet 11 to be less than the pressure outside the cabinet, which can make the doors 22 difficult to open. Equalizing the pressure between the interior and exterior of the cabinet 11 ensures that users can easily open the doors even after a substantial temperature drop occurs inside the cabinet with the doors closed.

In the illustrated embodiment, the cabinet module 11 is configured for top-mounted refrigeration. However, this disclosure is not strictly limited to top-mounted systems. It is contemplated that refrigeration system modules could be mounted on the side or bottom or rear of the merchandiser depending on the customer/application needs. But again, in the illustrated embodiment, each refrigeration system module 12 is mountable on the top wall 18 for cooling the free refrigerated space of the cabinet 11. An upper shroud 26 may be installed along the perimeter of the top wall 18 above the doors 22 for concealing the refrigeration system module 12, accessing the controls, and/or adding lighting and other marketing graphics as desired. Suitably, the shroud 26 is a separate component of the refrigerated merchandiser kit 10 that is configured to be installed on the cabinet module 11 in the field. This maximizes free refrigerated space height while still allowing the cabinet module to fit through a standard-height man door.

The top wall 18 of the cabinet module 11 is generally configured to operably connect to each of one or more refrigeration system modules 12 so that each refrigeration system module can cool the interior of the cabinet. In the illustrated embodiment, the top wall 18 of the cabinet module 11 comprises separate inlet and outlet ports 30, 32 for each the refrigeration system module 12. The inlet port 30 is configured to impart cold refrigerated air from the respective refrigeration system module 12 into the cabinet interior, and the outlet port 32 is configured to return the warmer air that carries the product heat and moisture back to the respective refrigeration system module. In the illustrated embodiment, each supply air inlet 30 comprises a slot that is elongate in the widthwise direction of the cabinet and extends through the thickness of the top wall 18 at a location adjacent the back wall 16. Each return air outlet 32 likewise comprises a slot that is elongate in the widthwise direction and extends through the thickness of the top wall 18. Each return air outlet 32 is spaced apart in front of the corresponding supply air inlet 30 in the front-to-back direction. The inlet and outlet ports 30, 32, depicted in this embodiment define a path of cold and warm air. It is contemplated that these ports could be reversed to supply the cold air to the front duct and warm air to the rear duct depending upon the application.

The top wall 18 further comprises one or more integrated connection fittings for releasably and operably attaching one or more refrigeration system modules 12 to the cabinet module 11. In particular, the illustrated top wall 18 comprises a plurality of pre-formed holes 34 (e.g., screw holes) configured to receive removable fasteners (e.g., screws) which operably connect each refrigeration system module 12 to the cabinet module 11 (as discussed in further detail below). In one or more embodiments, for each refrigeration system module 12, the screw holes 34 comprise a first set of screw holes spaced apart in a first front-to-back line located on a first lateral side of the supply air inlet 30 and return air outlet 32 and a second set of screw holes spaced apart in a second front-to-back line located on a second lateral side of the supply air inlet and the return air outlet. Suitably, the screw holes 34 are arranged so that, when used to secure a refrigeration system module 12 to the cabinet module 11: (i) the refrigeration system is supported on top of the cabinet module; (ii) the refrigeration system is configured to direct supply air from an evaporator into the refrigerated interior through the supply air inlet 30; and (iii) the refrigeration system is configured to direct return air from the refrigerated interior through the return air outlet 32.

Referring to FIGS. 5 and 6, the illustrated cabinet module 11 comprises air flow passaging that is configured to direct and distribute refrigerated air through the cabinet interior. In particular, the illustrated cabinet module 11 comprises one or more supply air discharge plenums 36 and one or more return air plenums 38. In the illustrated embodiment, the discharge plenum 36 and return air plenum 38 for each refrigeration system module 12 are separate ducts (i.e., there are individual discharge and return plenums for each refrigeration system module 12), but it is contemplated that the ducts could be combined such that a common return air plenum and a common supply air plenum are used for more than one refrigeration system module. In one or more embodiments, the supply air discharge plenum 36 extends along the back wall 16 from an open upper end portion to an enclosed lower end portion. Suitably, each supply air inlet opening 30 opens to the upper end portion of a respective supply air discharge plenum 36. Each supply air discharge plenum 36 includes a front plenum wall 40 defining a plurality of orifices through which supply air can flow into the free refrigerated space of the interior of the cabinet module 11. In this case, each front plenum wall 40 defines the back of the free refrigerated space of the cabinet (see FIG. 12A) and the door glass defines the front of the free refrigerated space of the cabinet. In the illustrated embodiment, each front plenum wall 40 includes outlet openings at a plurality of vertically spaced apart locations so that cold refrigerated air is directed to flow across the merchandise supported on each of the shelves 24.

In one or more embodiments, each return air plenum 38 extends along the underside of the top wall 18 from a front end portion end to a rear end portion. The front end portion of each return air plenum 38 defines one or more inlet openings or orifices that form an inlet through which return air is directed into the return air plenum. The rear end portion of the return air plenum 38 forms an outlet that opens to the return air outlet 32. Each return air plenum 38 generally defines the upper end of the free refrigerated space inside the interior of the cabinet module 11 and the bottom shelf 24 defines the opposite lower end of the free refrigerated space in the illustrated embodiment.

As can be seen the air flow passaging of the cabinet module is configured to direct cold refrigerated air downward along the back wall 18 from the supply air inlet 30 and then forward into the free refrigerated space in the interior of the cabinet. After absorbing heat and moisture from within the cabinet, return air is drawn upward generally at the front of the cabinet and then is directed to flow rearward along the top wall 18 and into the return air outlet 32. It will be appreciated that the particular arrangement of air flow passaging may vary from what is shown without departing from the scope of the disclosure. For example, instead of directing the air to flow back-to-front through the free refrigerated space, the merchandiser could be configured to direct the air to flow front-to-back or side-to-side through the free refrigerated space. While the primary thrust of this disclosure is directed to refrigerated cabinets, it is contemplated that a temperature control module could also be configured to warm or heat the interior space.

As explained more fully below, the illustrated refrigerated merchandiser kit 10 is configured so that no portion of the refrigeration system is located within the interior of the cabinet when the merchandiser 10' is assembled. This enables the cabinet module 11 to provide heretofore unattainable usable merchandising space in a merchandiser capable of being delivered through a standard-height man door.

In the illustrated embodiment, the cabinet module 11 has a free refrigerated space height FRSH (FIG. 12A) extending from the bottom wall 20 to the return air plenum 38. In this disclosure, the "free refrigerated space height" is a contiguous height along the cabinet module 11 that can be filled with merchandise and merchandise supports such as the shelves 24. Thus, a free refrigerated space height would exclude any portion of the interior of a refrigerated cabinet that is occupied by refrigeration system components, condensate removal components, or other functional components not directed to the support, display, or access of refrigerated merchandise. In one or more embodiments, the free refrigerated space height FRSH is at least 60 inches (such as at least about 61 inches, at least about 62 inches, at least about 63 inches, at least about 64 inches, at least about 65 inches, at least about 66 inches, about 68 inches±0.5 inches). Even greater free refrigerated space heights are possible in the scope of the disclosure. For instance, thinner foamed panels and thinner ducts could be used for applications that require even further pack-out volume but still result in the cabinet fitting through a man door doorway.

The illustrated cabinet module 11 also comprises a free refrigerated space depth FRSD (FIG. 12), in one or more embodiments, the free refrigerated space depth FRSD of the refrigerated merchandiser is at least about 22 inches (e.g., at least about 23 inches, at least about 24 inches, at least about 25 inches, at least about 26 inches, at least about 27 inches, at least about 28 inches, at least about 29 inches, at least about 30 inches, at least about 31 inches, about 32 inches±0.5 inches). As above, thinner foamed panels and thinner ducts could be used for applications that require even further pack-out volume but still result in the cabinet fitting through a man door. In the illustrated embodiment the depth of the shelves 24 is slightly less than the free refrigerated space depth FRSD of the cabinet module 11 to allow for air flow in front of the shelves.

As shown in FIG. 12A, the illustrated embodiment of the cabinet module 11 comprises a free refrigerated space cross-sectional area in a front-to-back plane perpendicular to a width of the cabinet module. In one or more embodiments, the free refrigerated space cross-sectional area is at least about the area defined by any multiple of a free refrigerated space height FRSH and free refrigerated space depth FRSD listed above. In one or more embodiments, the free refrigerated space cross-sectional area is greater than 1350 square inches (e.g., greater than 1500 square inches, greater than 1700 square inches, greater than 1900 square inches, greater than 2000 square inches, or greater than 2100 square inches). A free refrigerated space volume may be calculated as this free refrigerated space cross-sectional area times a refrigerated width IW (FIG. 4) extending from the interior of one lateral side wall 14 to the interior of the other lateral side wall of the cabinet module 11.

As explained above, the illustrated cabinet module 11 is configured to be fitted with a set of shelves 24 for holding product in a portion of the free refrigerated space. FIG. 12A shows a cross-section of the free refrigerated space FRS of the illustrated cabinet module 11, and to illustrate a comparison, FIG. 12B shows a cross-section of shelf space SS on which products can be supported within the free refrigerated space. Here, the shelf space defines the pack-out volume of the cabinet module 11. In other words, the pack-out volume of the illustrated cabinet is equal to the shelf space. But it is understood that other types of in-cabinet storage can be used such that pack-out volume need not always be coextensive with shelf space. In the illustrated embodiment, the shelves 24 include a bottom shelf on the bottom wall 20 of the cabinet 11 and a set of cantilevered shelves spaced apart above the bottom shelf. In one or more embodiments, the front-to-back depth CSD of the cantilevered shelves is at least about 20 inches (e.g., at least about 21 inches, at least about 22 inches, at least about 23 inches, at least about 24 inches, greater than 24 inches, or 25 inches±0.5 inches). In certain embodiments, the depth BSD of the bottom shelf 24 is greater than the depth CSD of the cantilevered shelves 24. For example, in one or more embodiments, the depth of the bottom shelf is greater than 26 inches (e.g., at least about 27 inches, or at least about 28 inches).

In the illustrated embodiment, the back end of the shelf space is delimited by a rear guard 42 comprising an upright grill spaced apart in front of the front wall 40 of the discharge plenum 36 used to ensure proper air flow by preventing merchandise from being pushed backward into contact with the discharge plenum. Above each shelf 24, the shelf-space extends forward from the rear guard 42 to the front edge of the shelf, and vertically from the plane of the shelf to the plane of the above-adjacent shelf (or the bottom wall of the return air plenum 38 in the case of the top cantilevered shelf). As shown in FIGS. 12A and 12B, shelf space SS is less than the free refrigerated space FRS because the shelf space does not include space occupied by the product guard 42 and space in front of the shelves 24 which allows air flow to the front inlets of the return air plenum 38. In one or more embodiments, the shelf space SS in a front-to-back cross-sectional plane perpendicular to the width of the cabinet module 11 is greater than 1550 $in^2$ (e.g., greater than or equal to 1600 $in^2$, greater than or equal to 1650 $in^2$, greater than or equal to 1700 $in^2$). Those skilled in the art will appreciate that this is a substantial increase in shelf space over conventional refrigerated merchandisers capable of fitting through a man doorway. It is also noted that the increased shelf space provided by the extra-deep bottom shelf is only able to be provided because the refrigeration system modules 12 do occupy space at the bottom of the interior of the cabinet.

The very deep reach-in cabinet 11 described above is well-suited for delivery through a double man door doorway. But when only a single man door is available, it may be useful to construct the cabinet to have a lesser free refrigerated space depth and/or shelf depth. Regardless, embodiments of field-installable refrigerated merchandiser kits 10 in the scope of the disclosure enable efficient use of the overall space occupied by the installed merchandiser.

The space that a unit occupies can be thought of in at least two ways. Firstly, the space can be defined in terms of the "unit dimensions," that is the exterior dimensions defined by the walls and doors of the cabinet independent of its environment. In that regard, referring to FIG. 12, the unit height UH of the cabinet module 11 extends from the top of the top wall to the bottom, the unit depth UD extends from the backmost component to a front plane FP of the cabinet defined by doors 22 (excluding handles) or the kick plate 21, and the unit width UW (FIG. 4) extends from the outer face of one side wall 14 to the outer face of the other side wall. Assuming an envelope that is a simple rectangular cube, the unit volume can be calculated as the unit height UH times the unit depth UD times the unit width UW. In one or more embodiments, the volume of the free refrigerated space is at least 60% of the unit volume. Similarly, the free refrigerated space cross-sectional area is at least 60% of the unit cross-sectional area measured as the unit depth UD times the unit height UH (e.g., at least 63% or at least 65%).

A second way to conceptualize how much of the space occupied by a cabinet module 11 is usable is by comparing the free refrigerated space dimensions with the dimensions that the cabinet module occupies as installed in a building. For most refrigerated merchandiser kits of the prior art, these "occupied dimensions" are materially greater than the unit dimensions because cabinet modules of the prior art must be installed at substantial offset (e.g., greater than 3 inches in a front-to-back direction) from a backing structure against which the cabinet is positioned, e.g., a store wall or the back of an adjacent cabinet, due to piping, wiring, tubing, and a required area for heat to escape the condensing unit. However, in one or more embodiments, the illustrated refrigerated merchandiser 10 is configured to be installed and operated against a backing structure at zero offset from a backing structure. In certain embodiments, the cabinet module is configured to define an occupied volume defined by an occupied height extending from the floor to the top of the top wall, an occupied depth extending from the backing structure against which the cabinet is deployed to the front plane FP, and an occupied width extending from the outer face of one side wall 14 to the outer face of the other side wall. When installed at zero offset, these occupied dimensions of the illustrated cabinet module 11 are equal to the unit dimensions UH, UD, UW. In an exemplary embodiment, the occupied depth of the cabinet 11 is less than 40 inches. The occupied volume can be calculated as the occupied height (e.g., UH) times the occupied depth (e.g., UD) times the occupied width (e.g., UW). In one or more embodiments, the volume of the free refrigerated space is at least 60% of the occupied volume. Similarly, the free refrigerated space cross-sectional area is at least 60% of the occupied cross-sectional area measured as the occupied depth times the occupied height (e.g., at least 63%, at least 65%).

Another useful metric that demonstrates how efficiently the cabinet module 11 uses space compares the volume of the shelf space (e.g., the interior width IW of the cabinet module times the shelf space cross-sectional area SS depicted in FIG. 12B) to the occupied footprint of the cabinet as installed (e.g., the occupied depth (e.g., UD) times the occupied width (e.g., UW)). In the illustrated embodiment, a ratio of the volume of the shelf space to the occupied footprint is greater than 3.25 $ft^3/ft^2$ (e.g., greater than 3.4 $ft^3/ft^2$, greater than 3.5 $ft^3/ft^2$, or greater than 3.6 $ft^3/ft^2$). A related metric that demonstrates how efficiently the cabinet module 11 uses the occupied space is a ratio comparing the shelf-space cross-sectional area to the occupied cabinet depth. In an exemplary embodiment, the ratio of shelf space cross-sectional area to occupied cabinet depth is greater than or equal to 40 $in^2/in$ (greater than or equal to 41 $in^2/in$, or greater than 42 $in^2/in$).

Figure 7:
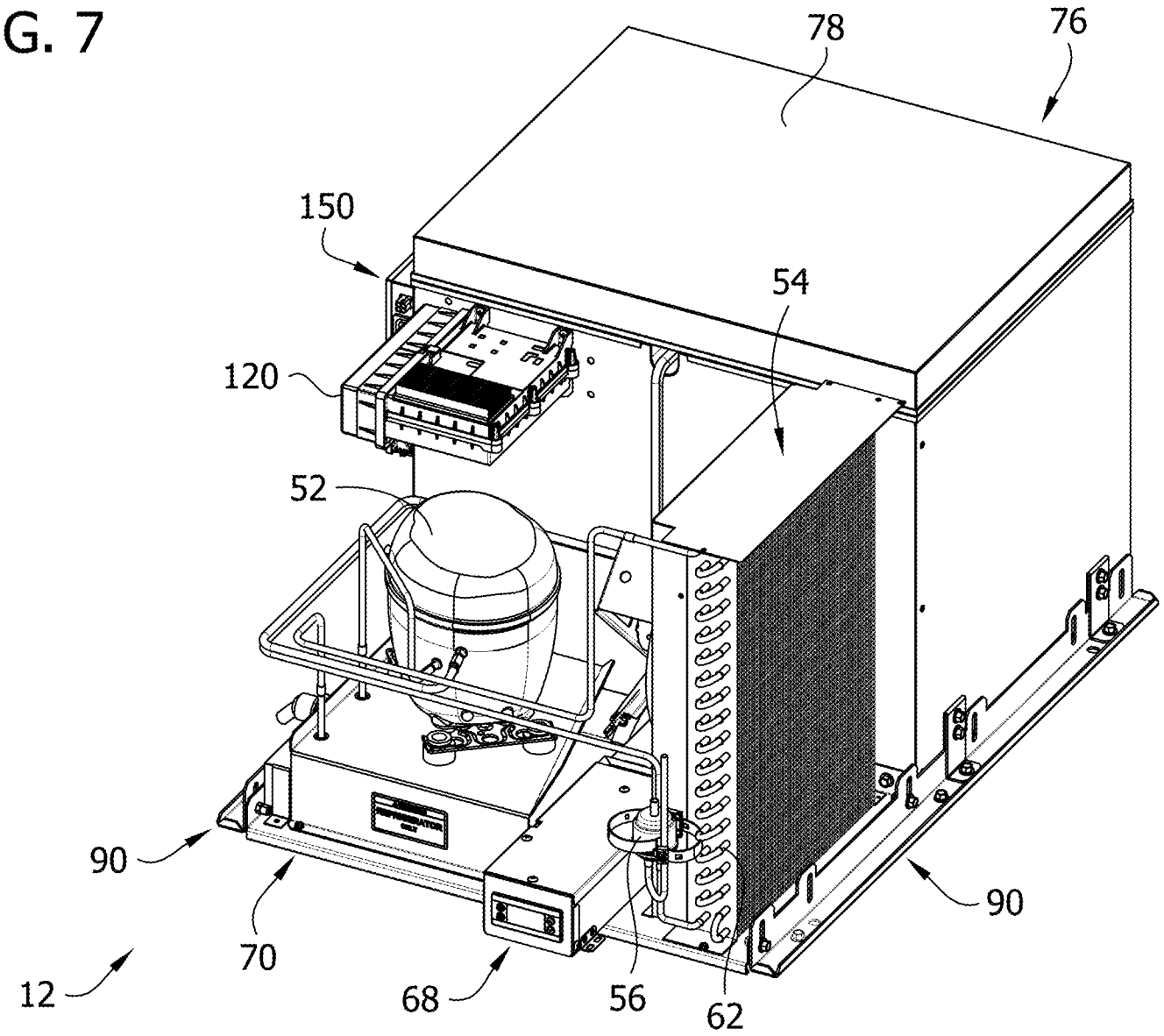
FIG. 7 is a perspective of the refrigeration system module.
Figure 8:
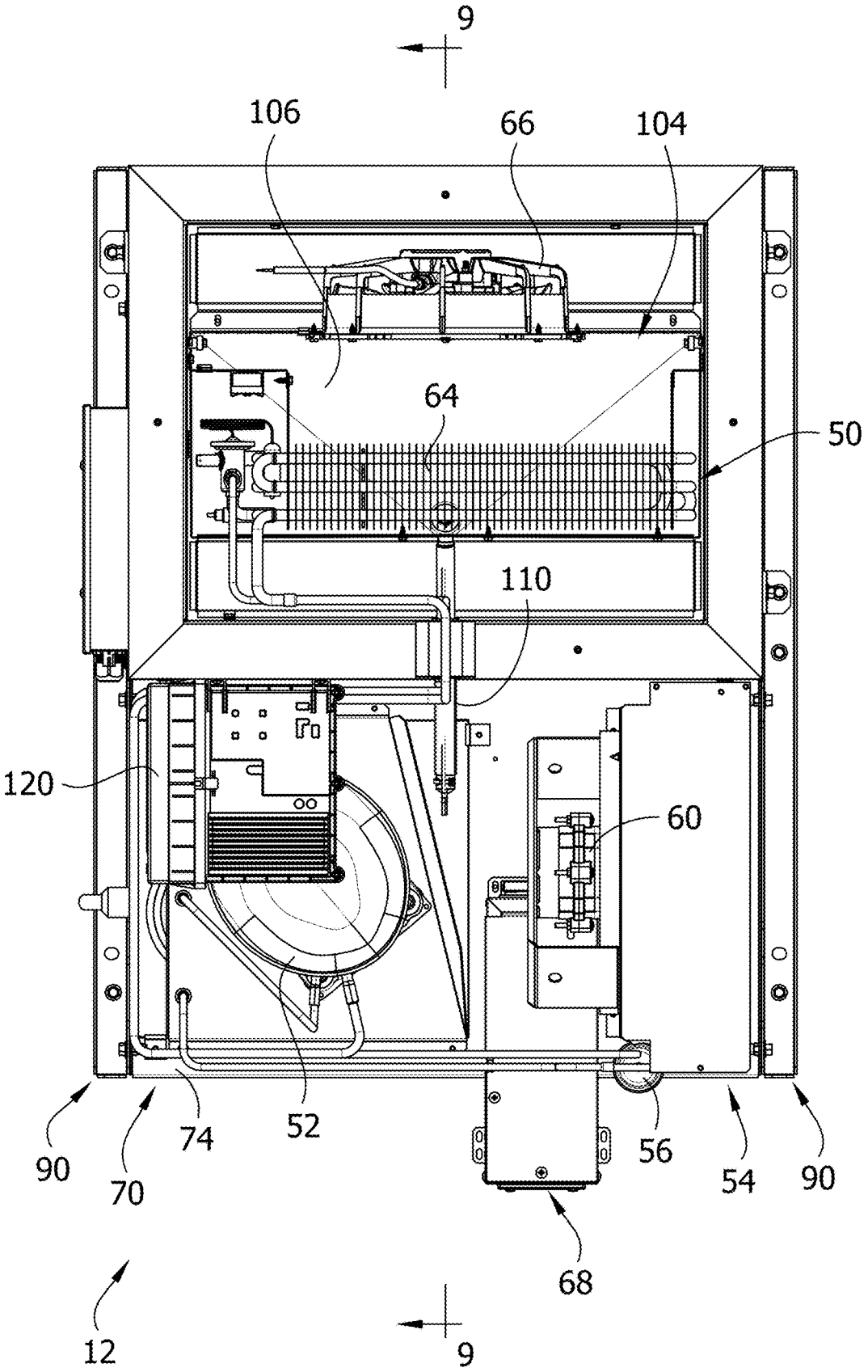
FIG. 8 is a top plan view of the refrigeration system module with a lid of an evaporator enclosure thereof removed.
Figure 9:
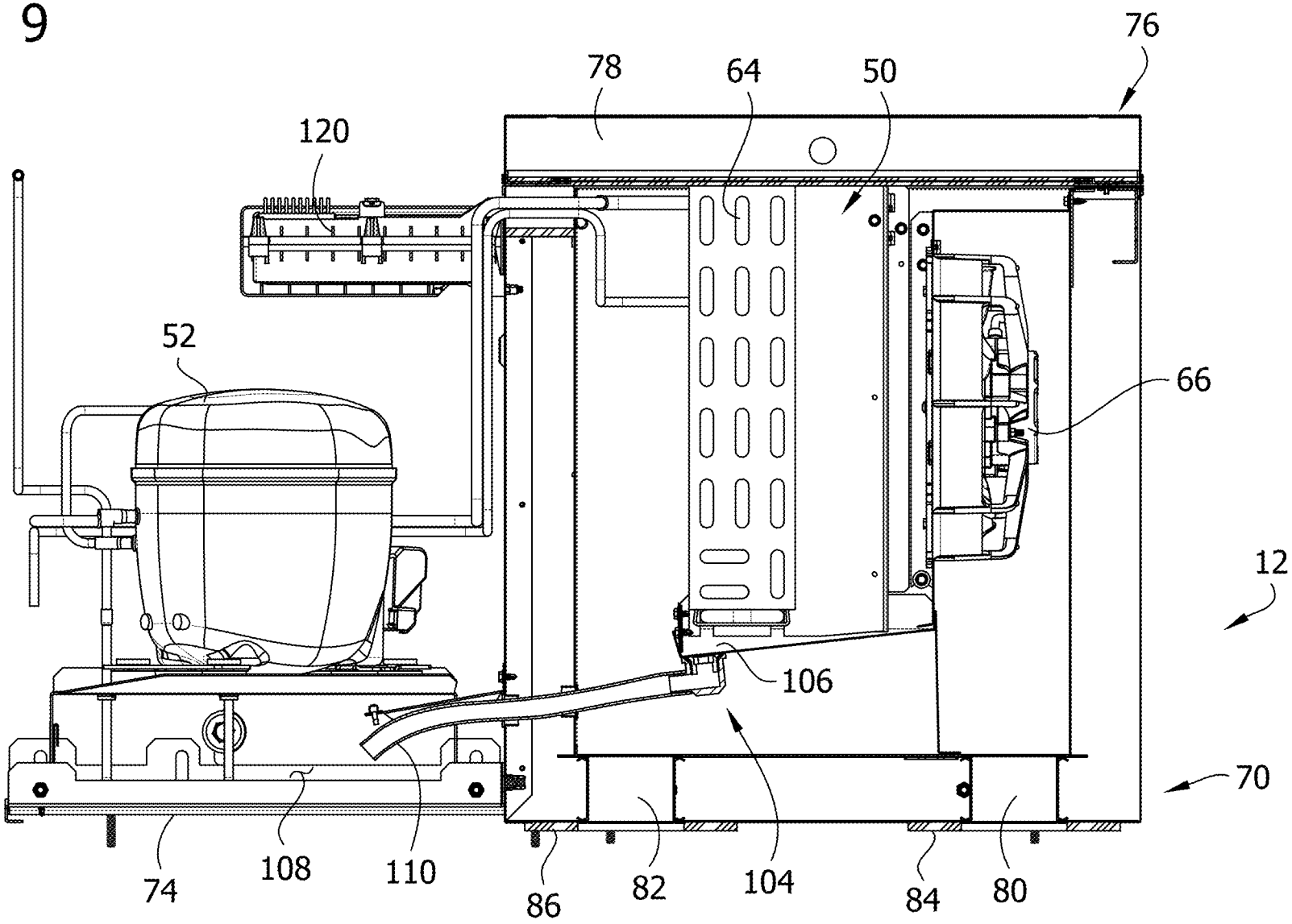
FIG. 9 is a cross section taken in the plane of line 9-9 of FIG. 8.
Figure 10:
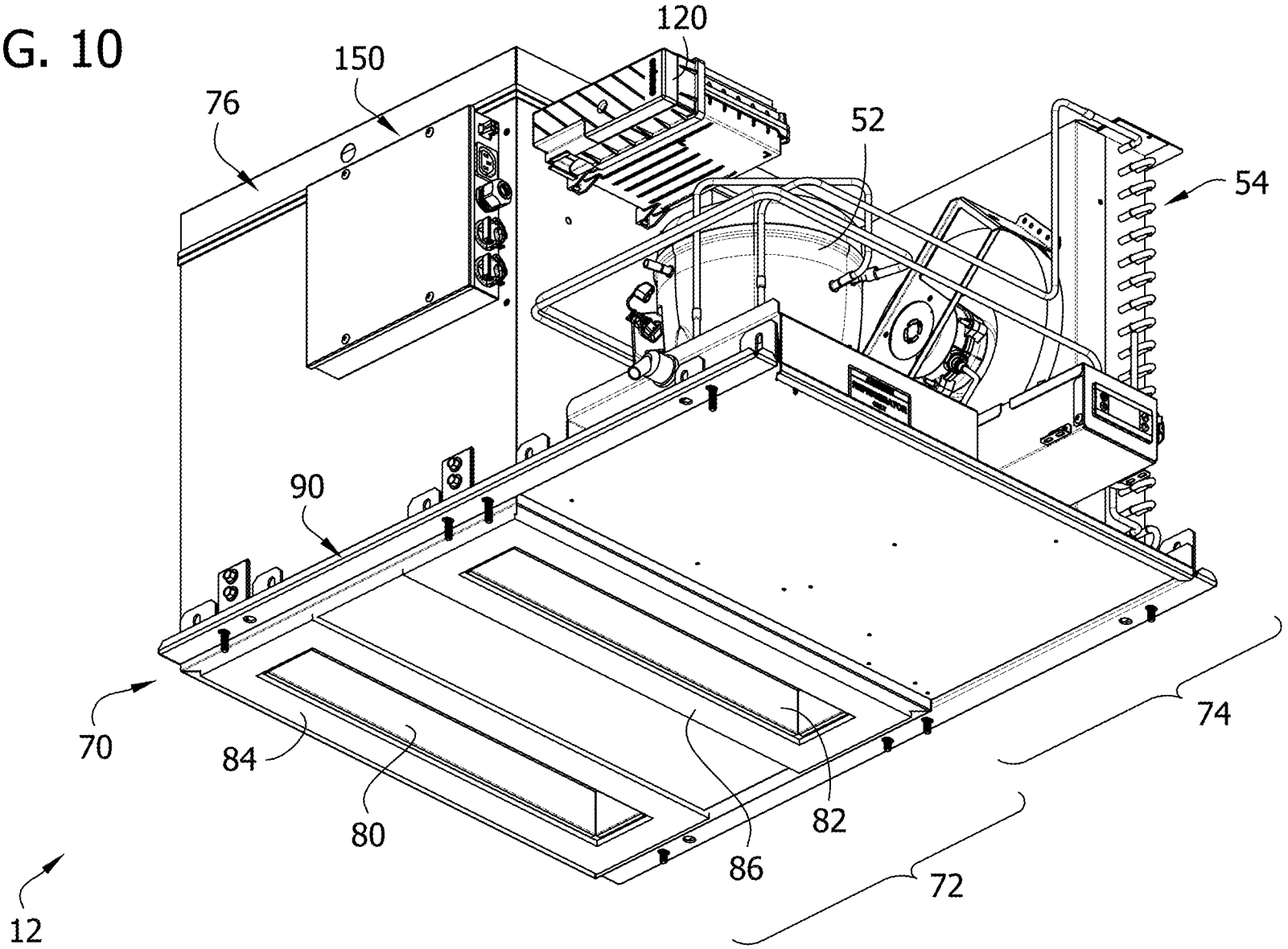
FIG. 10 is a bottom perspective of the refrigeration system module.
Figure 11:
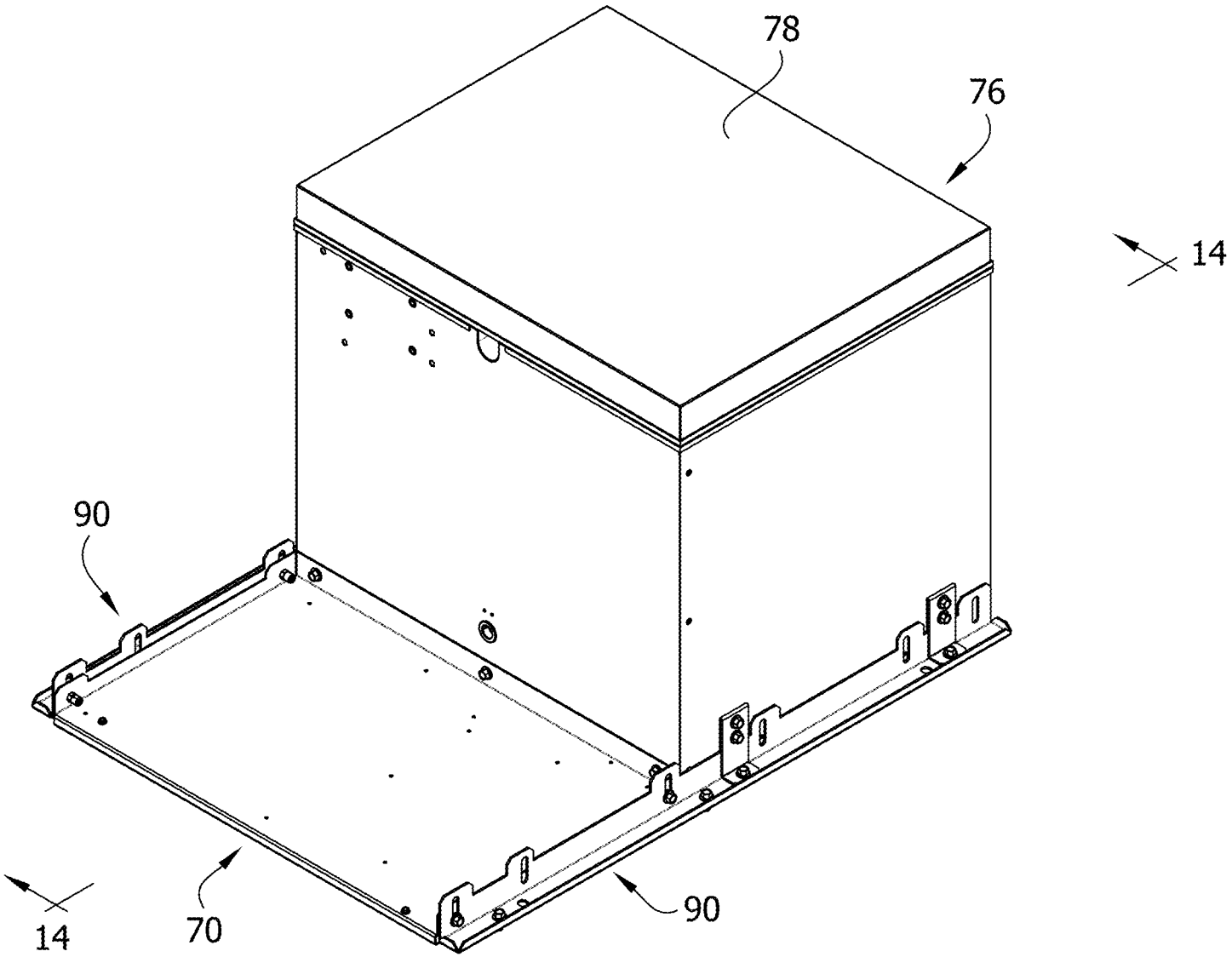
FIG. 11 is a perspective of an assembly of the refrigeration system module including a base, an evaporator enclosure, and a pair of support rails.

Referring to FIGS. 7-9, in an exemplary embodiment, the refrigeration system module 12 comprises a prefabricated refrigeration system. Here, the term "prefabricated" means that components included in the refrigeration system module 12 are assembled at a manufacturing facility remote from the ultimate location at which the refrigeration system module is deployed on a separate cabinet module 11. The term "refrigeration system" refers to a complete refrigeration circuit including all components required to cycle refrigerant between a heat absorbing heat exchanger and a heat rejecting heat exchanger.

In an exemplary embodiment, each prefabricated refrigeration system module 12 comprises a single refrigeration circuit that is hermetically sealed. Thus, no refrigeration connections are required to be made in the field. This substantially reduces the likelihood of refrigerant leaks during use of the refrigerated merchandiser 10' in comparison with comparable field-installable merchandiser systems that require refrigeration connections to be made in the field. The inventors recognize that, when installing certain remote condensing units in the field, evacuation, access, and charging ports are used, and these create opportunity for refrigeration leaks and performance degradation due to non-condensable fluid entering the refrigeration system. In the merchandiser 10', no access or service ports are provided in order to provide a truly hermetically sealed refrigeration module. In an exemplary embodiment, in lieu of service ports, the high and low side pressure transducers are integrated into the refrigeration system to output pressure signals as described in U.S. Provisional Patent Application Ser. No. 63/152,363, filed Feb. 23, 2021 and entitled ICE MAKER, which is hereby incorporated by reference in its entirety for all purposes. As explained therein, a local or remote display can be used to display pressure data from the pressure transducers for diagnostic purposes as needed.

Although U.S. Provisional Patent Application Ser. No. 63/152,363 pertains particularly to the use of integrated pressure transducers in the hermetically sealed refrigeration system of a dedicated ice maker, it will be apparent that the same general type of pressure transducers can be used in the same general way in the hermetically sealed refrigeration system modules 12 discussed herein. It is also noted that, in this disclosure, the refrigeration module(s) 12 do not employ the use of a receiver or vessel for storing excess refrigerant, in contrast with remote refrigeration systems, which require receivers to account for the plethora of different locations, piping sizes, piping runs, and line sets that occur when the cabinets are connected to various configurations of condensing units.

In an exemplary embodiment, the refrigeration circuit comprises natural refrigerant such as r290. Those skilled in the art will recognize that use of such natural refrigerant requires compliance with certain laws and regulations, particularly laws and regulations defining maximum charge amounts. In one or more embodiments, the refrigeration system module 12 comprises one or more hermetically sealed refrigeration circuits comprising r290 refrigerant at a charge of less than or equal to 150 grams. In another embodiment, the refrigeration system module can comprise one or more refrigeration circuits that utilize other types of refrigerant and/or other charge amounts (e.g., 150 grams of charge or greater).

Each illustrated refrigeration system module 12 comprises a complete compression-driven refrigeration circuit including an evaporator assembly 50, a compressor 52, a condenser assembly 54, a drier 56, an expansion valve 58, and interconnecting tubing. It is also expressly contemplated that the prefabricated refrigeration system 12 can comprise more than one refrigeration circuit as part of the same module in certain embodiments. Those skilled in the art will be familiar with the basic components, functions, and operations of these components in a compression-driven refrigeration circuit. It is contemplated that other temperature control modules in the scope of this disclosure could provide heat and/or could use secondary refrigerant circuits to maintain the desired cabinet interior temperatures. As will be explained in further detail below, in the illustrated embodiment, each prefabricated refrigeration system module 12 (refrigeration system) comprises an independent temperature controller 68 configured to drive the refrigeration system based on a detected temperature.

In an exemplary embodiment, the compressor 52 of each refrigeration system is a variable speed compressor. As will be explained in further detail below, the use of a variable speed compressor is thought to enhance the implementation of multiple refrigeration system modules 12 on the same cabinet module 11 for cooling a common refrigerated space. It will be understood that fixed speed compressors can also be used in certain embodiments.

In the illustrated embodiment, the condenser assembly 54 (broadly, heat rejecting heat exchanger) comprises an air-cooled condenser unit including a condenser fan 60 configured to draw outside room ambient air across condenser coils 62. In certain embodiments, the condenser fan 60 can comprise a fixed speed fan or variable speed fan or a combination of both to meet application requirements. It is also contemplated that the prefabricated refrigeration system can comprise a water-cooled condenser unit in one or more embodiments.

The evaporator assembly 50 (broadly, heat absorbing heat exchanger) comprises evaporator coils 64 in which liquid refrigerant absorbs heat and changes to vapor. Other heat exchangers such as heating elements or secondary refrigerant/glycol coils or loops could also be used to change the temperature inside the free refrigerated space. The evaporator assembly 50 further comprises an evaporator fan 66 configured to draw return air from the cabinet module 11 across the evaporator coils 64 to cool the air before discharging it into the cabinet module through the supply air inlet 30. Like the condenser fan 60 described above, the evaporator fan 66 can be a fixed speed or variable speed or a combination of both to provide the cooling output that meets application requirements. The fans are used to transfer volumes of air from inside the conditioned space of the cabinet 11 to the cooling/heating module and also from the ambient surrounding to the cooling/heating module through the heat exchangers.

Various additional sensors and transducers used for monitoring the operating characteristics of the refrigeration system may also be employed. In one or more embodiments, the temperature controller 68 is configured to receive inputs from these sensors and transducers.

In one or more embodiments, the temperature controller 68 is configured to control the compressor 52 to selectively maintain refrigeration temperatures in a range of from 20° F. to 75° F. The temperature controller 68 may also be configured to control the speed or output of a variable speed condenser fan 60 and/or a variable speed evaporator fan 66 (discussed below) based on algorithms that perform pull-down operations, recovery operations, energy savings operations, or preventative maintenance operations. In certain embodiments, the refrigeration system module further comprises a wired (e.g. RS485) or wireless transceiver (e.g., a cellular modem, Bluetooth, Wifi, and other radio frequency devices) configured to provide communication between the merchandiser controller and a remote communication device. Exemplary ways of utilizing such remote communications are described in U.S. Pat. No. 9,863,694, which is hereby incorporated by reference in its entirety.

In general, the prefabricated refrigeration system modules 12 and the cabinet module 11 comprise mutual connection fittings configured to releasably and operatively connect the prefabricated refrigeration system module to the cabinet module for cooling the interior of the cabinet module and such that an entirety of the prefabricated refrigeration system module is on the exterior of the cabinet module. More particularly, the mutual connection fittings in the illustrated embodiment are configured to mount each refrigeration system 12 on the top wall 18 of the cabinet module 11 entirely above the top wall of the cabinet module for cooling the interior of the cabinet module. Preferably, each refrigeration system module 12 is configured to releasably and operably connect to the cabinet module 11 (e.g., the top wall 18) such that the refrigeration system module 12 can cool the interior of the cabinet when connected. Suitably, the mutual connection fittings also enable the refrigeration system modules 12 to be disconnected from the cabinet modules 11 so that the modules may be separately moved through a standard-height man door to another location as needed.

Referring to FIGS. 9-15, the illustrated refrigeration system module 12 comprises a base 70 that supports the entire refrigeration circuit and control system described above. The base 70 also provides at least some of the facets for the mutual connection fittings that facilitate operative connection with the cabinet module 11. In the illustrated embodiment, the base 70 comprises an evaporator portion 72 and a condenser portion 74. The refrigeration system is supported on the base so that the evaporator assembly 50 is located above the evaporator portion 72 and the condenser assembly 54, the compressor 52, and the drier 56 are located above the condenser portion 74. In the illustrated embodiment, the condenser portion 74 and the evaporator portion 72 are formed from separate pieces of material that are attached together to form the base. For example, in one or more embodiments, the condenser portion 74 and evaporator portion 72 are attached by mechanical fasteners. In the illustrated embodiment, the evaporator portion 72 forms the back end portion of the base 70 and the condenser portion 74 forms the front end portion. This configuration enables the evaporator portion 72 to overlie the respective supply air inlet 30 and the respective return air outlet 32 when the refrigeration system module 12 is deployed.

The evaporator portion 72 forms the bottom wall of an insulated evaporator enclosure 76 that is broadly configured to enclose the evaporator assembly 50 and provide fluid communication with the supply air discharge plenum 36 and the return air plenum 38 of the cabinet module 11. The evaporator enclosure 76 is generally configured to separate the evaporator assembly 50 from the condenser assembly 54. Thus, the illustrated evaporator enclosure 76 includes an insulated front wall generally between the condenser portion 74 and the evaporator portion 72 of the base, which provides thermal separation between the evaporator assembly 50 and the condenser assembly 54. The illustrated evaporator enclosure 76 further includes left and right side walls and a back wall that, together with the front wall, define a 360° insulated perimeter around the evaporator assembly 50. The evaporator enclosure 76 further comprises a removable lid 78 that may be removed as required to access the evaporator assembly 50 for service and maintenance.

The evaporator portion 72 of the base 70 defines a supply air outlet 80 and a return air inlet 82. In the illustrated embodiment, the supply air outlet 80 comprises a slot that is elongate in the widthwise direction of the base 70 and that extends through the thickness of the base at a location adjacent the back wall of the evaporator enclosure 76. The return air inlet 82 is likewise a slot that is elongate in the widthwise direction and is spaced apart in front of the supply air outlet 80. In other words, in the illustrated embodiment, the return air inlet 82 and supply air outlet 80 are spaced apart from one another in the front-to-back direction. The return air inlet 82 and the supply air outlet 80 are respectively sized and arranged for registration with the return air outlet 32 and the supply air inlet 30. As such, when the refrigeration system module 12 is operably connected to the cabinet module 11, the supply air outlet 80 provides fluid communication between the interior of the evaporator enclosure 76 and the supply air inlet 30, and the return air inlet 82 provides fluid communication between the interior of the evaporator enclosure and the return air outlet 32.

Suitably, the kit 10 comprises seals for sealing the interface between the top wall 18 of the cabinet module 12 and the base 70 of the refrigeration system module 12 around the supply air openings 30, 80 and the return air openings 32, 82. For example, one of the prefabricated refrigeration system module 12 and the cabinet module 11 suitably comprises a supply air gasket 84 configured to extend 360° about the supply air openings 30, 80 and another return air gasket 86 configured to extend 360° about the second return air openings 32, 82. In the illustrated embodiment, the prefabricated refrigeration system module 12 comprises a supply air gasket 84 on the lower surface of the base 70 which extends 360° about the supply air outlet. In addition, the prefabricated refrigeration system module 12 comprises a return air gasket 86 on the lower surface of the base 70 which extends 360° about the return air inlet 82. These seals alternatively could be installed on the upper surface of the cabinet module. In the illustrated embodiment, the gaskets 84, 86 comprise two separate pieces of compressible closed-cell foam. However, a single piece of compressible material and compressible material other than closed cell foam may also be used without departing from the scope of the disclosure. Alternatively, interlocking geometry of plastic could also be used to create the seal between refrigeration module and cabinet module.

Figure 12:
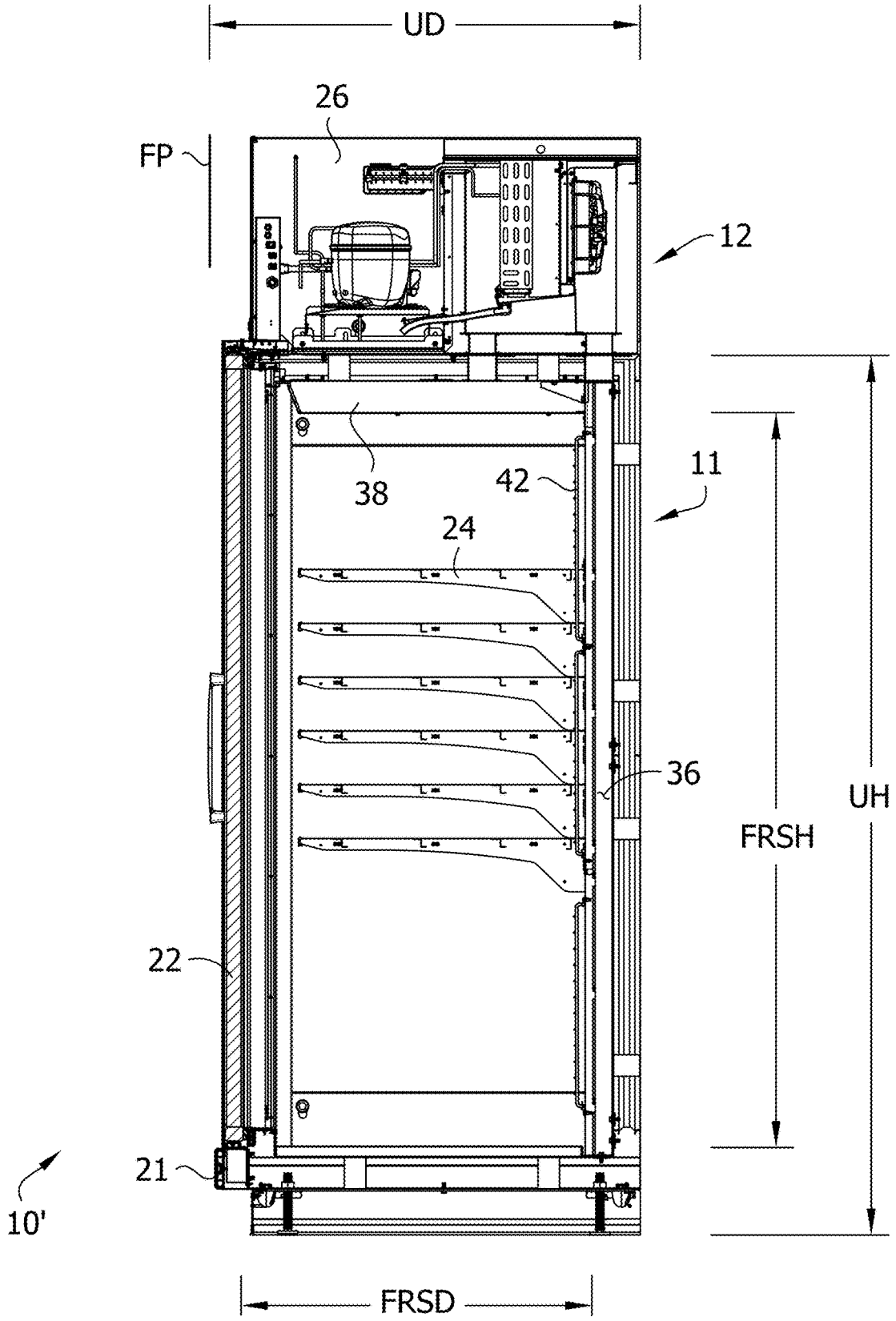
FIG. 12 is a cross-section of the refrigerated merchandiser taken in a front-to-back plane.
Figure 12A:
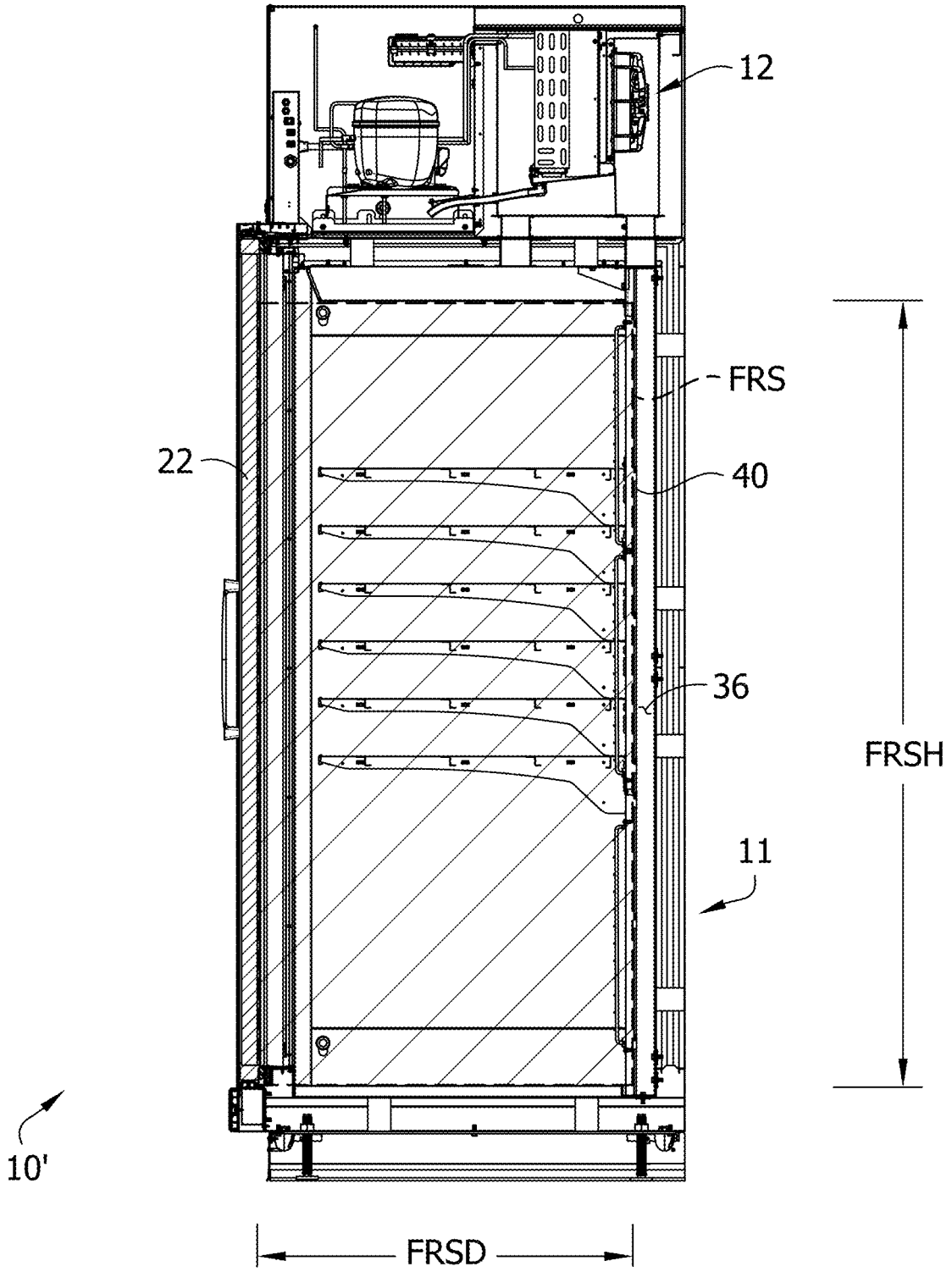
FIG. 12A is a cross-section similar to FIG. 12 with an overlay indicating a cross-section of free refrigerated space within the refrigerated merchandiser.
Figure 12B:
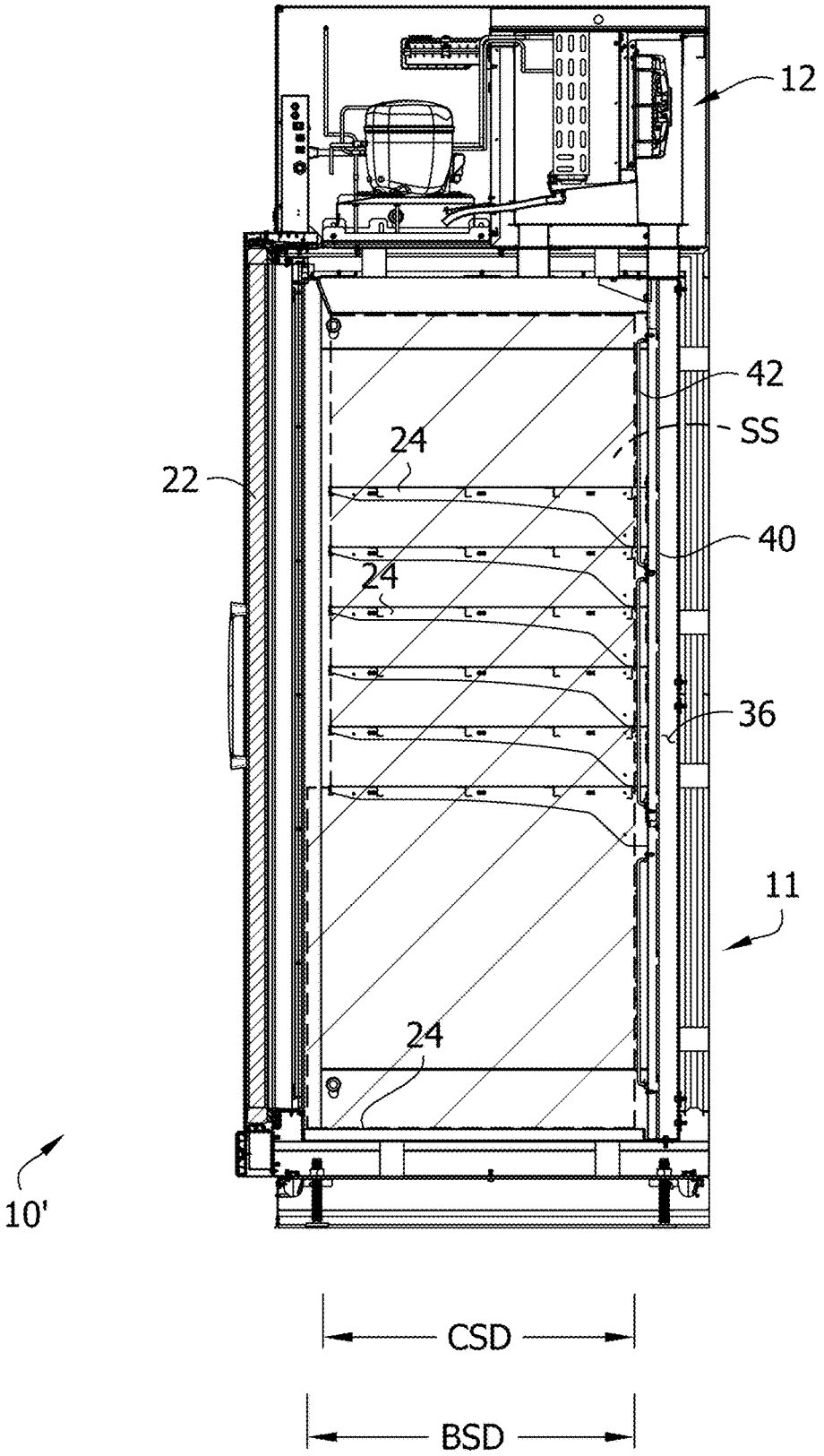
FIG. 12B is a cross-section similar to FIG. 12 with an overlay indicating a cross-section of shelf space within the refrigerated merchandiser.
Figure 13:
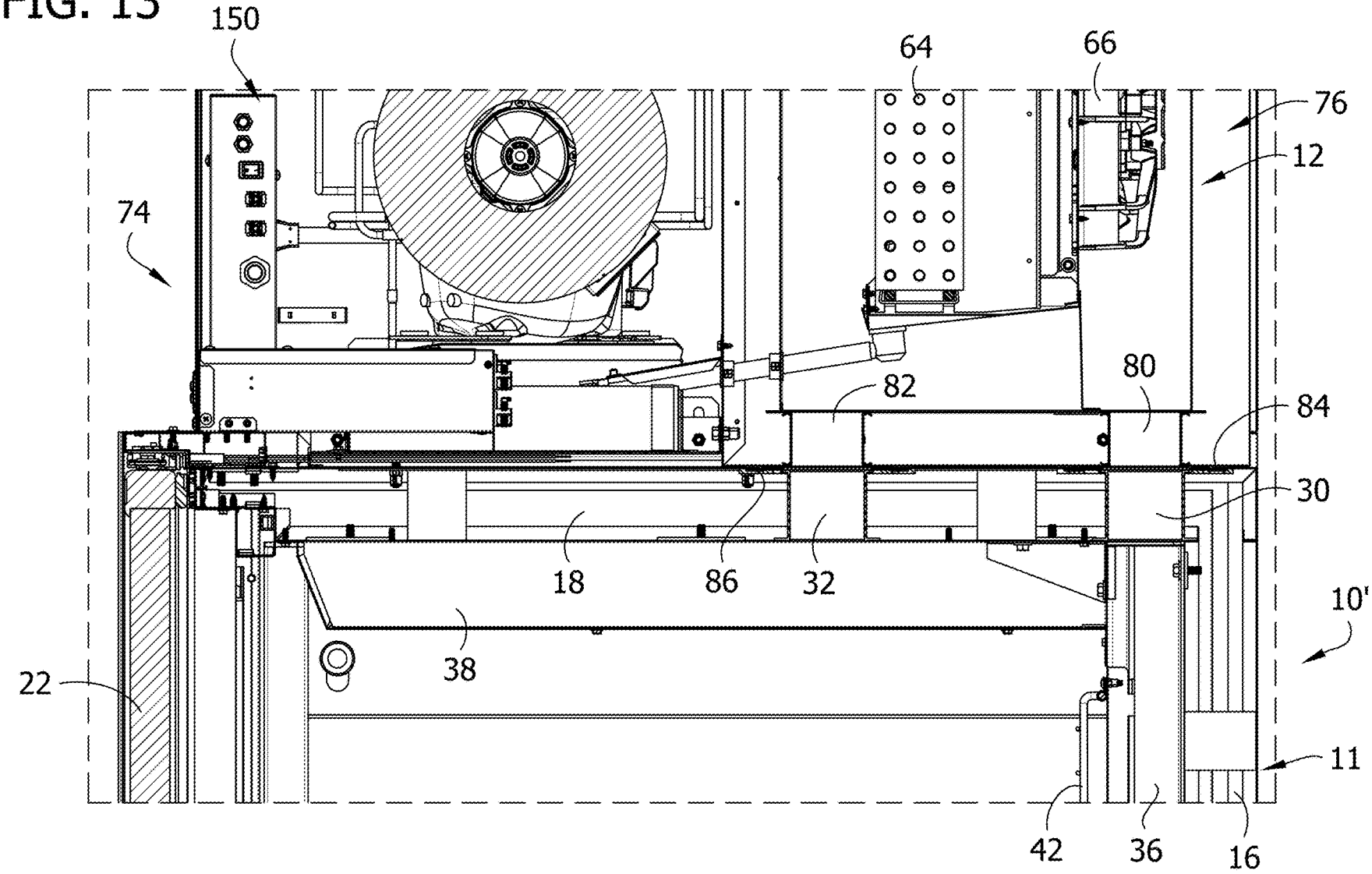
FIG. 13 is an enlarged view of a portion of FIG. 12.
Figure 14:
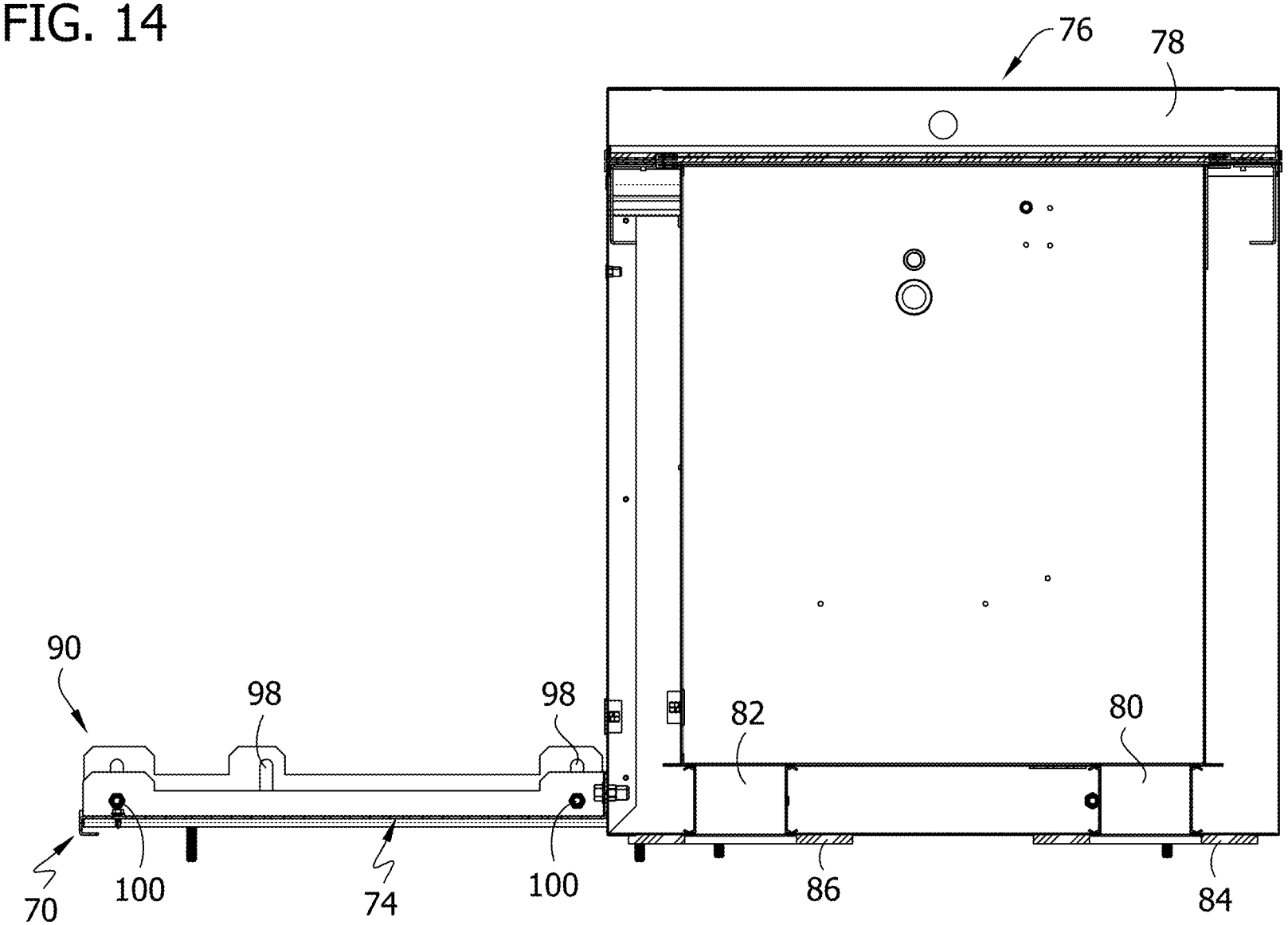
FIG. 14 is a cross-section taken in the plane of line 14-14 of FIG. 11.
Figure 15:
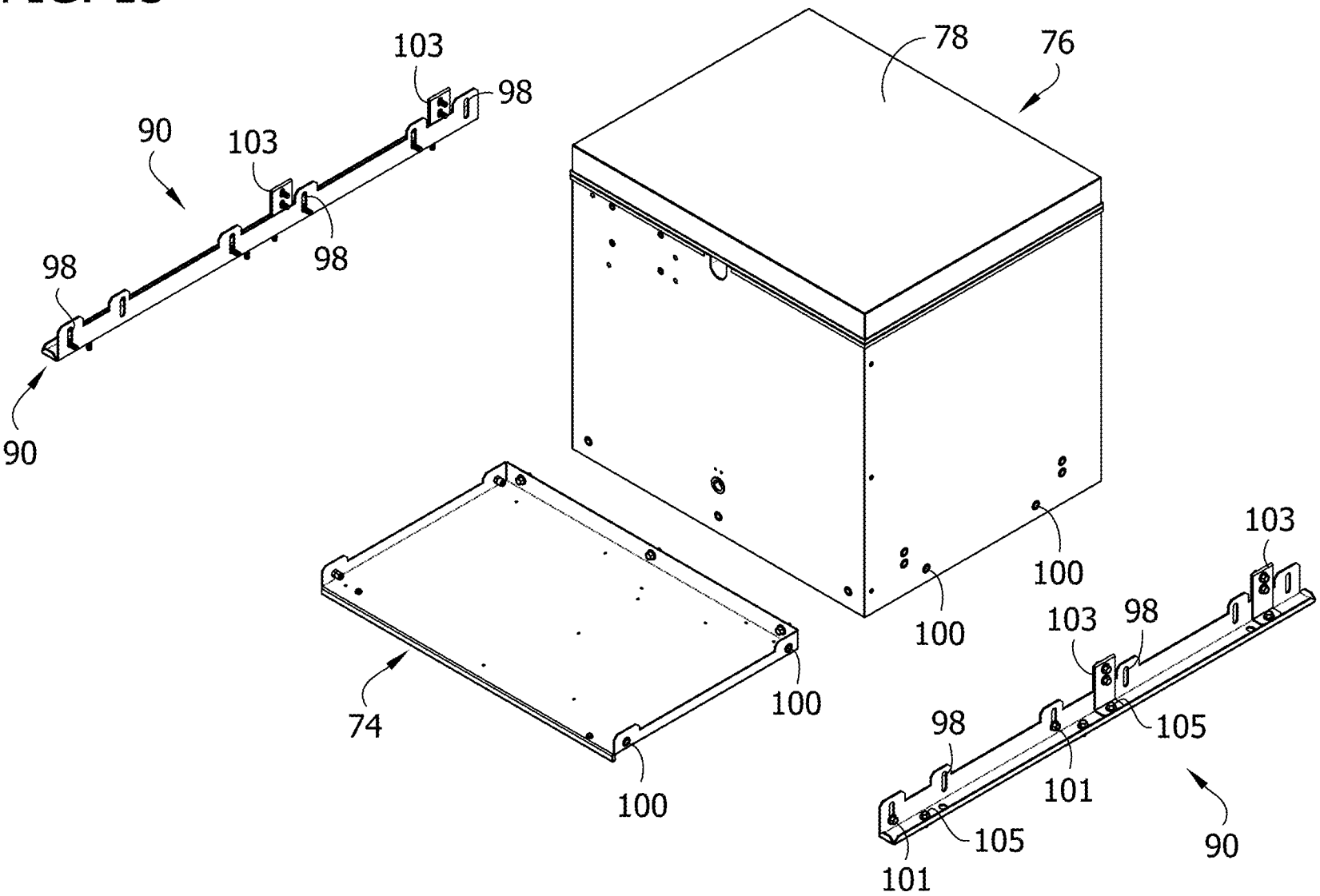
FIG. 15 is an exploded perspective of the assembly of FIG. 11.

Referring to FIGS. 12 and 13, the base 70 is configured to couple to the top wall 18 of the cabinet module 11 such that the supply air gasket 84 is compressed between the base and the top wall to form a fluid seal that extends 360° about the perimeters of the supply air outlet 82 and the supply air inlet 32. Thus, the evaporator fan 66 can blow air across the evaporator coil 64 to cool the air and then direct the supply air into the cabinet 11 through the supply air outlet 80 and the supply air inlet 30. The base 70 is likewise configured to couple to the top wall 18 of the cabinet module 11 such that the return air gasket 86 is compressed between the base and the top wall to form a fluid seal that extends 360° about the perimeters of the return air outlet 32 and the return air inlet 82. Thus, the evaporator fan 66 is configured to draw return air from the free refrigerated space of the cabinet 11 into the front end portion of the return air plenum 38, then rearward along the return air plenum, then upward through the return air outlet 32 of the cabinet module 11, and then further upward through the return air inlet 82 of the refrigeration system module 12 into the evaporator enclosure 76. After directing the air to flow in the evaporator enclosure 76 across the evaporator coils 64, the fan forces the now-supply air to flow through the supply air outlet 80 of the refrigeration system module 12, through the supply air inlet 30 of the cabinet module 11, and along the supply air discharge plenum 36 into the free refrigerated space of the cabinet.

Referring to FIGS. 11 and 14-18, the refrigeration system module 12 further comprises at least one mounting rail 90 configured to facilitate lifting the refrigeration system module 12 as a unit from a lower support surface such as the ground onto the top wall 18 of the cabinet module 11. Furthermore, each rail 90 is configured to be releasably fastened to the top wall 18 of the cabinet module 11 to operably connect the refrigeration system module 12 to the cabinet module. In the illustrated embodiment, the refrigeration system module 12 comprises first and second rails 90 connected to opposing lateral edge margins of the base 70 to extend generally in a front-to-back direction when the prefabricated refrigeration system module 12 is operatively connected to the top wall 18 of the cabinet module 11. Each of the rails 90 functions as a support beam, imparting bending strength to the base 70 to prevent the base from bending or collapsing under the weight of the refrigeration circuit when lifted.

Figure 18:
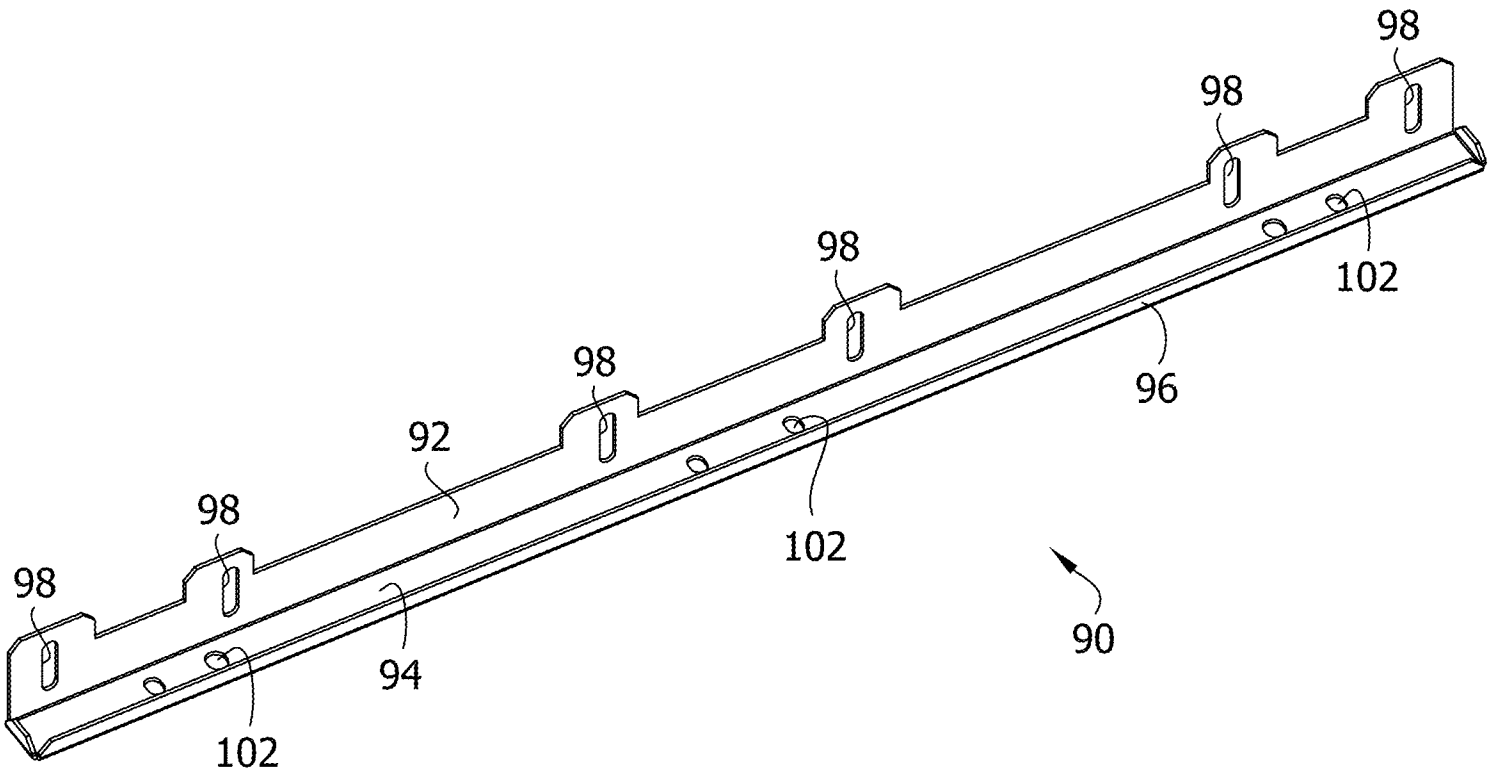
FIG. 18 is a perspective of one of the rails.

Each rail 90 is formed from a generally U-shaped or J-shaped metal channel. As shown in FIG. 18, each rail 90 comprises an inboard adjustment flange 92 for adjustably attaching the rail to the base 70, a bottom web 94 extending laterally outward from the adjustment flange, and an upturned lip 96 defining the laterally outboard side of the rail. Thus, it can be seen that the illustrated rails 90 comprise lower portions having generally U-shaped profiles (also known as a double-return profile). The U-shaped profile provides a grip surface that does not gouge the hand of a technician when the technician grips the rail 90 while lifting the refrigeration system module 12 onto the cabinet module 11. In addition, the U-shaped profiles of the lower portions of the rails 90 enable the refrigeration system module 12 to slide along the top wall of the cabinet module 11 while supported on the rails substantially without marring or gouging the cabinet module. Thus, the illustrated rails 90 comprise non-gouging bottoms.

Figure 16:
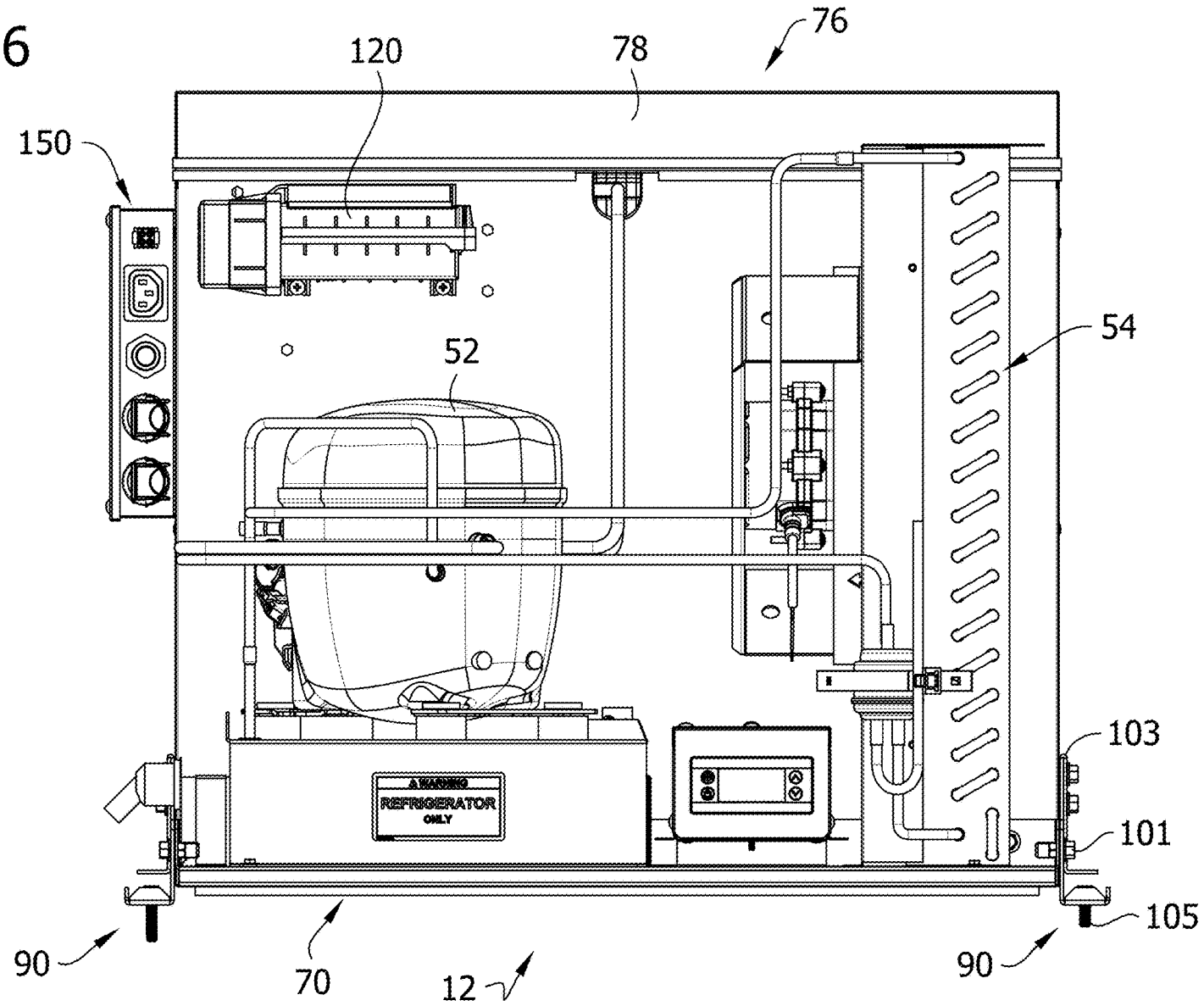
FIG. 16 is a front elevation of the refrigeration system module showing rails thereof in lowered positions.
Figure 17:
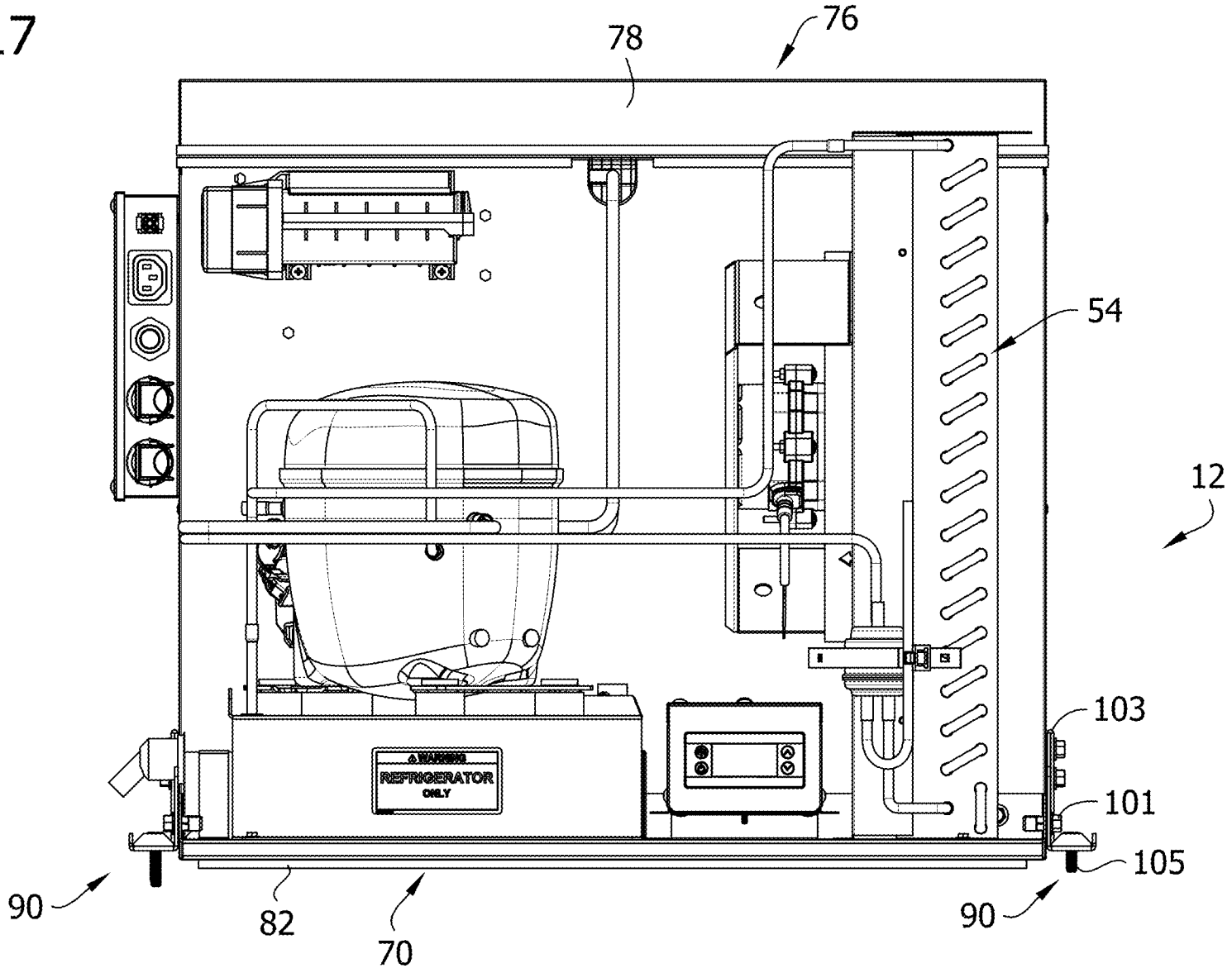
FIG. 17 is a front elevation of the refrigeration system module similar to FIG. 16 but showing the rails in raised positions.

The adjustment flange 92 is configured to facilitate adjustment of the rail between a lowered position (FIG. 16) and a raised position (FIG. 17). In the illustrated embodiment, the adjustment flange 92 comprises a set of vertically elongate attachment slots 98 for attaching the rail to the base 70. Each attachment slot 98 is configured to receive a removable fastener therethrough. Each attachment slot 98 is configured for registration with a corresponding set of attachment points 100 (FIG. 15) on a lateral edge margin of the base 70. In the illustrated embodiment, the base attachment points 100 also comprise holes for receiving a removable fastener 101 such as a screw. Each rail 90 can be fastened to the base 70 in the lowered position by threadably advancing screws 101 through the upper end portions of the attachment slots 98 into the attachment holes 100 formed in the respective side of the base 70. In addition, each rail 90 can be fastened to the base 70 in the raised position by threadably advancing screws 101 through the through the lower end portions of the attachment slots 98 into the attachment holes 100 formed in the respective side of the base 70.

As shown in FIGS. 16 and 17, the bottom portion of each rail 90 protrudes below the bottom of the base 70 and the gaskets 84, 86 in the lowered position but is one of (i) flush with and (ii) spaced apart above the bottom of the base when the rail is in the raised position. This enables the refrigeration system module 12 to be initially placed onto the top wall 18 of the cabinet module 11 with the rails 90 in the lowered positions, such that the weight of the refrigeration system module is supported on the rails. This prevents the gaskets 84, 86 from being compressed before the refrigeration system module 12 is properly positioned along the top wall 18 and allows for easier sliding movement of the refrigeration system module along the top wall. After being initially placed onto the top wall 18 of the cabinet module 11, the refrigeration system module 12 can slide along the top wall, with the rails 90 acting as sliding points of contact, to the location at which the refrigeration system module is operably aligned with the cabinet module.

The bottom web 94 of each rail 90 defines a set of integral attachment points 102 used for fastening the refrigeration system module 12 to the cabinet module 11 in an operative position. In particular, the bottom web 94 defines a plurality of screw holes 102 arranged for registration with the integral screw holes 34 of the top wall 18 of the cabinet module 11. Rear ones of the screw holes 102 align with mounting brackets 103 connected to the sides of the base 70 (e.g., screwed to the side walls of the evaporator enclosure 76). Each refrigeration system module 12 is configured to be operatively connected to the cabinet module 11 by threadably advancing screws 105 mounting through each of the screw holes 102 formed in the bottom web of each rail 90 into a corresponding screw hole 34 on the top wall 18 of the cabinet module 11. The rear screws 105 are fastened to the top wall of the cabinet 11 through the mounting brackets 103.

In summary, the refrigerated merchandiser kit 10 comprises separate cabinet and refrigeration system modules 11, 12 that can be releasably and operably connected together using mutual connection features or fittings that are integrated into the modules. In the illustrated embodiment, the mutual connections fittings include supply air inlet and outlet openings 30, 80 and a supply air gasket 84 that are configured to align to provide substantially sealed fluid passaging from the downstream side of the evaporator assembly 50 to the supply air discharge plenum 36 of the cabinet 11. Similarly, the mutual connections fittings of the illustrated kit 10 include return air inlet and outlet openings 32, 82 and a return air gasket 86 that are configured to align to provide substantially sealed fluid passaging from the upper end of the refrigerated interior of the cabinet to the upstream side of the evaporator assembly 50. Still further, the mutual connection fittings of the illustrated kit 10 comprise corresponding sets of mechanical attachment points 34, 102 by which the refrigeration system module 12 is configured to be releasably fastened to the top wall 18 of the cabinet module 11 at the operative position, for example by threadably advancing screws 105 through the screw holes 102 of the refrigeration system module 12 into the screw holes 104 formed in the top wall 18 of the cabinet module 11.

A method of installing one or more refrigeration system modules 12 on the cabinet module 11 will now be briefly described. In an exemplary embodiment, the kit 10 comprises instructions for performing this method. Initially, the prefabricated cabinet module 11 and the refrigeration system module 12 are separately moved through a doorway to a desired location within a building. After removing any packaging materials, the technician can begin the process of loading the refrigeration system module 12 onto the cabinet module 11. The rails 90 of the prefabricated refrigeration system module 12 will initially be in the lowered positions (FIG. 16). The installers can lift the refrigeration system module 12 onto the top wall 18 while holding the module by the rails 90. After placing the refrigeration system module 12 onto the top wall 18, the installers can slide the refrigeration system module in front-to-back and lateral directions along the top wall as needed until the screw holes 102 in the bottom webs of the rails align with the screw holes 34 in the top wall. In this position, the supply air outlet 80 will substantially align with the supply air inlet 30 and the return air inlet 82 will substantially align with the return air outlet 32. (In certain embodiment, the modules may include snap-in features (not shown) that engage when the cabinet module reaches the correct position).

Figure 16A:
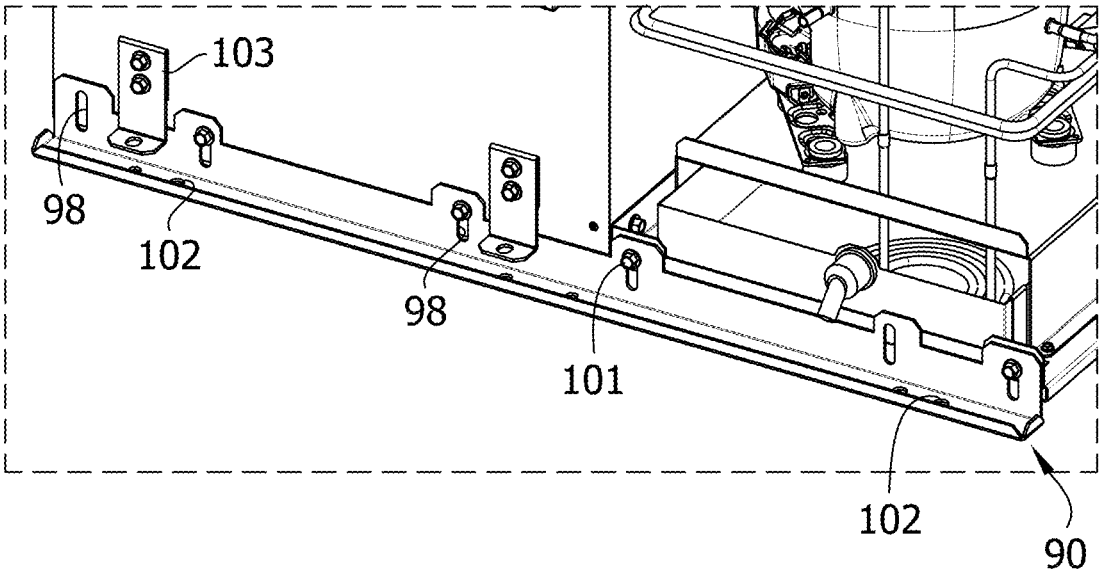
FIG. 16A is an enlarged perspective of a portion of the refrigeration system module showing one of the rails in the lowered position.
Figure 16B:
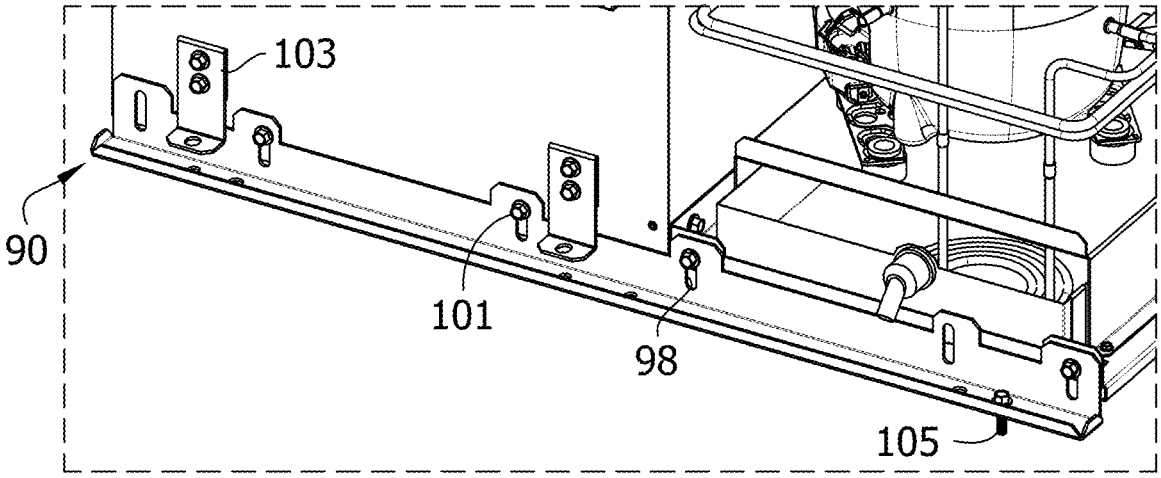
FIG. 16B is an enlarged perspective similar to FIG. 16A showing a first screw installed in the rail for temporarily retaining the refrigeration system module in position.
Figure 17A:
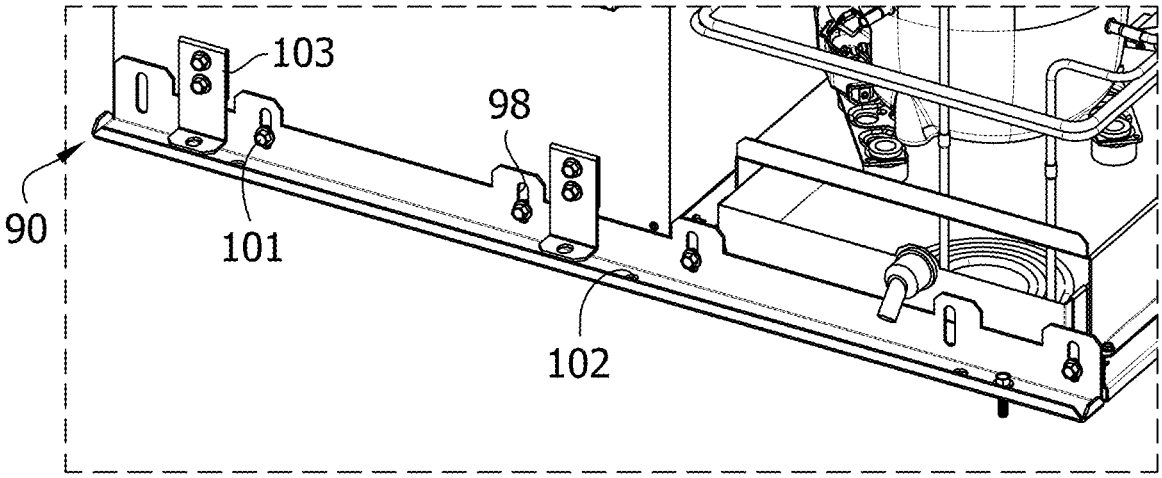
FIG. 17A is an enlarged perspective of a portion of the refrigeration system module showing one of the rails in the raisedposition.
Figure 17B:
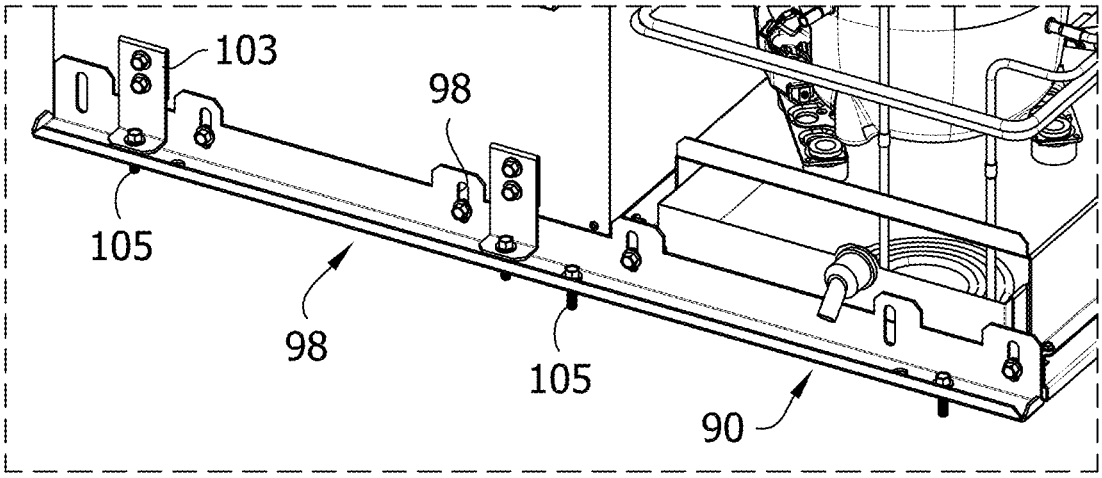
FIG. 17B is an enlarged perspective similar to FIG. 17A showing a set of screws installed in the rail for retaining the refrigeration system module in position on the cabinet module.

As shown in FIGS. 16A-16B, in this location, screws 105 can be threadably advanced through the front-most bottom screw holes 102 in the rails 90 into the front-most screw holes 34 in the top wall 18 of the cabinet module 11 to temporarily retain the refrigeration system module 12 in the aligned position. Subsequently, as shown in FIG. 17A, the installers can loosen the screws 101 from the attachment slots 98 in the adjustment flange 92. This will cause the base 70 to drop down between the rails 90 and compress the gaskets 84, 86, thereby forming fluid seals at the interface between the cabinet module 11 and the refrigeration system module 12 about the supply air openings 30, 80 and the return air openings 32, 82. As shown in FIG. 17B, the installers can finally advance the screws 105 through the mounting brackets 103, rear rail screw holes 102, and rear cabinet screw holes 34 to secure refrigeration system module 12 to the cabinet. Finally, the screws are tightened into the attachment slots 98 to secure the rails 90 in the raised positions and thereby operatively connect the refrigeration system module 12 to the cabinet module 11.

Figure 19:
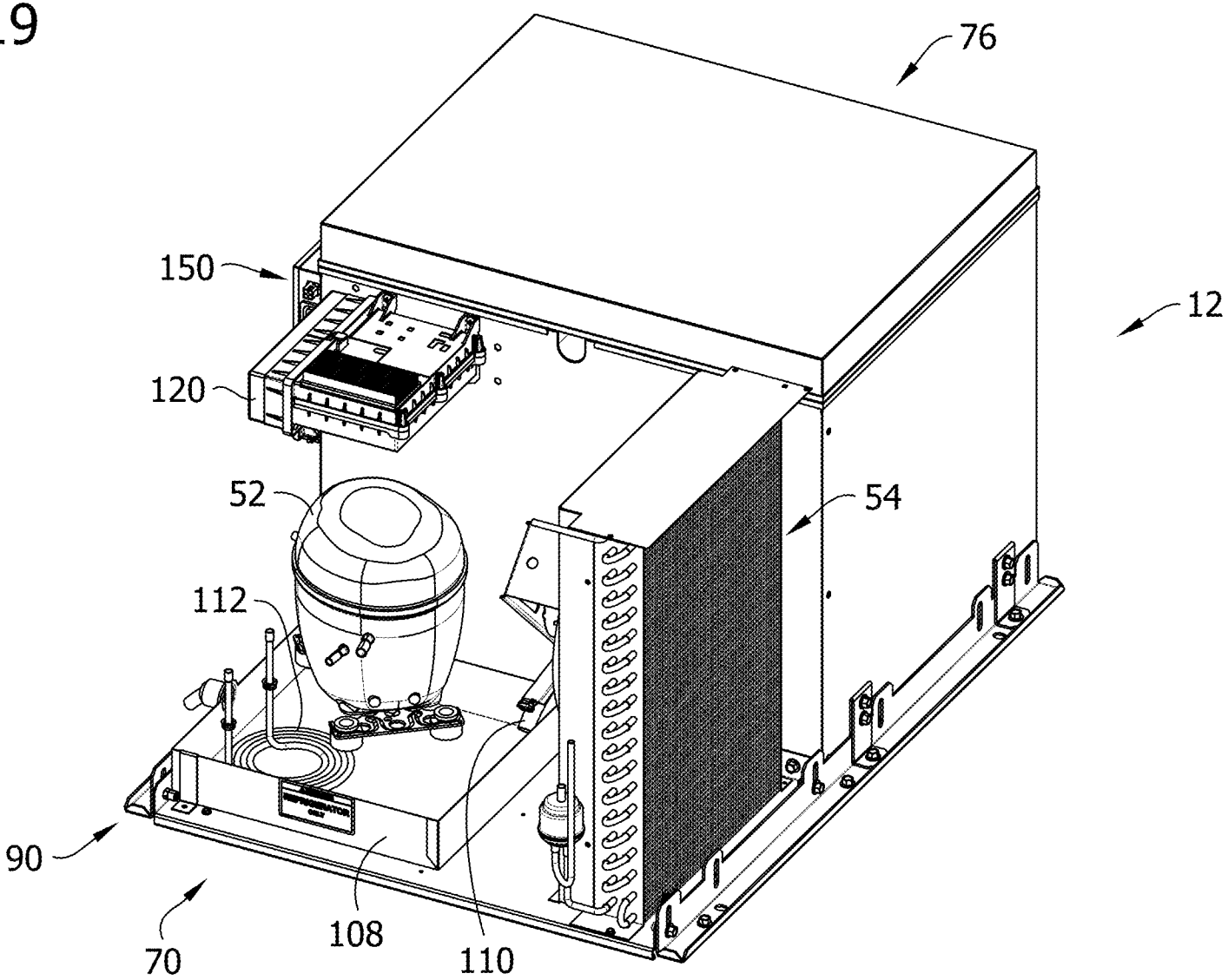
FIG. 19 is a perspective of the refrigeration system module with parts removed to show a condensate heater.

Referring to FIGS. 9 and 19, in the illustrated embodiment, the refrigeration system module 12 comprises an integrated condensate removal system 104 for removing the condensate byproduct of refrigeration which forms on the evaporator coils 64 during use. The condensate removal system 104 is a prefabricated component of the refrigeration system module 12 which requires no field assembly to operate. The condensate removal system 104 includes an evaporator drain pan 106 below the evaporator coil 64 and above the evaporator portion 72 of the base 70 (inside the evaporator enclosure), condensate drain pan 108 above the condenser portion 74 of the base (outside of the evaporator enclosure), a drain tube 110 through which condensate in the evaporator drain pan may drain into the condensate drain pan, and a heating element 112 in thermal communication with the condensate drain pan for heating condensate received therein to cause evaporation. A drain tube heater or conductive material that wicks heat from the defrost heater is also required for applications where condensate can freeze in the drain line. These heating elements ensure condensate can flow between the two drain pans 106, 108. Suitably, the condensate removal system 104 does not require any water pumps to operate. Instead, water can drain from the evaporator drain pan 106 to the condensate drain pan 108 by gravity. For example, the drain conduit 110 has an inlet fluidly connected to a bottom of the evaporator drain pan 106 and an outlet fluidly connected to the condensate drain pan 108 that is lower than the inlet. In the illustrated embodiment, the heating element 112 comprises a hot gas line of the refrigeration circuit. In addition, the condenser fan 60 can be directed so that hot air coming off of the condenser coil 62 flows across the top of the condensate drain pan 108 to further heat the tray. Other heating elements may also be used alone or in combination, such as an electric condensate heater with an optional float switch or capacitive or electric measurement to trigger the electric circuit to provide electric heat and/or a bank of wicks or pads used to create surface area. Additional controls may be employed that trigger and control this electric heater circuit for adding additional heat to the condensate drain pan.

Figure 20:
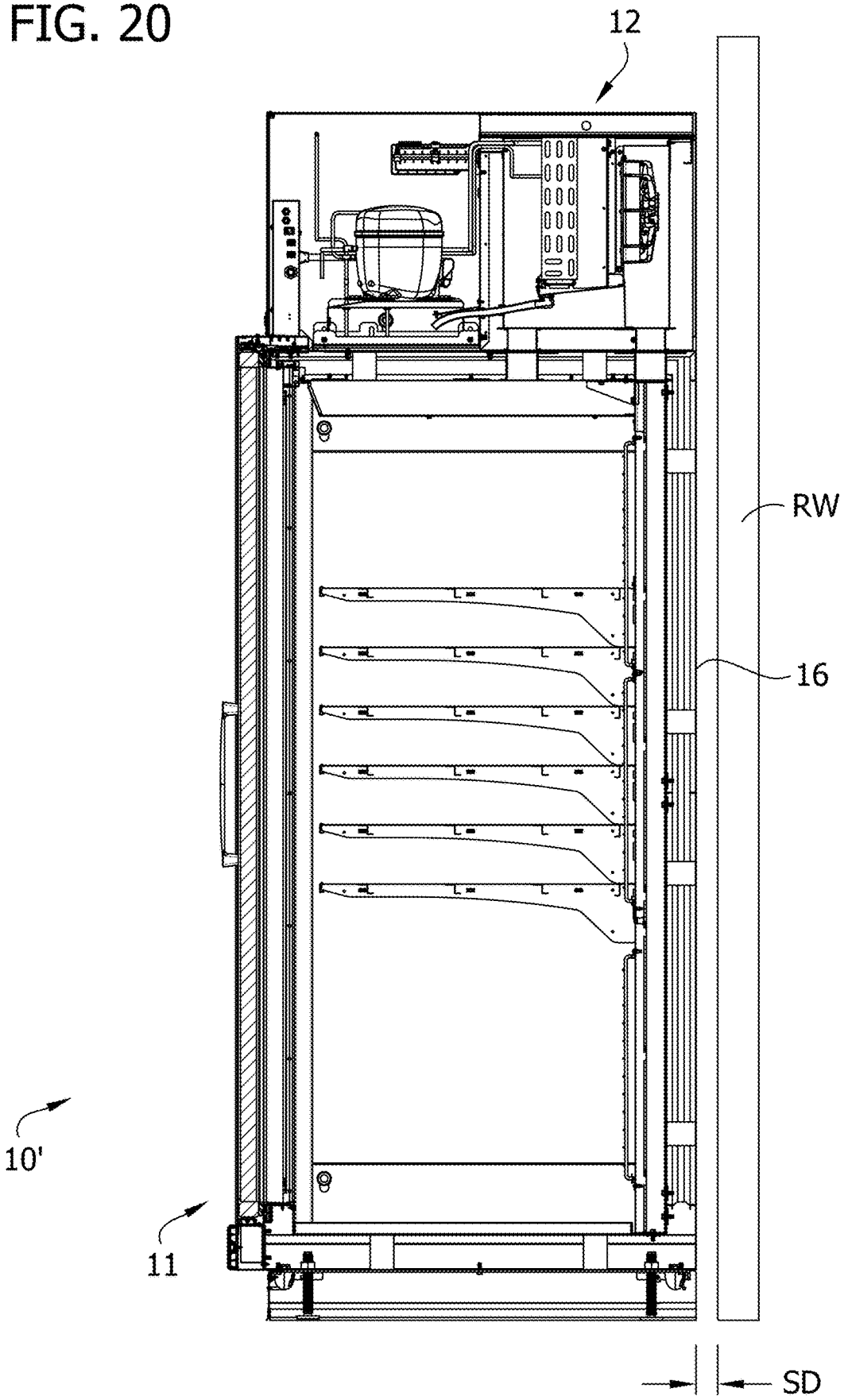
FIG. 20 is a cross section similar to FIG. 12 showing the merchandiser at a deployed and operating position against a retail building wall.

Referring to FIG. 20, the condensate removal system 104 being integrated with the prefabricated refrigeration system module 12 may enable the refrigerated merchandiser 10' to provide greater pack-out volume within a given occupied footprint of a retail building, particularly when compared to other field-installable refrigerated merchandiser kits known to those skilled in the art. As shown in FIG. 20, the field-installable refrigerated merchandiser kit 10 is configured to be deployed as a refrigerated merchandiser 10' by releasably and operatively connecting the prefabricated refrigeration system module 12 to the top wall 18 of the cabinet module 11 and positioning the back wall 16 of the cabinet module against a retail wall RW (broadly, backing structure). As shown, the back wall 16 of the cabinet module 11 is spaced apart from the retail wall RW by a spacing distance SD, which can be less than three inches in one or more embodiments (e.g., less than two inches, less than one inch, or at zero offset). This can be achieved because, among other things, the retail merchandiser 10' formed by the kit 10 requires no vertical condensate line nor piping nor wiring chases nor mechanical stand-offs along the back of the cabinet 11.

As can be understood in view of the foregoing, in one aspect, the present disclosure provides a large-capacity merchandiser 10' that is configured to be cooled to refrigeration and freezer temperatures entirely by prefabricated refrigeration systems 12. More particularly, the present disclosure provides a large-capacity merchandiser 10' with volumetric shelf space greater than 10,000 $in^3$ (e.g., greater than 12,500 $in^3$, greater than 15,000 $in^3$, greater than 20,000 $in^3$, greater than 25,000 $in^3$, or even greater still) configured to be cooled to refrigeration and freezer temperatures entirely by hermetically sealed refrigeration systems charged with natural refrigerant at a charge level that complies with predominant worldwide regulatory standards. For example, in one or more embodiments, the present disclosure provides such a large-capacity merchandiser 10' cooled entirely by a plurality of refrigeration systems 12 that run on r290 refrigerant at a charge of less than or equal to 150 g. To achieve such large capacity using only prefabricated, natural refrigerant refrigeration, the inventors have developed a new system for deploying multiple refrigeration systems 12 to cool the same common refrigerated space.

In the illustrated cabinet 11, the free refrigerated space is a single, contiguous refrigerated space. Throughout this disclosure, the term "common refrigerated space" is used to describe such a single, contiguous refrigerated space in a merchandiser 10' that includes multiple refrigeration systems for cooling the same undivided (i.e., common) refrigerated space.

In general, refrigerated merchandisers 10' in accordance with the present disclosure can incorporate a plurality of discrete refrigeration systems 12 for cooling a common refrigerated space, wherein each refrigeration system comprises an independent temperature controller 68 configured to control the respective refrigeration system independently of the other refrigeration systems. As explained above, each refrigeration system 12 comprises a separate refrigeration circuit, comprising at least a respective evaporator assembly 50, compressor 52, condenser assembly 54, expansion valve 58, and interconnecting tubing. Although exemplary embodiments of the refrigerated merchandiser 10' use field-installable refrigeration system modules 12, it is contemplated that aspects of this disclosure pertaining to multiple independent temperature control and multiple refrigeration system integration can also be used in a fully self-contained refrigeration cabinet employing a plurality of refrigeration systems. In an exemplary embodiment, each independent temperature controller 68 is digital temperature controller (e.g., one of many suitable temperature controllers is a Dixell XR70CH temperature controller). However, other types of temperature controllers (e.g., pressure controllers, analog thermostats) may also be used in one or more embodiments.

As explained above, the illustrated cabinet 11 has a width UW and the discrete refrigeration systems 12 are configured to be operatively connected to the cabinet at a plurality of locations spaced apart along the width of the cabinet. Each refrigeration system module 12 comprises its own air temperature sensor 69 (illustrated schematically in FIG. 24; e.g., a thermistor or RTD) configured to detect an air temperature of the common refrigerated space at a respective location corresponding to the location of the refrigeration system 12 on the cabinet 11. Thus, the illustrated merchandiser 10' provides individual temperature sensors 69 for independent temperature controllers 68 at locations spaced apart along the width of the cabinet 11. In an exemplary embodiment, each temperature sensor 69 is located in the return air passaging, e.g., in the return air plenum 38 or a return air port 32, 82. Each temperature sensor 69 is operatively connected to the temperature controller 68 to output a signal representative of the detected temperature at the respective location. Each independent temperature controller 68 is configured to independently control the respective refrigeration system 12 based on the detected air temperature at the respective location. As will be explained in further detail below, the inventors believe that cooling a common refrigerated space in a cabinet 11 by independently controlling a plurality of individual refrigeration systems 12 substantially enhances the robustness of a merchandiser cooling system and provides significant protection of temperature-sensitive merchandise over and above what is currently achievable with conventional refrigeration solutions.

Referring to FIG. 2, each of the plurality of refrigeration systems 12 is contained within a common air space defined by the shroud 26. Moreover, at least one refrigeration system 12 is positioned so that the condenser fan 60 blows warm air in a direction generally toward an adjacent refrigeration system. The inventors have recognized that this warm air has the potential to reduce the cooling performance of the of the adjacent (downstream) refrigeration system 12. To mitigate against the adverse effects of this warm air flow, as shown in FIG. 2 (see also FIG. 2B) the illustrated merchandiser 10' includes one or more isolators 118 providing thermal and fluid isolation of adjacent condenser assemblies 54. In the illustrated embodiment, the isolator 118 comprises a dividing wall between the condenser fans 60 of two adjacent refrigeration systems 12. The dividing wall 118 attaches to the top wall 18 of the cabinet 11 via screws and stands upright, forming a divider between adjacent refrigeration systems 12. The dividing wall diverts air flow from the upstream condenser fan 60 away from the downstream refrigeration system 12. It is contemplated that other types of thermal isolators may also be used to redirect air moved by a condenser fan away from an adjacent heat exchanger. For example, in certain embodiments, the isolator comprises a duct for each condenser fan 60 configured to carry the air moved by the respective condenser fan away from the adjacent condensers.

As mentioned above, each refrigeration system 12 comprises a variable speed compressor 52. Each refrigeration system 12 further comprises an inverter 120 that connects the temperature controller 68 to the respective compressor 52 for controlling the speed of the compressor. In other words, each refrigeration system 12 comprises an inverter compressor. Each inverter 120 is operatively connected to the respective temperature controller 68 so that the temperature controller 68 can output a control signal to the inverter 120. The inverter 120 is configured to vary the frequency of alternating current output to the compressor 52 and thereby drive the compressor at a speed proportional to the alternating current frequency. This eliminates stop-start cycles and substantially moderates the inrush of current to the compressors 52 at startup. As will be explained in further detail below, the illustrated merchandiser 10' is configured to run all of the refrigeration systems 12 from a single power input 122. Moderating the inrush of current at startup is critical to preventing the refrigerated merchandiser from tripping a circuit breaker or other current limiter on the premises.

Each independent temperature controller 68 is configured to adjust the speed of the variable speed compressor 52 based on the detected air temperature at the respective location. In one or more embodiments, a user can use a user interface connected to the temperature controller 68 to adjust a set point temperature for the refrigeration system 12. In the illustrated embodiment, the set point temperature of each refrigeration system 12 can be set independently via a respective user interface, but it is contemplated that other embodiments can use a common interface for all of the independent temperature controllers 68 to ensure that each of the independent temperature controllers has the same set point.

The temperature controllers 68 may employ various methods for independently controlling the speed of each variable speed compressor 52. In one example, for each individual refrigeration system 12, when the detected air temperature at the respective location is greater than the required temperature, the independent temperature controller 68 is configured to signal the variable speed compressor inverter 120 in the same way it would a single-speed compressor, and the inverter uses internal logic to set the speed of the compressor 52. This method is referred to as the "drop in" method. In the "drop in" method, the inverter 120 uses internal parameters, timers, and logic to determine the rate at which to run the variable speed compressor 52. For example, at a basic level, the inverter 120 can be configured to gradually increase the speed of compressor 52 as the temperature controller 68 continuously signal the inverter to provide cooling. The independent temperature controller 68 also communicates a defrost signal to the inverter 120. The timers, parameters, and response rates for each variable speed compressor 120 and inverter 52 are configured such that the multiple refrigeration systems 12 work in concert to uniformly cool the cabinet 11, and moreover, can make up for lost cooling capacity in the event that one of the refrigeration systems goes offline.

In another example, which may be referred to as "proportional" control mode, each independent temperature controller 68 has a defined "proportional control band," e.g., a temperature range about the user-defined required temperature setting. When the detected air temperature at the respective location is greater than the required temperature settings plus the proportional band, the temperature controller 68 provides a frequency output to the variable speed compressor inverter 120, which communicates to the compressor 52 to run at its highest speed. As detected temperature decreases to be within the proportional control band, the temperature controller 68 reduces the frequency output proportionally. In response, the inverter 120 reduces the speed of the variable speed compressor 52. Additionally, during defrost, cycle starts, and cycle stops, the temperature controller 68 can output unique frequencies to the variable speed compressor inverter 120 to account for these transitory states. Of course, it will be understood that alternatively to a frequency output, a temperature controller 68 could provide a serial output to the variable speed compressor inverter for even more precise control and feedback. The serial control can gather information as to the status of the variable speed compressor 52 and inverter 120. Based on the mechanical systems' ability to reach and hold the required temperature setting, integral and derivative signals can be provided from the temperature controller 68 to the variable speed compressor inverter 120 to achieve the user defined temperature setting. It will be further understood that more complex algorithms, such as hybrids of the above-described "drop in" algorithm and "proportional" algorithm may be used by each independent temperature controller 68 to set the compressor speed.

By equipping each refrigeration system 12 with a variable speed compressor 52 independently controlled by the respective independent temperature controller 68, the illustrated refrigerated merchandiser 10' builds in substantial redundancy that improves merchandising reliability in the event of a malfunction, particularly in the embodiment shown in which each refrigeration system 12 mounts atop the top wall 18 of the cabinet 11 entirely out of the cold space. In conventional refrigerated merchandisers, e.g., those of the hybrid refrigeration type, refrigeration repairs often require unstocking the cabinet 11 to access the refrigeration system. Furthermore, when there is a malfunction, it affects the entire cooling capacity of the merchandiser. The reduced temperatures cannot be maintained while the repair is made. By contrast, when one of the refrigeration systems 12 of the merchandiser 10' has a malfunction, the malfunctioning unit can be repaired or replaced while the other refrigeration system(s) continues to provide cooling to the common refrigerated space. Moreover, the variable speed control algorithms executed by the independent temperature controllers 68 in the remaining refrigeration system(s) will automatically make up for a substantial portion of the lost cooling by increasing the compressor speed. Furthermore, because of the kitted, field-installable nature of the illustrated refrigeration system modules 12, any defective refrigeration system module can be replaced with a new or refurbished refrigeration system module in short order, without the involvement of any skilled tradesmen, and without any intrusion into the cold space.

Figure 21:
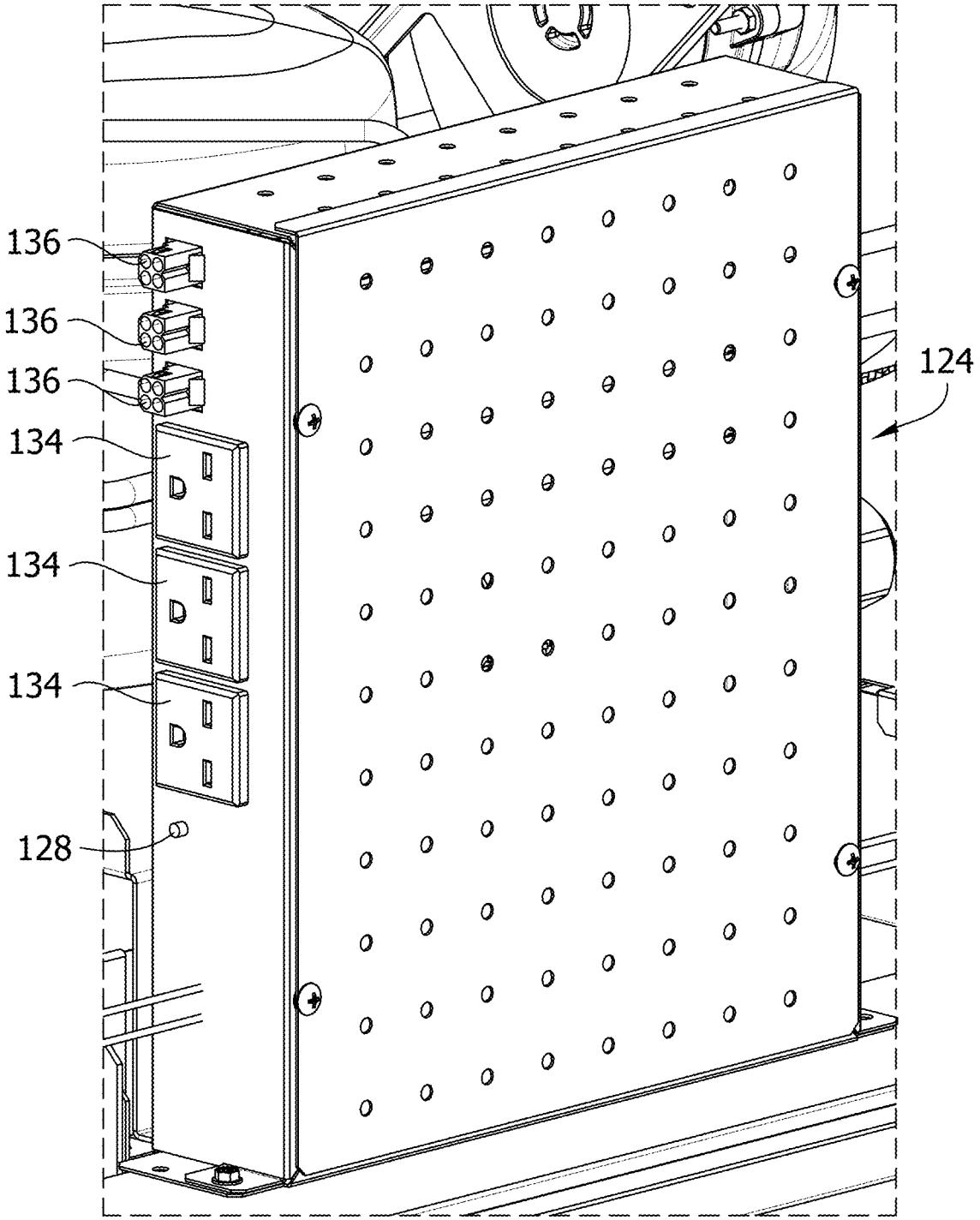
FIG. 21 is an enlarged perspective of the refrigerated merchandiser showing one side of a main electrical box thereof.
Figure 22:
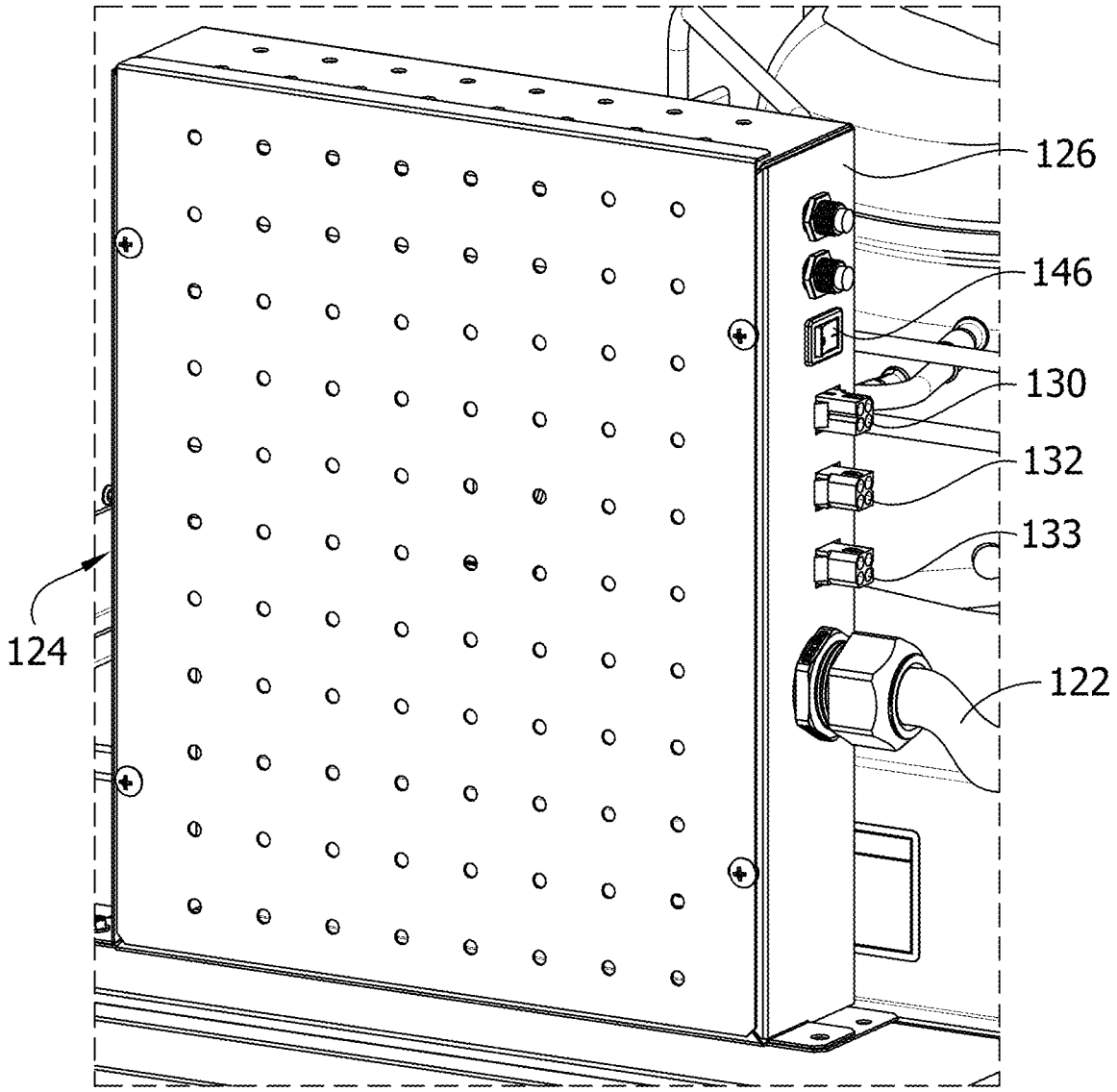
FIG. 22 is an enlarged perspective of the refrigerated merchandiser showing an opposite side of the main electrical box.
Figure 23:
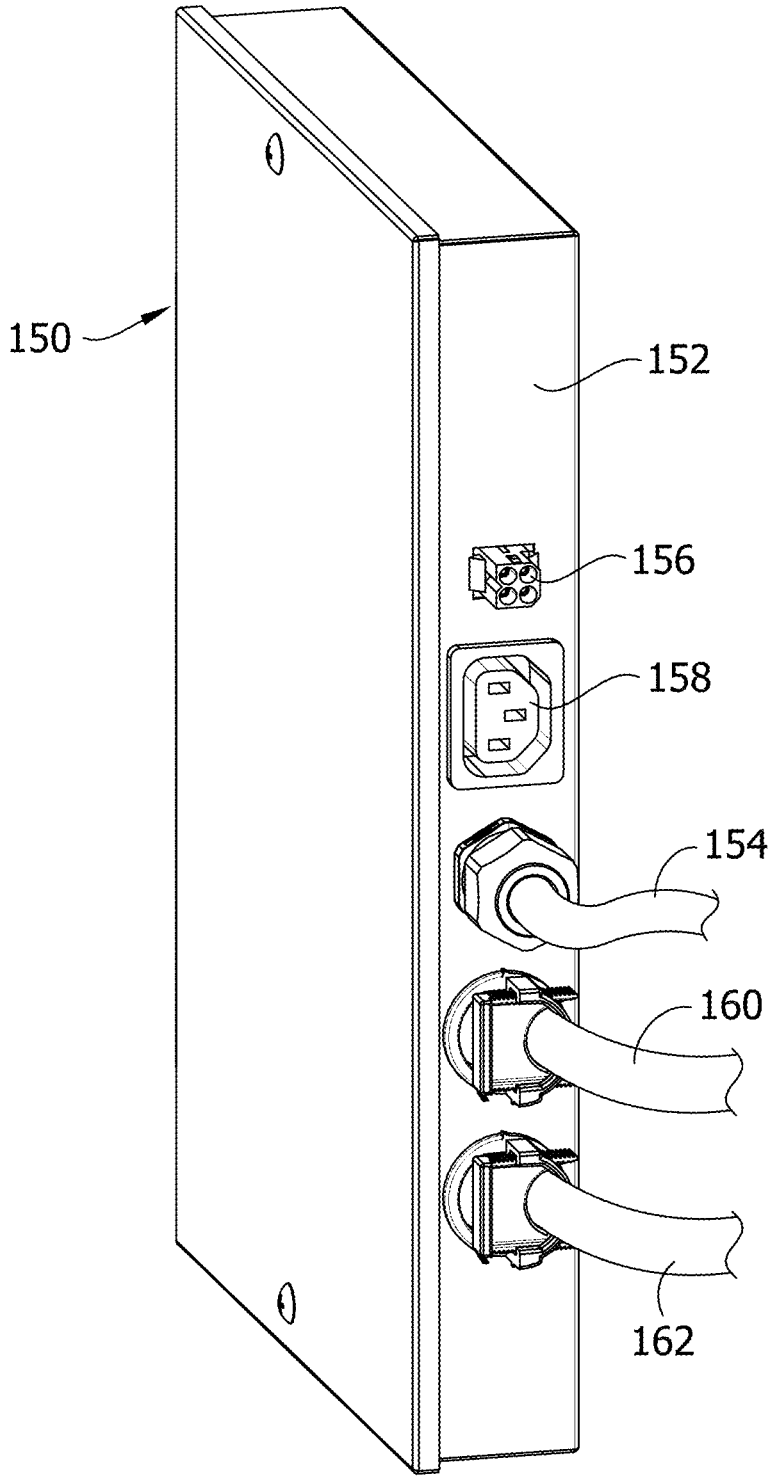
FIG. 23 is an enlarged fragmentary perspective of the refrigerated merchandiser showing a system-dedicated electrical box.

Referring to FIGS. 21-23, the illustrated refrigerated merchandiser 10', with its multiple refrigeration systems 12, uses only a single power input 122 and is configured to distribute power from the single power input to each of the plurality of refrigeration systems for cooling the common refrigerated space. The refrigerated merchandiser 10' comprises a main electrical box 124 (see also FIGS. 1 and 3), and the power input 122 comprises a power cord extending from the main electrical box. Typically, the power cord 122 will be terminated by a standard electrical plug-in connector suitable for the application. In an exemplary embodiment, the power input 122 may comprise a NEMA 6-30P grounded power cable, but it will be understood that different amperage and conductor combinations could be used, such as NEMA 14-30P, etc., depending upon the amperage requirements and wiring methods of a given application. Still further, in certain embodiments, the single power input 122 could be connected by an electrician onsite. Throughout this disclosure, the term "plug-in connector" refers to any type of male, female, or hermaphroditic electrical connector that enables an electrical connection to be made, without employing a skilled electrician, by plugging two such connectors together and, optionally, actuating any fastening mechanism(s) (e.g., latches, threaded coupling nuts, bayonet locks, etc.) that are part of the plug-in connectors.

The main electrical box 124 is configured to route power and signals to the various systems of the merchandiser 10'. The main electrical box 124 includes one or more electrical panels 126, 128 configured to facilitate plug-in connections from the individual refrigeration units 12 and the cabinet 11.

Referring to FIG. 22, the main electrical box comprises a first electrical panel 126 from which the power input 122 extends. The first electrical panel 126 comprises a plurality of signal and load plug-in connectors 130, 132, 133. The signal and load plug-in connectors 130, 132, 133 can comprise any suitable panel-mounted electrical connector configured to mate (and optionally latch) with a corresponding cable connector. Such connectors are well-known to those skilled in the art and sold by, among others, Amp, Inc. and Molex. Each signal and load plug-in connector 130, 132, 133 is configured to operatively connect to a mating connector (e.g., a latching plug; not shown) that terminates a cable connected to a cabinet system (see FIG. 24) such as the door sensor circuit 140, the cabinet lighting system 142, the cabinet heating system 144, and/or the heated pressure relief valve 145. In the illustrated embodiment, the plug-in connector 130 is configured to connect to the door sensor circuit 140 (as described in further detail below), the plug-in connector 132 is configured to connect to the lighting system 142 and heating system 144, and the plug-in connector 133 is configured to connect to the heated pressure relief valve 145. In the illustrated embodiment, the first electrical panel 126 further comprises a mode switch 146 configured to simultaneously switch each of the refrigeration units between a plurality of switchable operating modes, such as between a freezer mode and a cooler mode. Actuating the mode switch 146, signals each of the independent temperature controllers 68 to change its control algorithm from one for a freezer operating mode to one for a cooler operating mode, or vice versa.

Referring to FIG. 21, the main electrical box 124 of the illustrated embodiment comprises a set of plug-in connectors 134, 136 configured for connection to the individual refrigeration systems 12. In the illustrated embodiment, the panel 128 comprises three pairs of connectors 134, 136, which enable the main electrical box to operably connect to up to three independent refrigeration systems 12. The electrical panel 128 comprises three high voltage plug-in connectors 134 (broadly, a plurality of high voltage plug-in connectors) operatively connected to the single power input 122 such that each refrigeration system 12 can draw power from the single power input through a respective one of the high voltage plug-in connectors 134. In an exemplary embodiment, each high voltage plug-in connector 134 can comprise a 6-15R receptacle configured to mate with a 6-15P plug (not shown). The illustrated electrical panel 128 further comprises three signal and load plug-in connectors 136 configured facilitate electrical communication between the refrigeration systems 12 and the cabinet systems, as will be explained in further detail below.

Referring to FIG. 23, each refrigeration system 12 comprises a dedicated electrical box 150 with a system-dedicated electrical panel 152. A system power cable 154 extends out of the electrical box 150 and is terminated by a plug-in connector (e.g., a 6-15P plug, not shown) configured to make a plug-in connection to one of the high voltage plug-in connectors 134, whereby the cable operatively connects the refrigeration system 12 to the single power input 122 for drawing power from the single power input for cooling the common refrigerated space. The illustrated system-dedicated electrical panel 152 also comprises a signal and load connector 156. Not shown is a separate cable configured to connect the refrigeration system 112 to the main electrical box 124. More particularly, such a cable has a first end portion terminated by a first plug-in connector configured to make a plug-in connection to one of the connectors 136 on the main electrical box 124 and a second end portion terminated by a second plug-in connector configured to make a plug-in connection to the plug-in connector 156 on the system-dedicated electrical box 150. In the illustrated embodiment, the system-dedicated electrical panel 152, further comprises a plug-in power connector 158, which can be used to power (via plug-in connection) certain auxiliary systems that may be used in combination with the refrigeration system 12 (e.g., electrical condensate heaters, connectivity gateways, top mounted lighting and display devices, etc.). In the illustrated embodiment, cables 160, 162 extend from each system-dedicated electrical box to carry power and control signals to/from the refrigeration system 12.

Referring to FIGS. 21-23, a method of connecting the refrigeration systems 12 and the cabinet 11 using the electrical boxes 124, 150 will now be briefly described. In the illustrated embodiment, after the refrigeration systems 12 are physically mounted atop the cabinet, they can be electrically connected using only plug-in connectors, without requiring the services of skilled electrical tradesman. In some embodiments, the installer physically attaches the main electrical box 124 to the cabinet module 11 during the field-installation process. For example, the installer places the main electrical box in position atop the cabinet 11 and threads screws into pre-formed screw holes in the top of the cabinet 11 to secure the main electrical box 124 at the proper location. The power cable 154 from each refrigeration system 12 is plugged into one of the high voltage connectors 134 on the main electrical box 124, and separate cables are used to connect the signal and load connector 156 of each refrigeration system 12 to one of the signal and load connectors 136 on the main electrical box. To connect the door sensor circuit 140 of the cabinet 11 to the main electrical box 124, a cable associated with the door sensors (not shown) is plugged into connector 130 on the main electrical box. To connect the cabinet heaters 144 and the cabinet lights 142 to the main electrical box 124, a cable associated with these cabinet components (not shown) is plugged into the connector 132. And likewise, to connect the heated pressure relief valve 145 to the main electrical box 124, a cable associated with the relief valve (not shown) is plugged into the connector 133. Lastly, the single power input 122 is plugged into a building power outlet to power all of the components of the merchandiser 10' from a single source.

Figure 24:
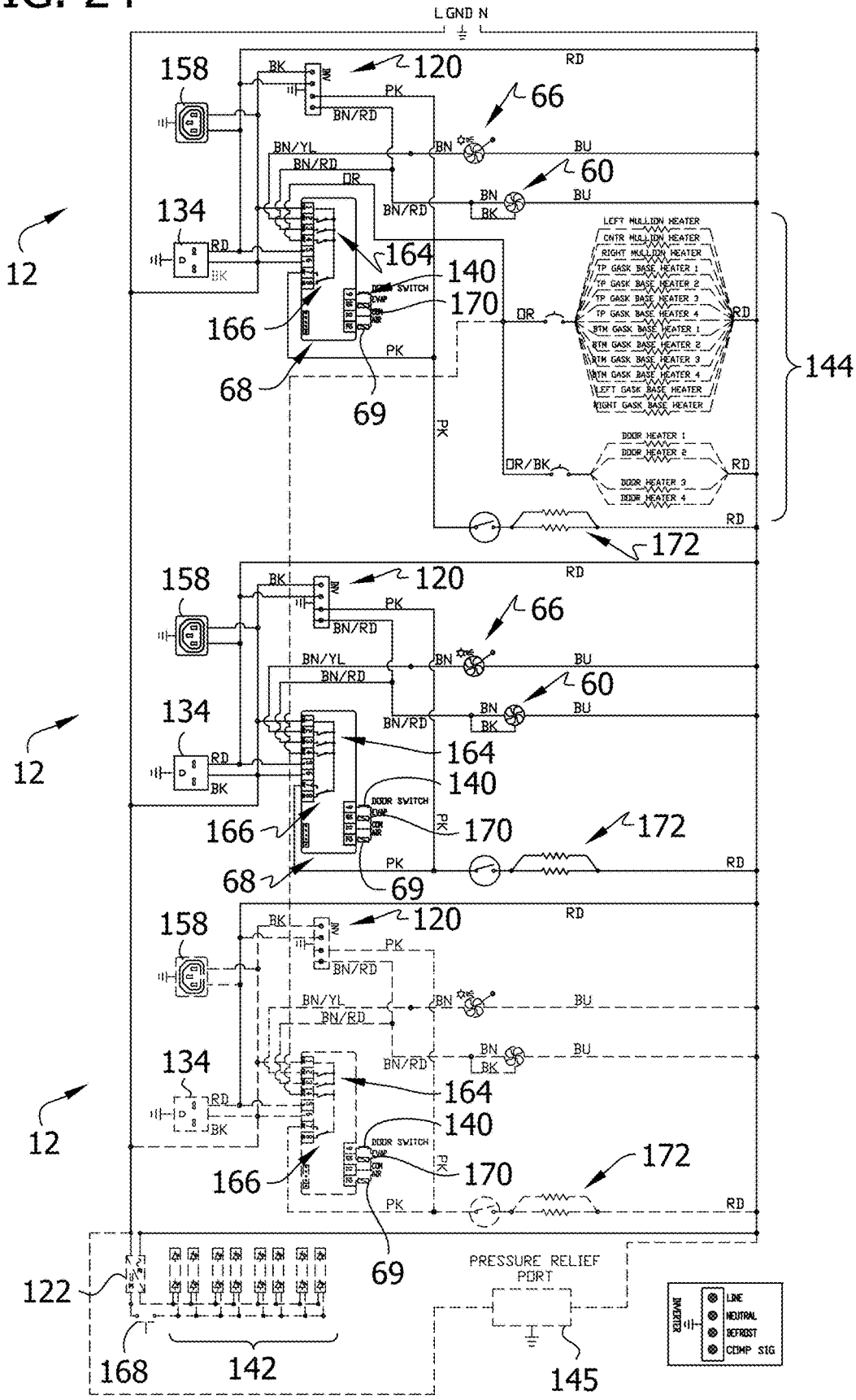
FIG. 24 is a schematic wiring diagram of the refrigerated merchandiser.

FIG. 24 provides a schematic illustration of how all of the components of the merchandizer 10' are wired together after the main electrical box 124 and the system-dedicated electrical boxes 150 are used to connect and power the refrigeration systems 12 and cabinet systems 140, 142, 144, 145, as described above. In the illustrated example, two refrigeration systems 12 are shown in solid line to represent the two refrigeration systems 12 of the merchandiser 10'. Broken lines show how it is possible to connect a third refrigeration system 12 via plug-in connections to the main electrical box 124 without any further modifications to the system. Although the illustrated electrical system is configured to accept a maximum of three refrigeration systems 12, it is contemplated that that the main electrical box could be expanded to connect to more than three refrigeration systems in one or more embodiments. As shown, each refrigeration system 12 draws power from a single power input 122 via a respective high voltage connector 134. Each temperature controller 68 includes inputs for receiving signals from the door sensor circuit 140, the air temperature sensor 69, and an evaporator temperature sensor 170. Based on the temperature detected by the air temperature sensor 69, each temperature controller 68 is configured to actuate a set of relays 164 that control outputs to the compressor inverter 20, the evaporator fan 66, and the condenser fan 60. Hence, each temperature controller 68 is configured to independently control the respective refrigeration system 12 based on the temperature signal output from the temperature sensor 69.

Suitably, each temperature controller 68 is configured to output a cabinet control signal to one or more cabinet systems, such as the cabinet lights 142 and/or the cabinet heaters 144. Each of the illustrated temperature controllers 68 controls a relay 166 that provides the cabinet control signal to the cabinet heaters 144. As shown, the multiple temperature controllers 68 are connected to the cabinet heaters 144 in parallel. At any point in time, if any one of the temperature controllers 68 is outputting a cabinet control signal to the cabinet heaters 144, the cabinet heaters will be active. Various methods and algorithms for controlling cabinet heaters of a refrigerated merchandiser 10' are known and may be used without departing from the scope of the disclosure. In one embodiment each temperature controller defines a duty cycle for the cabinet heaters and outputs the control signal to independently control the cabinet heaters according to the defined duty cycle. In the illustrated embodiment, the cabinet lights 142 are controlled by a separate manual switch 168. But it is also contemplated that the cabinet lights 142 may be controlled by the temperature controllers 68 in one or more embodiments. For example, the multiple temperature controllers 68 may be coupled to the cabinet lights 142 in parallel so that, if any one of the temperature controllers is outputting a cabinet control signal to the cabinet lights 142 at a given point in time, the cabinet lights will be active. In the illustrated embodiment, the main electrical box 124 hardwires the heated pressure relief valve 145 to the power supply 122 such that a heater on the relief valve runs at 100% duty cycle. It will be understood that the heated pressure relief valve may draw power in other ways without departing from the scope of the disclosure.

In an exemplary embodiment, the door sensor circuit 140 comprises a plurality of door sensors (e.g., one door sensor for each door 22) connected together in series, and the door sensor circuit is configured to communicate with the temperature controllers 68 in parallel. Hence, if any of the door sensors is outputting a signal indicating that the respective door 22 is open, the door sensor circuit 140 transmits a signal to the all of the temperature controllers 68. The temperature controllers 68 are suitably configured to control the refrigeration system based on the signals from the door sensor circuit 140. In one embodiment, each temperature controller 68 is configured to turn off the respective evaporator fan 66 in response a signal from the door sensor circuit 140 indicating that a door 22 is open. In certain embodiments, the temperature controllers 68 are configured to monitor the time that the door sensor circuit 140 continuously outputs a signal indicating that a door is open. Each temperature controller 68 is configured to (i) turn off the evaporator fan 66 for an initial interval of time, and (ii) after the initial interval of time, turn the evaporator fan back on. This ensures that cooling is provided in the event of a door sensor fault or a scenario in which one of the doors 22 is stuck open.

In the illustrated embodiment, each refrigeration system 12 comprises a defrost heater 172. The refrigerated merchandiser 10' is configured to periodically execute a defrost cycle in each refrigeration system 12 in which the respective temperature controller 68 turns on the defrost heater 172 and turns off the evaporator fan 66 for a period of time. In general, the refrigerated merchandiser 10' is configured to execute the defrost cycles in each refrigeration system at different times. More particularly, each independent temperature controller 68 independently executes defrost cycles as a function of the respective system's run time (e.g., compressor run time). The run time of each of the refrigeration systems 12 will inherently vary because each system runs on an independent temperature control based on a detected temperature at a unique location. Each temperature controller 68 is configured to periodically execute a defrost cycle in which the temperature controller turns on the defrost heater 172 and turns off the evaporator fan 66 for a period of time. Each independent temperature controller 68 is configured to monitor an elapsed run time of the respective refrigeration system 12 since a last defrost and to initiate a subsequent defrost cycle when the elapsed run time exceeds a defined defrost interval.

In an exemplary method of repairing the refrigerated merchandiser 10', a defective one of the refrigeration system modules 12 is initially removed from the cabinet 11. Removal of the defective refrigeration system module 12 does not require the involvement of any specialized tradesmen. Rather, any technician can simply unscrew the rails 90 from the top wall 18 of the cabinet 11, disconnect the power cord 154 from the high voltage receptacle 136, disconnect the cable from the plug-in connector 152, and then lift the defective refrigeration system 11 off of the top wall 18 of the cabinet. While the defective refrigeration system module 12 is removed, the common refrigerated space in the cabinet 11 is continuously cooled with one or more remaining (operational) refrigeration system modules 12.

When the defective refrigeration system module 12 is removed, it exposes one or more holes in the cabinet 11 (e.g., the cold air inlet 30 and the return air outlet 32). In an exemplary embodiment, after the defective refrigeration system module 12 is removed, the holes 30, 32 are plugged to minimize loss of cold air through the holes. For example, in an exemplary embodiment, the technician plugs the holes 30, 32 with one or more pre-fabricated bung seals (not shown) formed from resiliently compressible sealing material such as closed cell foam and sized to be sealingly received in one or both of the holes 30, 32.

While the defective refrigeration system 12 is removed, the independent temperature controllers 68 of the remaining refrigeration system(s) 12 will automatically increase the speed of the compressor(s) 56 over time to make up for the missing cooling. Thus, it can be seen that various technical features of the merchandiser 10' (e.g., multiple independent temperature control, variable speed compression, top-mounted refrigeration with no intrusion into cold space, simplified/unskilled mechanical and electrical connections between refrigeration system modules and cabinet, etc.) work in concert to enable repair of a defective refrigeration system 12 without loss of merchandise.

Before installing an operational refrigeration system, the technician unplugs the holes 30, 32. In some cases, the technician may be able to quickly repair the refrigeration system module 12 after it has been removed to make it operational again. In such cases, the technician can reinstall the same refrigeration system module 12 on the cabinet module 11 after it has been repaired. In another embodiment, the technician installs an operational replacement refrigeration system module 12 in place of the defective system.

Again, no skilled tradesmen are required to install the operational refrigeration system 12 onto the cabinet 11. Any technician can simply mechanically mount the system onto the top wall using the rails 90 as described above, plug the power cord 154 into a high voltage receptacle 136 in the main electrical box 124, plug the previously unplugged cable into the connector 152, and then the independent temperature controller 68 of the newly installed system will begin independently cooling the common refrigerated space. It can be seen that the illustrated refrigerated merchandiser, with its entirely top-mounted refrigeration systems and multiple independent temperature control redundancy, can be repaired without unpacking merchandise from the reach-in cabinet.

As can be seen, the illustrated refrigerated merchandiser kit 10 is field-installable through a standard-height man entry doorway yet still provides a very large-capacity refrigerated merchandiser 10' once deployed. The merchandiser 10' maximizes packable space by placing all refrigeration components outside of the cabinet 11. In addition, by providing an integrated condensate removal system 104, the merchandiser 10' can be placed in-store with its back tightly positioned against an adjacent structure. Moreover, the merchandiser kit 10 can be installed and put into service without any need of specialized or certified tradesmen such as refrigeration technicians, plumbing technicians, or electricians. Even when multiple refrigeration system modules 12 are employed to cool the very larger common refrigerated space defined within the cabinet module 11, he entire installation process requires only turning a small number of screws and plugging the unit's electrical cord(s) into a standard electrical receptacle(s) along with standard latching electrical connector(s). The ease of installation enabled by the illustrated field-installable merchandiser kit 10 is unparalleled by any refrigerated cabinet of comparable size known to the inventors.

These advantages can pay substantial dividends in the event that the merchandiser 10 should need to be moved to another building or location. The refrigeration system module(s) 12 can be separated from the cabinet module 11 using the same basic techniques in reverse, without need of certified tradesmen. Then the separated modules can be moved through a standard-height man door to a new location where the merchandiser 10' can be redeployed using the same techniques as before.

Moreover, the kit 10 can provide hermetically sealed refrigeration system(s) 12 in combination with a cabinet 11 with an internal capacity on the order of, or greater than, cabinets that conventionally could only be realized using remote refrigeration systems. This is believed to substantially reduce the likelihood of refrigerant loss and generally improve installation, reliability, serviceability, and energy efficiency in comparison with conventional refrigerated 4merchandisers of comparable size.

Furthermore, the illustrated kit 10 provides the benefit of positioning the entire refrigeration system 12 outside of the cabinet interior, which provides substantial improvements in serviceability because no merchandise needs to be removed or unpacked from the cabinet in order to reach any component of the refrigeration system for servicing or maintenance.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. A field-installable refrigerated merchandiser kit comprising:

a reach-in cabinet having an interior, a top wall above the interior, and one or more cabinet systems integrated into the reach-in cabinet;

a refrigeration system including a support structure and a sealed refrigeration circuit supported by the support structure;

a temperature controller including a user interface;

a main electrical distribution assembly including an enclosure and a main power cable configured to extend from the enclosure, the main power cable terminated by a plug-in connector for making a plug-in connection to a main power source;

a power distribution cable terminated by a power distribution cable plug-in connector;

wherein in kit form, (a) the refrigeration system, the main electrical distribution assembly, and the temperature controller are detached from the top wall of the reach-in cabinet and (b) the refrigeration system is electrically disconnected from the main power cable;

wherein the refrigeration system is field-mountable to the top wall of the reach-in cabinet;

wherein the main electrical distribution assembly is field-mountable on the top wall of the reach-in cabinet;

wherein the temperature controller is field-mountable on the top wall of the reach-in cabinet;

wherein the power distribution cable plug-in connector is configured to make a field-installed plug-in connection between the main electrical distribution assembly and the refrigeration system;

wherein the field-installable refrigerated merchandiser kit is configured to be field-installed as a refrigerated merchandiser such that:

the refrigeration system is mounted to the top wall of the reach-in cabinet;

the main electrical distribution assembly is mounted on the top wall of the reach-in cabinet;

wherein the temperature controller is mounted on the top wall of the reach-in cabinet;

the main electrical distribution assembly is configured to distribute power from the main power cable to the refrigeration system, the one or more cabinet systems integrated into the reach-in cabinet, and the temperature controller;

the main electrical distribution assembly is configured to connect the temperature controller to the one or more cabinet systems;

the temperature controller is configured to thermostatically control the sealed refrigeration circuit; and the temperature controller is configured to control the one or more cabinet systems.

2. The field-installable refrigerated merchandiser kit of claim 1, wherein the top wall of the reach-in cabinet has prefabricated attachment points for mounting the refrigeration system, the temperature controller, and the main electrical distribution assembly to the top wall of the reach-in cabinet at predefined locations.

3. The field-installable refrigerated merchandiser kit of claim 2, wherein the prefabricated attachment points are configured so that, when the field-installable refrigerated merchandiser kit is installed as the refrigerated merchandiser, the user interface is in front of the sealed refrigeration circuit and the main electrical distribution assembly is spaced apart from the sealed refrigeration circuit.

4. The field-installable refrigerated merchandiser kit of claim 3, wherein the support structure comprises a plate and webs having first screw holes, the main electrical distribution assembly comprises a bottom portion having second screw holes, and the prefabricated attachment points comprise first prefabricated attachment points and second prefabricated attachment points, the first screw holes arranged to align with the first prefabricated attachment points and the second screw holes arranged to align with the second pre formed screw openings prefabricated attachment points.

5. The field-installable refrigerated merchandiser kit of claim 4, wherein the temperature controller comprises a housing and brackets on the housing, the brackets configured to meet the top wall of the reach-in cabinet forward of the plate.

6. The field-installable refrigerated merchandiser kit of claim 4, further comprising a field-installable shroud, wherein when the field-installable refrigerated merchandiser kit is in kit form, the field-installable shroud is detached from the top wall of the reach-in cabinet, wherein the shroud is configured to be mounted on the top wall of the reach-in cabinet to conceal the refrigeration system when the refrigerated merchandiser kit is installed as a refrigerated merchandiser, wherein the shroud is configured to expose the user interface when mounted on the top wall of the reach-in cabinet.

7. The field-installable refrigerated merchandiser kit of claim 4, wherein the reach-in cabinet comprises a return air plenum in the interior along the top wall, wherein the top wall of the reach-in cabinet comprises a port providing fluid communication between an exterior of the reach-in cabinet and the return air plenum, the first prefabricated attachment points including a first subset of first prefabricated attachment points and a second subset of first prefabricated attachment points spaced apart widthwise from the first subset, wherein the port is in between the first subset of first prefabricated attachment points and the second subset of first prefabricated attachment points, wherein the refrigeration system comprises a gasket configured to circumscribe the port in between the first subset of first prefabricated attachment points and the second subset of first prefabricated attachment points.

8. The field-installable refrigerated merchandiser kit of claim 1, wherein the one or more cabinet systems comprise a cabinet lighting system and one or more heaters and the temperature controller is configured to control the cabinet lighting system and the one or more heaters.

9. The field-installable refrigerated merchandiser kit of claim 1, wherein the sealed refrigeration circuit is charged with r290 refrigerant at a charge of 150 grams or less and the reach-in cabinet defines a free refrigerated space cross-sectional area of at least 1350 square inches.

10. The field-installable refrigerated merchandiser kit of claim 9, wherein when the field-installable refrigerated merchandiser kit is in kit form, the reach-in cabinet is configured to fit upright through a man door doorway of no more than seven feet; wherein when the field-installable refrigerated merchandiser kit is installed as the refrigerated merchandiser, the refrigerated merchandiser is too tall to fit upright through the man door doorway.

11. The field-installable refrigerated merchandiser kit of claim 10, wherein the interior of the reach-in cabinet has a free refrigerated space height of at least 63 inches.

12. The field-installable refrigerated merchandiser kit of claim 11, wherein the reach-in cabinet is configured to accommodate 24-inch-deep shelves.

13. The field-installable refrigerated merchandiser kit of claim 1, further comprising a signal and load cable terminated by a signal and load cable plug-in connector.

14. The field-installable refrigerated merchandiser kit of claim 1, wherein the refrigeration system is a first refrigeration system, the temperature controller is a first independent temperature controller, and the power distribution cable is a first power distribution cable and wherein the power distribution cable plug-in connector is a first power distribution cable plug-in connector, wherein the field-installable refrigerated merchandiser kit further comprises a second refrigeration system, a second independent temperature controller for the second refrigeration system, and a second power distribution cable terminated by a second power distribution cable plug-in connector;

wherein in kit form, the second refrigeration system and the second independent temperature controller are detached from the top wall of the reach-in cabinet and the second refrigeration system is electrically disconnected from the main power cable;

wherein the second refrigeration system is field-mountable to the top wall of the reach-in cabinet;

wherein the second independent temperature controller is field-mountable on the top wall of the reach-in cabinet;

wherein when the field-installable refrigerated merchandiser kit is installed as the refrigerated merchandiser:

the main electrical distribution assembly is further configured to distribute power from the main power cable to the second refrigeration system and the second independent temperature controller; and the second independent temperature controller is configured to thermostatically control the second refrigeration system.

15. The field-installable refrigerated merchandiser kit of claim 14, further comprising a first signal and load cable terminated by a first signal and load cable plug-in connector and a second signal and load cable terminated by a second signal and load cable plug-in connector.

16. The field-installable refrigerated merchandiser kit of claim 14, wherein the sealed refrigeration circuit of the first refrigeration system is a first sealed refrigeration circuit comprising a first variable speed compressor; wherein the second refrigeration system comprises a second sealed refrigeration circuit comprising a second variable speed compressor.

17. The field-installable refrigerated merchandiser kit of claim 16, wherein the base support structure of the first refrigeration system is a first support structure and wherein the first refrigeration system comprises a first inverter supported by the first support structure such that (i) the first inverter is configured to move with the first support structure to an installed position above the top wall of the reach-in cabinet and (ii) the first inverter is configured to be electrically connected to the main power cable when the plug-in connection of the first power distribution cable plug-in connector of the first power distribution cable is made; and wherein the second refrigeration system comprises a second inverter and a second support structure supporting the second inverter such that (i) the second inverter is configured to move with the second support structure to an installed position above the top wall of the reach-in cabinet and (ii) the second inverter of the second refrigeration system is configured to be electrically connected to the main power cable when the plug-in connection of the second power distribution cable plug-in connector of the second power distribution cable is made.

18. The field-installable refrigerated merchandiser kit of claim 17, wherein when the field-installable refrigerated merchandiser kit is installed as the refrigerated merchandiser:

the first independent temperature controller is configured to adjust the first inverter to control a speed of the first variable speed compressor; and the second independent temperature controller is configured to adjust the second inverter to control a speed of the second variable speed compressor.

19. The field-installable refrigerated merchandiser kit of claim 18, wherein when the field-installable refrigerated merchandiser kit is installed as the refrigerated merchandiser both the first independent temperature controller and the second independent temperature controller are configured to moderate inrush of current on the main power cable by independently controlling the first inverter and the second inverter to gradually increase compressor speed at startup.

20. The field-installable refrigerated merchandiser kit of claim 14, wherein the first refrigeration system comprises a first support structure and wherein the second refrigeration system comprises a second support structure;

wherein the first refrigeration system comprises a first dedicated electrical box supported by the first support structure and the second refrigeration system comprises a second dedicated electrical box supported by the second support structure;

wherein (i) the first dedicated electrical box is configured to move with the first support structure to an installed box position above the top wall of the reach-in cabinet, (ii) the second dedicated electrical box is configured to move with the second support structure to an installed box position above the top wall of the reach-in cabinet, (iii) the main electrical distribution assembly is configured to move separately from the first and second refrigeration systems to the top wall of the reach-in cabinet, (iv) the plug-in connection made by the first power distribution cable plug-in connector is between the first dedicated electrical box and the main electrical distribution assembly, and (v) the plug-in connection made by the second power distribution cable plug-in connector is between the second dedicated electrical box and the main electrical distribution assembly.

21. The field-installable refrigerated merchandiser kit of claim 20, wherein the field-installable refrigerated merchandiser kit further comprises a third refrigeration system, a third independent temperature controller for the third refrigeration system, and a third power distribution cable terminated by a third power distribution cable plug-in connector;

wherein in kit form, the third refrigeration system and the third independent temperature controller are detached from the top wall of the reach-in cabinet and the third refrigeration system is electrically disconnected from the main power cable;

wherein the third refrigeration system is field-mountable on the top wall of the reach-in cabinet;

wherein the third independent temperature controller is field-mountable on the top wall of the reach-in cabinet;

wherein when the field-installable refrigerated merchandiser kit is installed as the refrigerated merchandiser:

the main electrical distribution assembly is further configured to distribute power from the main power cable to the third refrigeration system and the third independent temperature controller; and the third independent temperature controller is configured to thermostatically control the third refrigeration system;

wherein the third refrigeration system comprises a third support structure, a third sealed refrigeration circuit, and a third dedicated electrical box;

wherein the third power distribution cable is configured to make a field-installed plug-in connection between the main electrical distribution assembly and the third dedicated electrical box.

22. The field-installable refrigerated merchandiser kit of claim 21, wherein the top wall of the reach-in cabinet comprises:

first prefabricated attachment points configured for mounting the first refrigeration system to the top wall;

second prefabricated attachment points configured for mounting the second refrigeration system to the top wall;

third prefabricated attachment points configured for mounting the third refrigeration system to the top wall;

fourth prefabricated attachment points configured for mounting the main electrical distribution assembly to the top wall;

a first port for the first refrigeration system adjacent the first prefabricated attachment points;

a second port for the second refrigeration system adjacent the second prefabricated attachment points; and a third port for the third refrigeration system adjacent the third prefabricated attachment points;

wherein the first refrigeration system comprises a first gasket configured to circumscribe the first port;

wherein the second refrigeration system comprises a second gasket configured to circumscribe the second port;

wherein the third refrigeration system comprises a third gasket configured to circumscribe the third port;

wherein the first, second, and third prefabricated attachment points and the first, second, and third ports are spaced apart widthwise along the top wall but are aligned in a front-to-back depth direction.

23. The field-installable refrigerated merchandiser kit of claim 22, wherein each of the first sealed refrigeration circuit, the second sealed refrigeration circuit, and the third sealed refrigeration circuit is charged with r290 refrigerant at a charge of 150 grams or less and the reach-in cabinet defines a free refrigerated space cross-sectional area of at least 1350 square inches; wherein when the field-installable refrigerated merchandiser kit is in kit form, the reach-in cabinet is configured to fit upright through a man door doorway of no more than seven feet; wherein when the field-installable refrigerated merchandiser kit is installed as the refrigerated merchandiser, the refrigerated merchandiser is too tall to fit upright through the man door doorway; wherein the interior of the reach-in cabinet has a free refrigerated space height of at least 63 inches; and wherein the reach-in cabinet is configured to accommodate 24-inch-deep shelves.

24. The field-installable refrigerated merchandiser kit of claim 23, wherein in kit form:

the first independent temperature controller and the first refrigeration system are assembled together as a first prefabricated unit;

the second independent temperature controller and the second refrigeration system are assembled together as a second prefabricated unit; and the third independent temperature controller and the third refrigeration system are assembled together as a third prefabricated unit.

25. The field-installable refrigerated merchandiser kit of claim 23, further comprising a field-installable shroud, wherein when the field-installable refrigerated merchandiser kit is in kit form, the field-installable shroud is detached from the top wall of the reach-in cabinet, wherein the field-installable shroud is field-mountable on the top wall of the reach-in cabinet to conceal the first, second, and third refrigeration systems, wherein the field-installable shroud is mounted on the top wall, the user interfaces of the first, second, and third independent temperature controllers are exposed through the field-installable shroud at a front of the refrigerated merchandiser.

26. The field-installable refrigerated merchandiser kit of claim 22, wherein the first sealed refrigeration circuit comprises a first defrost heater, wherein the second sealed refrigeration circuit comprises a second defrost heater, and wherein the third sealed refrigeration circuit comprises a third defrost heater.

27. The field-installable refrigerated merchandiser kit of claim 20, wherein the top wall of the reach-in cabinet comprises:

first prefabricated attachment points configured for mounting the first refrigeration system to the top wall, wherein the first independent temperature controller is configured to attach to the top wall in front of the support structure of the first refrigeration system;

second prefabricated attachment points configured for mounting the second refrigeration system to the top wall, wherein the second independent temperature controller is configured to attach to the top wall in front of the support structure of the second refrigeration system;

third prefabricated attachment points configured for mounting the main electrical distribution assembly to the top wall;

a first port for the first refrigeration system adjacent the first prefabricated attachment points;

a second port for the second refrigeration system adjacent the second prefabricated attachment points;

wherein the first refrigeration system comprises a first gasket configured to circumscribe the first port;

wherein the second refrigeration system comprises a second gasket configured to circumscribe the second port;

wherein the first and second prefabricated attachment points and the first and second ports are spaced apart widthwise along the top wall but are aligned in a front-to-back depth direction;

wherein each of the first sealed refrigeration circuit and the second sealed refrigeration circuit is charged with r290 refrigerant at a charge of 150 grams or less and the reach-in cabinet defines a free refrigerated space cross-sectional area of at least 1350 square inches;

wherein when the field-installable refrigerated merchandiser kit is in kit form, the reach-in cabinet is configured to fit upright through a man door doorway of no more than seven feet;

wherein when the field-installable refrigerated merchandiser kit is installed as the refrigerated merchandiser, the refrigerated merchandiser is too tall to fit upright through the man door doorway;

wherein the interior of the reach-in cabinet has a free refrigerated space height of at least 63 inches; and wherein the reach-in cabinet is configured to accommodate 24-inch-deep shelves.

28. The field-installable refrigerated merchandiser kit of claim 27, wherein the first independent temperature controller comprises a first housing and first brackets on the first housing, the first brackets configured to meet the top wall of the reach-in cabinet forward of the first support structure when the field-installable refrigerated merchandiser kit is installed as the refrigerated merchandiser; and wherein the second independent temperature controller comprises a second housing and second brackets on the second housing, the second brackets configured to meet the top wall of the reach-in cabinet forward of the second support structure when the field-installable refrigerated merchandiser kit is installed as the refrigerated merchandiser.

29. The field-installable refrigerated merchandiser kit of claim 1, wherein the field-installable refrigerated merchandiser kit is configured to be field-installed using only plug-in electrical connections and without making refrigerant line connections during the installation process.

* * * * *